US006120141A

United States Patent [19]

Tajika et al.

[11] Patent Number: 6,120,141

[45] **Date of Patent: *Sep. 19, 2000**

[54] INK JET PRINTING METHOD, INK JET HEAD USED FOR PRACTICING THE LATTER, INK JET CARTRIDGE AND INK JET PRINTING APPARATUS

[75] Inventors: Hiroshi Tajika, Yokohama; Jiro Moriyama, Kawasaki; Toshiharu Inui, Yokohama; Hitoshi Sugimoto, Yokohama; Masaya Uetsuki, Yokohama; Masao Kato, Yokohama; Minako Kato, Yokohama, all of Japan

[73] Assignee: Canon Kabushiki Kaisha, Toyko, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/549,208

[22] Filed: Oct. 27, 1995

[30] Foreign Application Priority Data

Feb. 13, 1995 [JP] Japan ..... 7-023862
Sep. 4, 1995 [JP] Japan ..... 7-226456

[51] Int. Cl.[7] ..... B41J 2/01

[52] U.S. Cl. ..... 347/96; 347/98; 347/101

[58] Field of Search ..... 347/101, 95, 96, 347/98, 100

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/10 |
| 4,463,359 | 7/1984 | Ayata et al. | 347/56 |
| 4,558,333 | 12/1985 | Sugitani et al. | 347/65 |
| 4,608,577 | 8/1986 | Hori | 346/66 |
| 4,723,129 | 2/1988 | Endo et al. . | |
| 4,723,796 | 2/1988 | Endo et al. | 347/56 |
| 4,740,796 | 4/1988 | Endo et al. | 347/56 |
| 4,836,852 | 6/1989 | Knirsch et al. | 347/100 |
| 5,376,958 | 12/1994 | Richtsmeier et al. | 347/40 |
| 5,549,740 | 8/1996 | Takahashi et al. | 106/20 R |
| 5,555,008 | 9/1996 | Stoffel et al. | 347/0 |
| 5,635,969 | 6/1997 | Allen | 347/96 |

FOREIGN PATENT DOCUMENTS

| | | |
|---|---|---|
| 53-024486 | 3/1978 | Japan . |
| 60-071260 | 3/1978 | Japan . |
| 54-043733 | 4/1979 | Japan . |
| 54-056847 | 5/1979 | Japan . |
| 55-150396 | 11/1980 | Japan . |
| 58-128862 | 8/1983 | Japan . |
| 59-123670 | 7/1984 | Japan . |
| 59-138461 | 8/1984 | Japan . |
| 63-299971 | 12/1988 | Japan . |
| 4247942 | of 1992 | Japan . |

*Primary Examiner*—John Barlow
*Assistant Examiner*—Christina Annick
*Attorney, Agent, or Firm*—Fitzpatrick, Cella, Harper & Scinto

[57] ABSTRACT

An ink jet printing method prints an image on a printing medium by ejecting ink and printabilty improvement liquid containing a substance for improving printablity of the ink to the printing medium. At this time, ejection of the ink and ejection of the printability improvement liquid onto the printing medium are achieved such that the position where the printability improvement liquid is applied and the position where the ink is applied are different from each other, but partially overlap when the ejected printability improvement liquid comes into contact with the ejected ink on the printing medium.

56 Claims, 30 Drawing Sheets

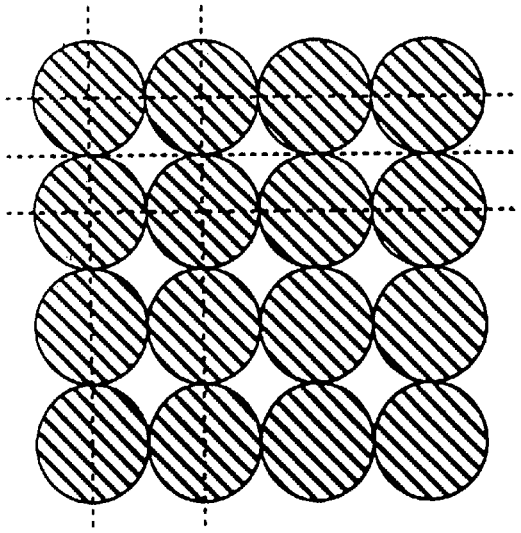
FIG.4A
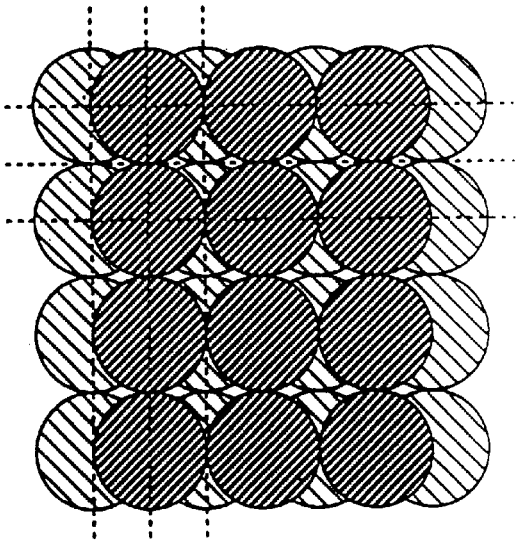
FIG.4B
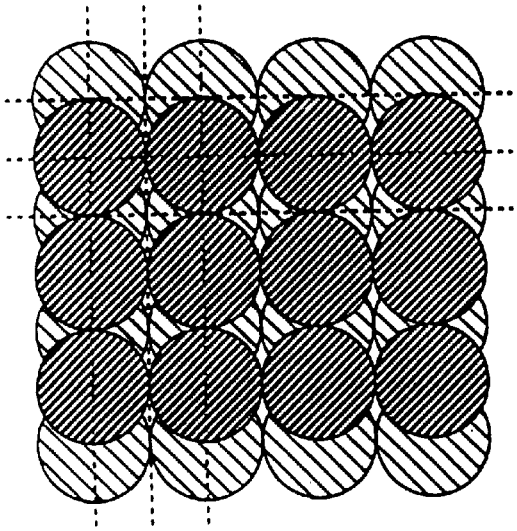
FIG.4C
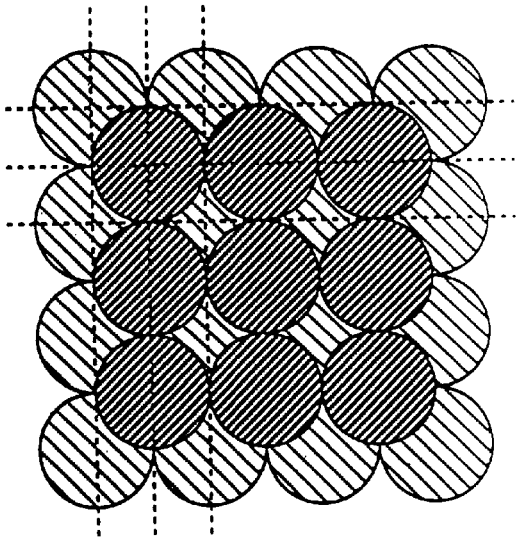
FIG.4D
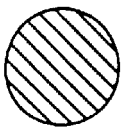
COLORED INK
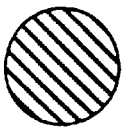
COLORED INK +PRINTABILITY IMPROVEMENT LIQUID
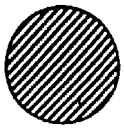
PRINTABILITY IMPROVEMENT LIQUID 1

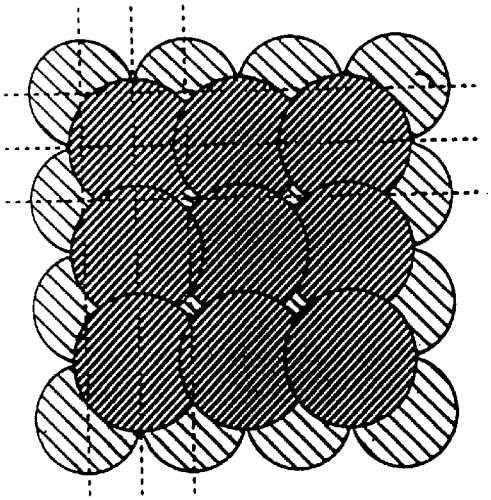
FIG. 18A
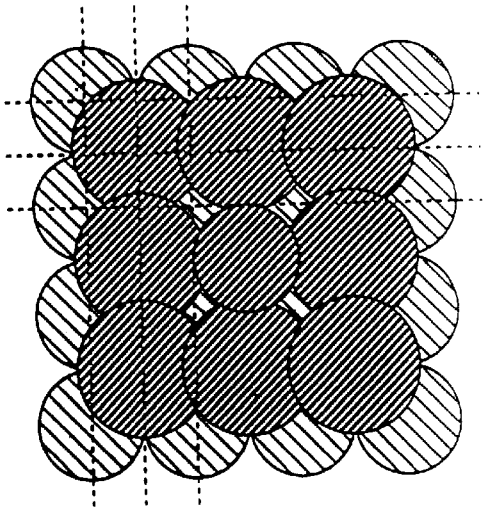
FIG. 18B
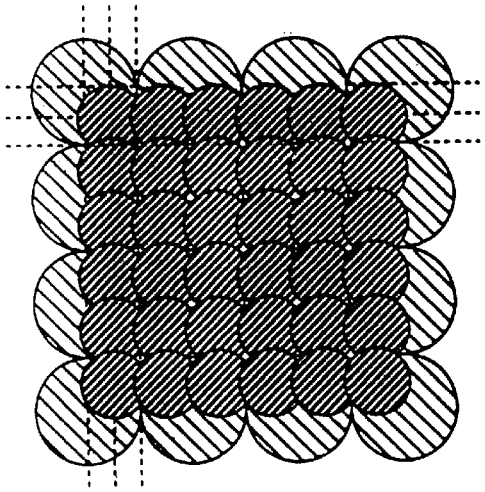
FIG. 18C
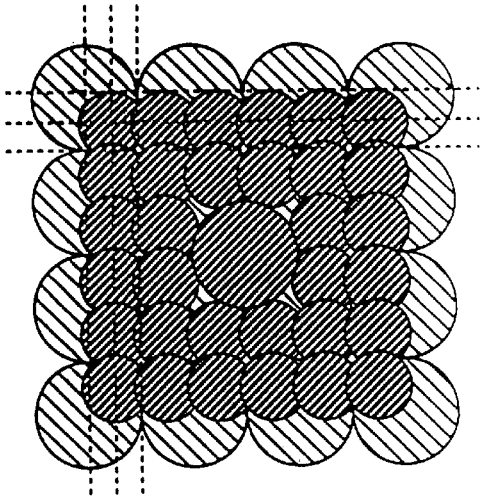
FIG. 18D
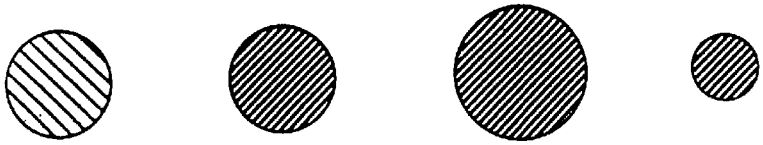
COLORED INK
PRINTABILITY IMPROVEMENT LIQUID 1
PRINTABILITY IMPROVEMENT LIQUID 2 (LARGE DOT)
PRINTABILITY IMPROVEMENT LIQUID 3 (SMALL DOT)

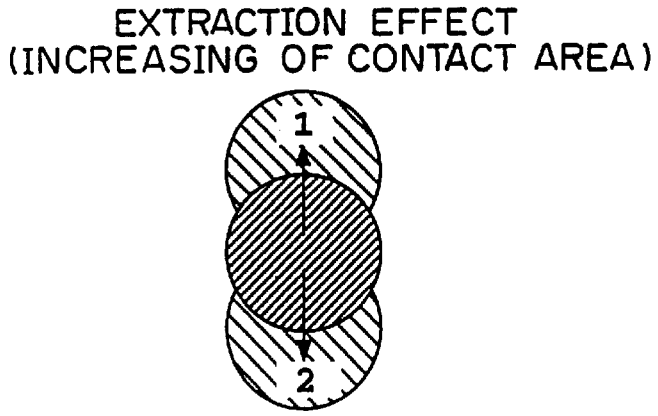
FIG. 19A
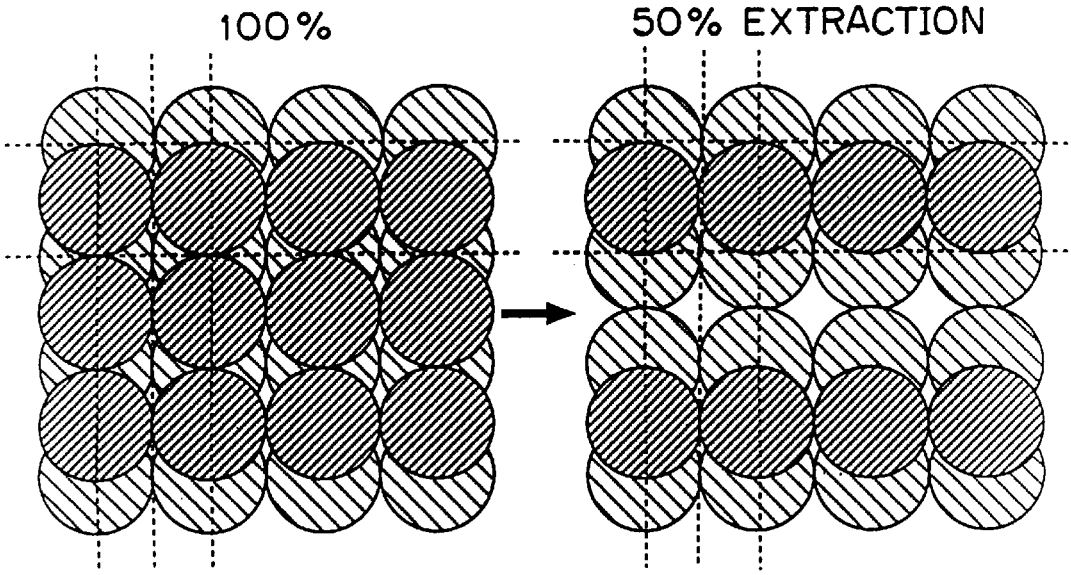
FIG. 19B
FIG. 19C
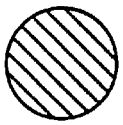
INK
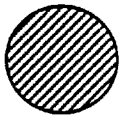
PRINTABILITY IMPROVEMENT LIQUID 1

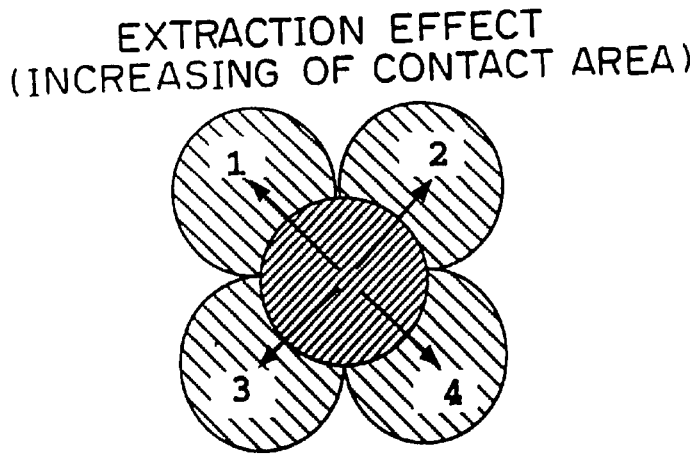
FIG .20A
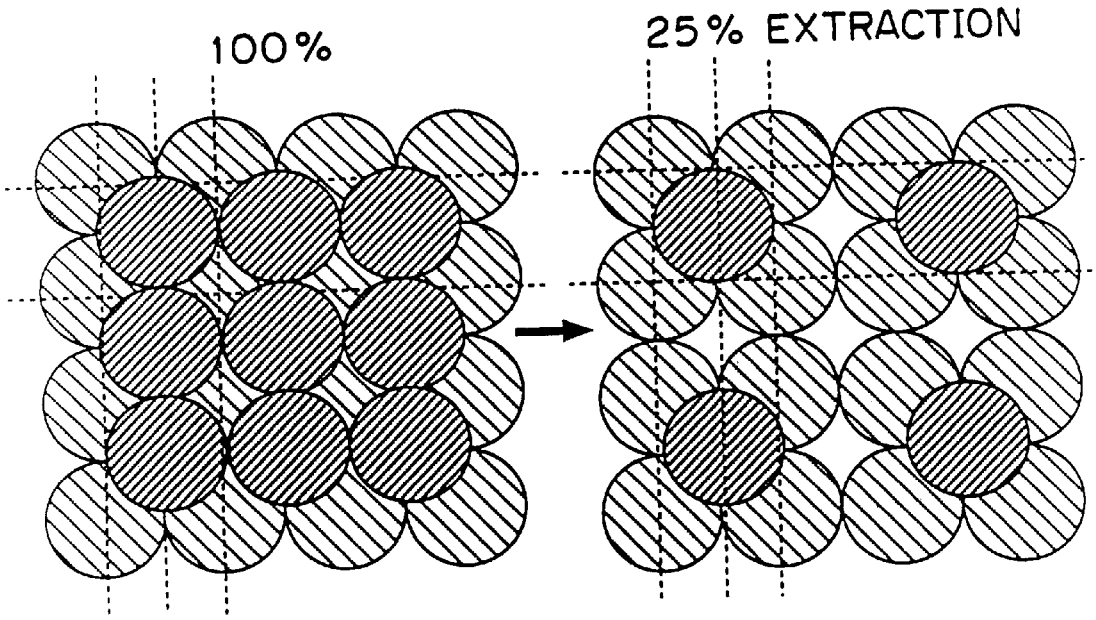
FIG .20B
FIG .20C
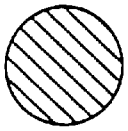
INK
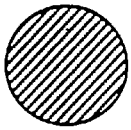
PRINTABILITY IMPROVEMENT LIQUID 1

THREE TIP INTEGRATED TYPE (FIRST EMBODIMENT)

THREE TIP INTEGRATED TYPE (OTHER EMBODIMENT)

THREE TIP INTEGRATED TYPE (OTHER EMBODIMENT)

THREE TIP INTEGRATED TYPE (SECOND EMBODIMENT)

THREE TIP INTEGRATED TYPE (OTHER EMBODIMENT)

THREE TIP INTEGRATED TYPE (OTHER EMBODIMENT)

SIX TIP INTEGRATED TYPE (THIRD EMBODIMENT)

SIX TIP INTEGRATED TYPE (OTHER EMBODIMENT)

SIX TIP INTEGRATED TYPE (OTHER EMBODIMENT)

SIX TIP INTEGRATED TYPE (OTHER EMBODIMENT)

INK JET PRINTING METHOD, INK JET HEAD USED FOR PRACTICING THE LATTER, INK JET CARTRIDGE AND INK JET PRINTING APPARATUS

BACKGROUND OF THE INVENTION

1. Field of the Invention

The present invention relates generally to an ink jet printing method, an ink jet head used for practicing the latter, an ink jet cartridge and an ink jet printing apparatus which can obtain a high quality of image on a printing medium. More particularly, the present invention is applied to ink jet printing which is effective for ejecting to the printing medium printability improvement liquid for making a coloring substance in the printing ink and the printability improvement liquid insoluble or aggregating them. Accordingly, the present invention can be applied to all apparatuses and equipment each using a printing medium such as a sheet of paper, cloth, leather, unwoven cloth, OHP paper, metallic sheet. A concrete apparatus and equipment to which the present invention can be applied is exemplified by copying machine, facsimile, printer, word processor and output terminal of computer.

Incidentally, the meaning of a term "print" includes application of ink (printing, image forming, recording and dyeing) to all ink carriers adapted to receive ink application, such as cloth, thread, paper, sheet material or the like.

2. Description of the Related Art

Conventionally, since the ink jet printing method generates low noise, it is practiced at a low running cost and it is easy to design and construct an apparatus and operate the apparatus with colors, the ink jet printing apparatus is used and commercially sold as a printer serving as an output terminal for, e.g., facsimile, electronic typewriter, word processor, work station or the like or as handy or portable printer to be equipped on personal computer, host computer, optical disc device, video apparatus or the like. In this case, the ink jet printing apparatus is constructed in correspondence to a function, a pattern of use or the like of these devices and apparatuses.

Generally, the ink jet printing apparatus includes a carriage having printing means (print head) and an ink tank carried thereon, conveying means for conveying a printing medium and controlling means for controlling them. In practical use, a printing head for ejecting ink droplets from a plurality of ejecting ports is serially scanned in the direction (main scanning direction) perpendicular to the conveying direction (auxiliary direction) of the printing medium, and during a non-printing operation, the printing medium is intermittently conveyed by a distance equal to a recording width. In addition, by using the printing head having a number of nozzles each adapted to eject ink therefrom arranged on a straight line extending in the auxiliary direction, recording is achieved with a width corresponding to the number of nozzles by allowing the printing head to once scan on the printing head. With this construction, it is possible to perform a recording operation at a higher speed.

In the case of a color ink jet printing apparatus, a colored image is formed by superimposing ink droplets ejected from plural colors of printing heads on one another. Generally, in the case that color printing is performed, three kinds of printing heads corresponding to three primary colors composed of yellow (Y), magenta (M) and cyan (C) or four kinds of printing heads corresponding to three primary colors plus black (Bk) and an ink cartridge are required. Recently, a color ink jet printing apparatus having three or four kinds of printing heads mounted thereon and having a possibility that an image is formed with full color has been put in practical use.

However, in the case that an image is formed on a printing medium that is called a plain paper, with the use of the printing apparatus to which the ink jet printing method is applied, the resultant image has insufficient water resistibility, and in the case that a color image is obtained, a color image having excellent image rigidity and acceptable image quality because requirement for an image having a high density without any occurrence of feathering and requirement for an image having no occurrence of oozing between adjacent colors can not simultaneously be met.

In recent years, as a method of improving water resistibility of an image, ink allowing a coloring material contained therein to have water resistibility has been put in practical use. However, since the foregoing ink has still insufficient water resistibility, and is ink which is hardly soluble in water in principle after the printed image is dried, it is presumed that nozzles in the printing head are readily clogged with the coloring material. To prevent this malfunction, however, the conventional type of simple printing head structure and ink jet printing apparatus structure is not sufficient, and it is presumed that apparatus structure corresponding to printability improvement liquid becomes complicated.

Many technologies for improving rigidity of a printed article have been hitherto disclosed. A technology of transforming dyestuff into lake which is fixedly secured to a dyed article by aftertreating the latter in order to improve rigidity of the dyed article in a wetted state is disclosed in Japanese Patent Application Laid-Open No. 24486/1978.

A printing method of printing by employing an ink jet printing process using two or more components of which film forming ability is increased at the room temperature or in a heated state when they come in contact with each other is disclosed in Japanese Patent Application Laid-Open No. 43733/1979. With this method, there is obtained a printed article having a film formed thereon while it is firmly secured to a printing medium by allowing the components to come in contact with each other on the printing medium.

A method of applying a water resisting agent for forming dyestuff and lake after an aqueous dyestuff ink is printed by employing an ink jet printing process is disclosed in Japanese Patent Application Laid-Open No. 150396/1980.

An ink jet printing method wherein an image position to be printed is preliminarily identified and print ink and treatment ink are printed in a superimposed state is disclosed in Japanese Patent Application Laid-Open No. 128862/1983. In this document, a method wherein an image is scribed with print ink prior to the print ink, the treatment ink is superimposed on the scribed print ink, and the print ink is superimposed on the scribed treatment ink, and moreover, the treatment ink is scribed in the superimposed state is disclosed.

As described above, on the assumption of the conventional head structure, with the method of ahead feeding wherein the head structure having only a printability improvement liquid head added thereto is combined with the conventional printing method, i.e., the printability improvement liquid is shot prior to ink and/or the method of behind feeding, i.e., the printability improvement liquid is superimposed on the ahead shot ink, it can not expected that a quantity of use of the printability improvement liquid is reduced and an effect derived from the printability improvement liquid and a printing speed are improved. Especially, the inventor has found that it is not only impossible to estimate an effect of ahead feeding and/or behind feeding treatment, e.g., permeation control, bleed reduction, reduction of fluctuation/stripe, head structure, printing method, time until the printability improvement liquid comes in contact with colored ink, permeating state of each ink on the printing medium, and state directly after ink printing and sufficiently exhibit the effect but also it is unavoidable that the printing speed is reduced (inclusive of low speed control of driving frequency, temporary stop of printing or the like) to maintain the effect to a certain extent, causing reduction of throughput of printing and increase of the running cost to arise.

SUMMARY OF THE INVENTION

The present invention has been made in consideration of the aforementioned background.

A first object of the present invention is to provide an ink jet printing method of forming an image with an image designing for utilizing ahead feeding and/or behind feeding treatment by ink jet printing in an optimum manner.

A second object of the present invention is to provide an ink jet printing method of controlling ink combination (CMY/Bk/printability improvement liquid) and ink composition for utilizing ahead feeding and/or behind feeding treatment in an optimum manner.

In addition, a third object of the present invention is to provide an ink jet printing apparatus which makes it possible to achieve ahead feeding and/or behind feeding treatment at a low cost (low running cost/low housing cost) not only at a high speed but also with a high image quality).

In the present invention, improvement of printability involves improvement of image quality such as density, chroma, degree of sharpness of an edge portion, diameter of a dot or the like, improvement of fixability of ink and improvement of weathering proofness such as water resistibility, light resistibility or the like, i.e., image reserving ability. Incidentally, it is not necessary that printability improvement liquid is ejected separately from ink without fail but it is acceptable that it is ejected in the mixed state with ink having no effect on the printability improvement liquid among plural kinds of inks.

In the present invention, an ejecting head portion (or ejecting portion) represents a row of ejecting nozzles for ink or printability improvement liquid. In addition, a head chip represents a chip which forms a group of ejecting nozzles on a single base plate associated with the ejecting head portion. A head unit is constituted by combining plural head chips with each other.

The ejecting head portion involves not only the case that it is formed in the shape of a single head chip but also the case that it is formed across different chips.

An ink jet head of the present invention represents an assembling portion of the ejecting head portion of a so-called ink jet printing apparatus, and it may be integral with the apparatus or it may be separate from the apparatus. In the case that it is separate from the apparatus, the head unit is involved in it. In this case, the number of head chips is not specifically defined.

Incidentally, as printability improvement liquid, a liquid containing a component having a function of making a coloring material in ink insoluble or aggregating it by contact with the ink is involved.

In a first aspect of the present invention, there is provided an ink jet printing method of printing an image on a printing medium by ejecting to the printing medium ink and printability improving liquid containing a substance for improving printability of the ink, characterized in that ejecting of the ink and ejecting of the printability improvement liquid are performed in such a manner that the position where the ejected printability improvement liquid is applied and the position where the ejected ink is applied are different within the range where the ejected printability improvement liquid comes in contact with at least a part of the ejected ink on the printing medium.

Printing of the image onto the printing medium may be performed along the main scanning direction (x), and the position where the ejected printability improvement liquid is applied and the position where the ejected ink is applied are different along the main scanning direction (x).

The distance between the position where the ejected printability improvement liquid is applied and the position where the ejected ink is applied and located adjacent to the position where the ejected printability improvement liquid is applied may be 1/Nx of the resolution of the image (where Nx is a positive numeral) relative to the main scanning direction (x).

The printing medium may be intermittently conveyed in the auxiliary scanning direction (y) perpendicular to the main scanning direction (x) along which printing of the image is performed, and the position where the ejected printability improvement liquid is applied and the position where the ejected ink is applied are different along the main scanning direction (x).

The distance between the position where the ejected printability improvement liquid is applied and the position where the ejected ink is applied and located adjacent to the position where the ejected printability improvement liquid is applied may be 1/Ny of the resolution of the image (where Ny is a positive numeral) relative to the auxiliary scanning direction.

Printing of the image onto the printing medium may be performed in the main scanning direction, and the printing medium is intermittently conveyed in the auxiliary scanning direction (y) perpendicular to the main scanning direction (x) along which the image is printed, and the position where the ejected printability improvement liquid is applied and the position where the ejected ink is applied are different in the main scanning direction (x) as well as in the auxiliary scanning direction (y).

The distance between the position where the ejected printability improvement liquid is applied and the position where the ejected ink is applied and located adjacent to the position where the ejected printability improvement liquid is applied may be 1/Nx and 1/Ny of the resolution of the image (where Nx and Ny are positive numerals) relative to the main scanning direction (x) and the auxiliary scanning direction (y).

The ejecting timing of the printability improvement liquid may be different from the ejecting timing of the ink.

A quantity of ejection of the printability improvement liquid per unit area of the printing medium may be a quantity of ejection of the ink per unit area of the printing medium or less.

The printability improvement liquid may contain a cation based substance composed of a low molecular component and a high molecular component, and the ink contains an anion based dyestuff.

The printability improvement liquid may contain a cation based substance composed of a low molecular component and a high molecular component, and the ink contains an anion based dyestuff or contains at least an anion based compound and a dyestuff.

Thermal energy may be used as energy of ejecting the ink and the printability improvement liquid.

In a second aspect of the present invention, there is provided an ink jet head including an ink ejecting portion for ejecting ink and a liquid ejecting portion for ejecting printability improvement liquid containing a substance for improving printability of the ink, the ink jet head printing an image onto a printing medium along the main scanning direction while it being mounted on an ink jet printing apparatus, characterized in that the ink ejecting portion and the liquid ejecting portion are arranged such that the ejected ink dot and the ejected printability liquid dot can be mixed together on the printing medium and the ink and the printability improvement liquid are ejected to the positions where centers of both dots do not coincide with each other.

An energy generating section for generating thermal energy for ejecting the ink and the printability improvement liquid may be disposed in the ink jet head respectively.

In a third aspect of the present invention, there is provided an ink jet head including a plurality of ink ejecting portions each for ejecting ink therefrom and a liquid ejecting portion for ejecting printability improvement liquid containing a substance for improving printability of the ink, the ink jet head printing an image onto a printing medium along the main scanning direction while it being mounted on an ink jet printing apparatus, characterized in that the distance between the ink ejecting portions located adjacent to each other in the main scanning direction is different from the distance between the ink ejecting portion and the liquid ejecting portion located adjacent to each other in the main scanning direction.

An energy generating section for generating thermal energy for ejecting the ink and the printability improvement liquid may be disposed in the ink jet head respectively.

The plurality of ink ejecting portions may be ink ejecting portions each corresponding to color printing.

In a fourth aspect of the present invention, there is provided an ink jet head including an ink ejecting portion for ejecting ink therefrom and a liquid ejecting portion for ejecting printability improvement liquid containing a substance for improving printability of the ink, the ink jet head printing an image onto a printing medium along the main scanning direction while it being mounted on an ink jet printing apparatus, characterized in that the ink ejecting portion and the liquid ejecting portion are not placed on a same straight line extending along the main scanning direction.

An energy generating section for generating thermal energy for ejecting the ink and the printability improving liquid may be disposed in the ink jet head respectively.

In a fifth aspect of the present invention, there is provided an ink jet printing apparatus for printing an image onto a printing medium using an ink jet head, characterized in that the ink jet head includes an ink ejecting portion for ejecting ink therefrom and a liquid ejecting portion for ejecting a printability improvement liquid containing a substance for improving printability of the ink, and prints an image onto the printing medium in the main scanning direction, and the ink ejecting portion and the liquid ejecting portion are arranged such that the ejected ink dot and the ejected printability improvement liquid dot can be mixed together on the printing medium and the ink and the printability improvement liquid are ejected at the positions where centers of both the dots are not coincide with each other.

An energy generating section for generating thermal energy for ejecting the ink and the printability improvement liquid may be disposed in the ink jet head respectively.

An ink jet printing apparatus may further comprise controlling means for ejecting the printability improvement liquid under a condition that a quantity of ejection of the printability improving liquid per unit area of the printing medium is a quantity of ejection of the ink per unit area of the printing medium or less.

The printability improvement liquid may contain a cation based substance composed of a low molecular component and a high molecular component, and the ink contains an anion based dyestuff.

The printability improvement liquid may contain a cation based substance composed of a low molecular component and a high molecular components, and the ink contains an anion based dyestuff or contains an anion based dyestuff and pigment.

In a sixth aspect of the present invention, there is provided an ink jet printing apparatus for printing an image onto a printing medium using an ink jet head, characterized in that the ink jet head includes a plurality of ink ejecting portions each for ejecting ink therefrom and a liquid ejecting portion for ejecting printability improvement liquid containing a substance for improving printability of the ink, and prints an image onto the printing medium in the main scanning direction, the distance between the ink ejecting portions located adjacent to each other along the main scanning direction is different from the distance between the ink ejecting portions and the liquid ejecting portion located adjacent to each other along the main scanning portion.

An energy generating section for generating thermal energy for ejecting the ink and the printability improvement liquid may be disposed in the ink jet head respectively.

The plurality of ink ejecting portions may be ink ejecting portions each corresponding to color printing.

An ink jet printing apparatus may further comprise controlling means for ejecting the printability improvement liquid under a condition that a quantity of ejection of the printability per unit area of the printing medium is a quantity of ejection of the ink per unit area of the printing medium or less.

The printability improvement liquid may contain a cation based substance composed of a low molecular component and a high molecular component, and the ink contains anion based dyestuff.

The printability improvement liquid may contain a cation based substance composed of a low molecular component and a high molecular component, and the ink contains an anion based dyestuff or contains an anion based compound and pigment.

In a seventh aspect of the present invention, there is provided an ink jet printing apparatus for printing an image onto a printing medium using an ink jet head, characterized in that the ink jet head includes an ink ejecting portion for ejecting ink therefrom and a liquid ejecting portion for ejecting printability improvement liquid containing a substance for improving printability of the ink, the ink jet head printing an image on the printing medium along the main scanning direction while it being mounted on the ink jet printing apparatus, and the ink ejecting portion and the liquid ejecting portion are not placed on a same straight line extending along the main scanning direction.

An energy generating section for generating thermal energy for ejecting the ink and the printability improvement liquid may be disposed in the ink jet head respectively.

An ink jet printing apparatus may further comprise controlling means for ejecting printability improvement liquid under a condition that a quantity of ejection of the printability improvement liquid per unit area of the printing medium is a quantity of ejection of the ink per unit area of the printing medium or less.

The printability improvement liquid may contain a cation based substance composed of a low molecular component and high molecular component, and the anion contains an anion based dyestuff.

The printability improvement liquid may contain a cation based substance composed of a low molecular component and a high molecular component, and the ink contained anion based dyestuff or contains an anion based compound and pigment.

In an eighth aspect of the present invention, there is provided a printed article having an image formed by colorant of ink applied to a printing medium and a substance for improving printability of the ink, characterized in that the image is formed such that a center of a dot of a substance for improving the printability is different from a center of a dot of the colorant of the ink.

In a ninth aspect of the present invention, there is provided an ink cartridge including an ink jet head and an ink tank adapted to be detachably connected to the ink jet head, characterized in that the ink jet head includes an ink ejecting portion for ejecting ink and a liquid ejecting portion for ejecting printability liquid containing a substance for improving printability of the ink, the ink jet head printing an image onto a printing medium along the main scanning direction while it being mounted on an ink jet printing apparatus, and the ink ejecting portion and the liquid ejecting portion are arranged such that the ejected ink dot and the ejected printability improvement liquid can be mixed together on the printing medium and the ink and the printability improvement liquid are ejected at the positions where centers of both the dots do not coincide with each other.

In a tenth aspect of the present invention, there is provided an ink jet printing method of performing printing using colored ink applied from an ejecting portion of an ink jet head onto a printing medium and a liquid containing at least printability improvement substance applied to the printing medium for improving printability in ink jet printing, characterized in that a liquid droplet of the printability improvement liquid and a liquid droplet of at least one colored ink are arranged such that their shot lattice points are different from each other within the range where they come in contact with each other.

Printing of the image onto the printing medium may be performed along the main scanning direction, and the shot lattice point of the ejected printability improvement liquid and the shot lattice point of at least one colored ink are different from each other along the main scanning direction (x).

Positional deviation between the shot lettice points in the main scanning direction may be achieved by changing an ejecting timing of the ejecting head.

The distance between the shot lattice point of the ejected printability liquid and the lattice point of at least one ejected colored ink located adjacent to the shot lattice point of the ejected printability improvement liquid may be 1/Nx (where Nx is a positive numeral) of the resolution of the image in the main scanning direction (x).

The printing medium may be intermittently conveyed in the auxiliary scanning direction (y) perpendicular to the main scanning direction (x) along which printing of the image is performed, and the shot lattice point of the ejected printability improvement liquid and the shot lattice point of at least one ejected colored ink are different from each other in the main scanning direction (x).

Positional deviation between the lettice points in the auxiliary scanning direction may be achieved by performing scannings several times while a quantity of feeding of the printing medium is changed.

The distance between the shot lattice point of the ejected printability improvement liquid and the shot lattice point of at least one ejected colored ink may be 1/Ny (where Ny is a positive numeral) in the auxiliary scanning direction.

Printing of the image onto the printing medium may be achieved along the main scanning direction (x), and the printing medium is intermittently conveyed in the auxiliary scanning direction (y) perpendicular to the main scanning direction (x) along which printing of the image is performed, and the shot lattice point of the ejected printability improvement liquid and the shot lattice point of at least one ejected colored ink are different from each other in the main scanning direction (x) as well as in the auxiliary scanning direction (y).

Positional deviation of the lettice points in the main scanning direction (x) may be achieved by changing an ejecting timing of the ejecting head portion, and positional deviation of the lettice points in the auxiliary scanning direction is achieved by performing scannings several times while a quantity of feeding of the printing medium is changed.

The distance between the shot lattice point of the ejected printability improvement liquid and the shot lattice point of at least one ejected colored ink located adjacent to the position where the ejected printability improvement liquid is applied may be 1/Nx and 1/Ny (where Nx and Ny are positive numerals) relative to the main scanning direction (x) and the auxiliary scanning direction.

An ejecting timing of the printability improvement liquid and an ejecting timing of the ejecting head portion may be different from each other.

A quantity of ejection of the printability improvement liquid per unit area of the printing medium may be a quantity of ejection of the colored ink per unit area of the printing medium or less.

The printability improvement liquid may contain a cation based substance composed of a low molecular component and a high molecular component, and the ink contains an anion based dyestuff.

The printability improvement liquid may contain a cation based substance composed of a low molecular component and a high molecular component, and the ink contains an anion based dyestuff or contains at least an anion based compound and pigment.

Thermal energy may be used as energy for ejecting the ink and the printability improvement liquid.

In an eleventh aspect of the present invention, there is provided an ink jet head including an ink ejecting head portion for ejecting ink therefrom and a liquid ejecting head portion for ejecting a liquid containing at least printability improvement substance to be applied to a printing medium for improving printability in ink jet printing, characterized in that at least one of liquid ejecting heads has a head structure that it is arranged while it is deviated relatively to a colored ejecting head adapted to eject at least one colored ink.

The relative deviation may orient in the main scanning direction (x) of a printed image.

The relative deviation may orient in the auxiliary scanning direction (y) of a printed image.

The relative deviation may orient in the main scanning direction (x) as well as in the auxiliary scanning direction (y) of a printed image.

The relative deviation may be Mx+1/Nx and My+1/Ny (where Nx and Ny are positive numerals and Mx and My are integrals) in the main scanning direction (x) as well as in the auxiliary scanning direction (y).

The ink jet head may include an electrothermal transducer as an energy generating element for generating thermal energy for causing a phenomenon of film boiling to appear in the ink or in the printability improvement liquid.

In a twelfth aspect of the present invention, there is provided an ink jet printing apparatus for printing an image on a printing medium using an ink jet head, characterized in that the ink jet head includes an ink ejecting portion for ejecting ink and a liquid ejecting portion for ejecting liquid including at least printability improvement substance to be applied to a printing medium for improving printability in ink jet printing, and at least one of the liquid ejecting portion is arranged while it is deviated relatively to at least one of the ink ejecting portion.

The ink jet head may be detachably disposed to a body of the ink jet printing apparatus.

In a thirteenth aspect of the present invention, there is provided an printed article having an image formed by ink applied to a printing medium from an ink jet head and printability improvement liquid applied to the printing medium for improving printability in ink jet printing, characterized in that the image is formed while the shot lattice point of the printability improvement liquid and the shot lattice point of at least one colored ink are arranged on the printing medium such that they are not coincide with each other.

In a fourteenth aspect of the present invention, there is provided an ink jet cartridge including an ink jet head and an ink tank adapted to be detachably connected to the ink jet head, characterized in that the ink jet head includes an ink ejecting portion for ejecting ink and a liquid ejecting portion for ejecting liquid including at least printability improvement substance to be applied to a printing medium for improving printability in ink jet printing, and at least one of the liquid ejecting portion is arranged while it is deviated relatively to at least one of the ink ejecting portion.

In a fifteenth aspect of the present invention, there is provided an ink jet printing method of printing an image on a printing medium by applying ink and printability improvement liquid containing a substance for improving printability of the ink to the printing medium, comprising the steps of:

applying dot of the printability improvement liquid to the printing medium; and applying dot of the ink to the printing medium, wherein dot of the printability improvement liquid and dot of the ink can be combined together on the printing medium and both dots are applied to the positions where their centers do not coincide with each other.

In a sixteenth aspect of the present invention, there is provided an ink jet printing method of printing an image on a printing medium by applying ink and liquid containing a component having a function of making a coloring material in ink insoluble or aggregating the coloring material by bringing the liquid in contact with the ink, comprising the steps of:

applying dot of the liquid to the printing medium; and applying dot of the ink to the printing medium, wherein dot of the liquid and dot of the ink can be combined together on the printing medium and both dots are applied to the positions where their centers do not coincide with each other.

In a seventeenth aspect of the present invention, there is provided an ink jet printing apparatus for printing an image on a printing medium using an ink jet head, characterized in that the ink jet head includes an ink ejecting portion for ejecting ink therefrom and a liquid ejecting portion for ejecting liquid containing a substance having a function of making a coloring material in ink insoluble or aggregating the coloring material by bringing the liquid in contact with the ink, and forms the image on the printing medium along the main scanning direction, and dot of the ink ejected from the ink ejecting portion and dot of the liquid ejected from the liquid ejecting portion can be combined together on the printing medium, and the ink and the liquid are ejected to the positions where centers of both dots do not coincide with each other.

The above and other objects, effects, features and other advantages of the present invention will become apparent from the following description of embodiments thereof taken in conjunction with the accompanying drawings.

BRIEF DESCRIPTION OF THE DRAWINGS

FIGS. 4A to 4D are views which show examples of superimposing of printability improvement liquid and ink in comparison with a conventional method;

FIG. 18A to FIG. 18D are views which explain a printing method according to other embodiment;

FIGS. 19A to 19C are schematic views which show the positions where ink and printability improvement liquid are ejected according to an eighth embodiment of the present invention;

FIGS. 20A to 20C are schematic views which show the positions where ink and printability improvement liquid are ejected according to a ninth embodiment of the present invention;

DESCRIPTION OF THE PREFERRED EMBODIMENTS

The present invention will now be described below with reference to the accompanying drawings.

Embodiment 1

This embodiment is concerned with a monochromatic head unit (Bk1+S+Bk2) including a first black ink chip having a plurality of ejecting ports formed thereon for ejecting black ink (hereinafter referred to as Bk1 chip), a second black ink chip having a plurality of ejecting ports formed thereon for ejecting black ink (hereinafter referred to as Bk2 chip) and a printability improvement liquid chip having a plurality of ejecting ports formed thereon for ejecting printability improvement liquid (hereinafter referred to as S chip). A plurality of ejecting ports located on the S chip form a row in parallel with the center line extending in the longitudinal direction, and this row is located at the position deviated from the center line by a distance of half pixel.

<Structure of an ink jet head>

First, description will be made below with respect to the structure of an ink jet head constructed in accordance with the first embodiment of the present invention.

A monochromatic head unit 2000 constructed in accordance with the first embodiment of the present invention will generally be described with reference to FIG. 1 to FIG. 3.

Figure 1:
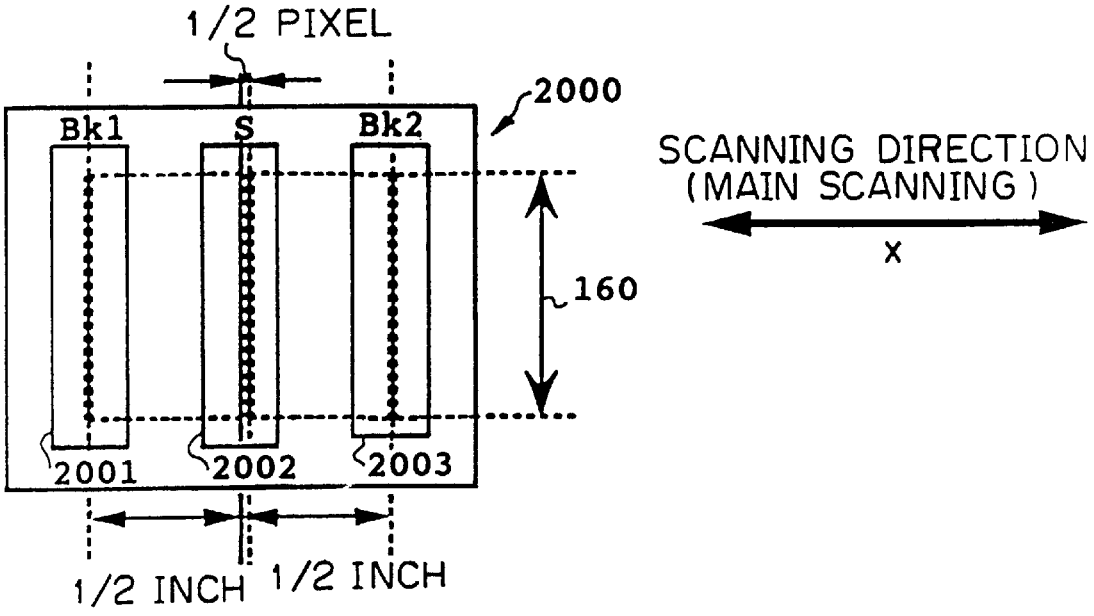
FIG. 1 is a plan view which shows the structure of a printing head unit according to a first embodiment of the present invention.
Figure 2:
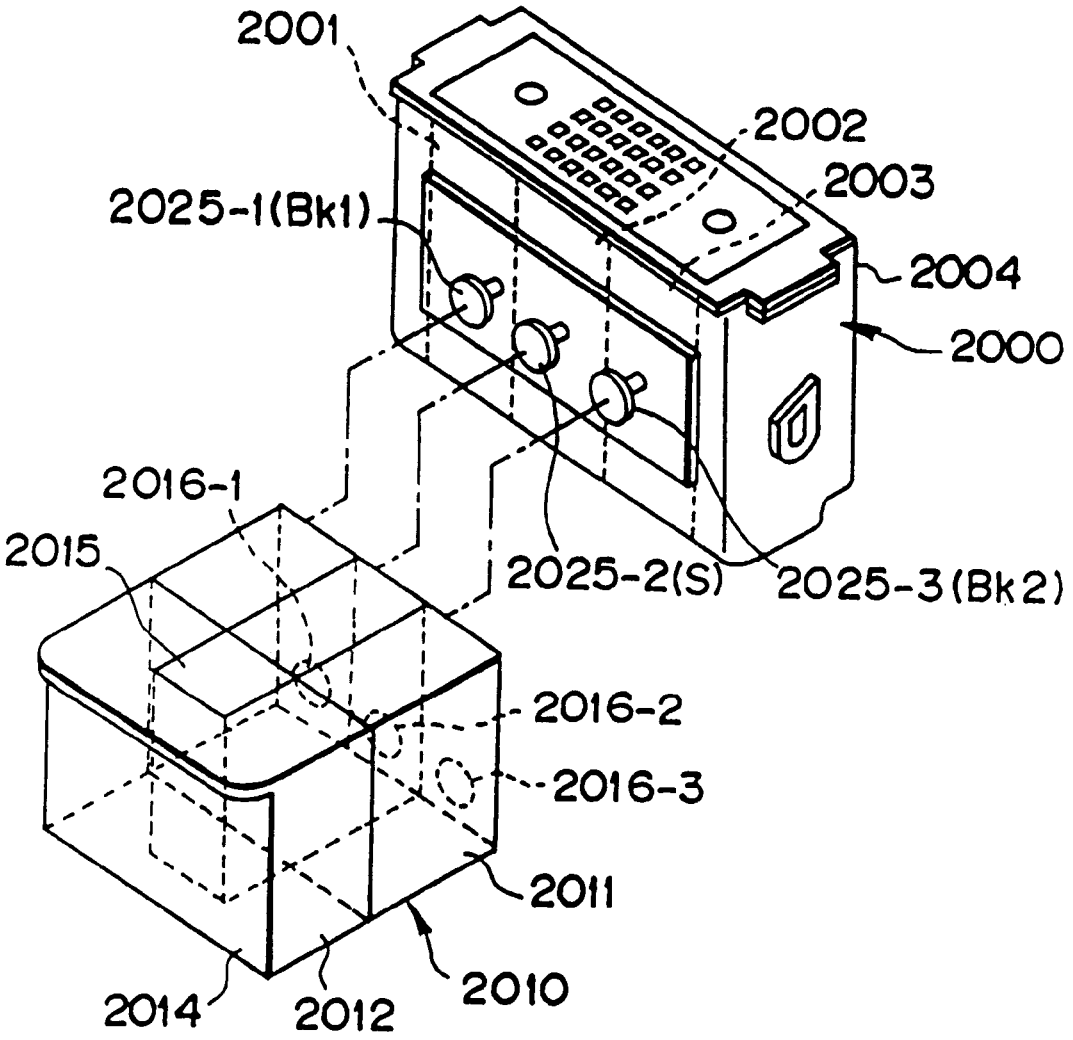
FIG. 2 is a perspective view of a monochromatic printing head unit employed according to the first embodiment.
Figure 3:
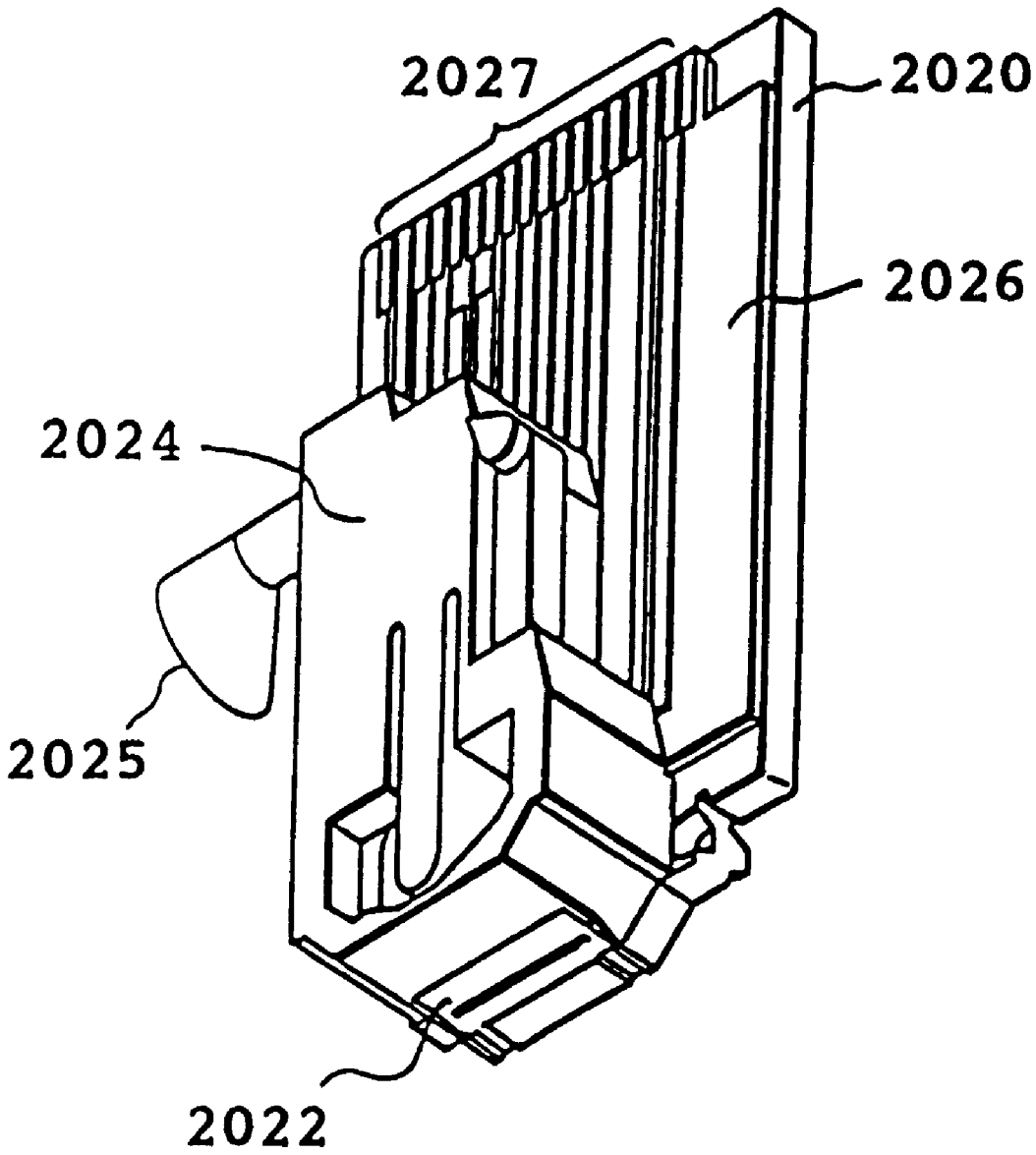
FIG. 3 is a perspective view which shows by way of example a printing head chip.

FIG. 1 is a schematic plan view which schematically explains the structure of an ejecting plane of the head unit, FIG. 2 is a perspective view of an ink jet cartridge (head unit and ink tank), and FIG. 3 is a perspective view which shows by way of example a print head chip.

As shown in the figure, a main scanning direction (x) is defined as the direction along which the monochromatic head unit on the carriage is traveled.

The head unit is composed of a Bk1 chip 2001, a S chip 2002 and a Bk2 chip 2003, and it is arranged in the tilted state with an angle of inclination defined as $\tan\theta = 1/160$ relative to a sub-scanning direction perpendicular to the main-scanning direction (x) of the head unit 2000 so as to make correction corresponding to the driving timing with a pitch of ½ inch.

The Bk1 chip and the Bk2 chip are arranged with deviation of ½ pixel (about 35 $\mu$m) at 360 dpi in the direction of a main scanning direction (x) on the head unit. In other words, the distance between the ejecting ports of the Bk1 chip and ejecting ports of the S1 chip 2002 is represented by (½ inch+½ pixel), while the distance between the ejecting ports of the Bk2 chip 2003 and the ejecting ports of the S1 chip 2002 is represented by (½ inch−½ pixel). Although effects derived from the foregoing positional deviation will be described in detail later, they are intended to increase a contact surface with the Bk ink so as to allow the printability improvement liquid to react the Bk ink at a high speed by increasing contact probability of fore and rear image dots while the shot position (i.e., shot point of lattice or dot-applied position) of the printability improvement liquid is deviated in the direction of (x, 0) by a quantity of half pixel of 360 dpi from the viewpoint of image designing, and moreover, to reduce a total quantity of consumption of the printability improvement liquid.

<Ejection properties> number of nozzles: 160 nozzles (number of divided blocks; 16 blocks are successively driven)

resolution: 8.0 (kHz)

ejection quantity: Vd=80±4 (pl/dot)

ejection speed: 15±0.5 (m/s)

<Driving condition> driving voltage: Vop=24.0 (V)

driving pulse width: Pw=5.5 ($\mu$s)

open time per one block: Tb=7.6 ($\mu$s)

As shown in FIG. 2, the head unit 2000 and a tank 2010 are detachably arranged, and when ink becomes empty in the tank, an ink remaining quantity detecting mechanism (not shown) urges a user to exchange the ink tank with a new one.

The head unit 2000 is constructed such that a Bk1 chip 2001, a S chip 2002 and a Bk2 chip 2003 are received in a frame 2004. As shown in FIG. 3, each of the head chips 2001, 2002 and 2003 is constructed such that a grooved ceiling plate 2022 molded of polysulfone resin with a heater board (not shown) attached thereto is mounted on a base plate 2020 of aluminum, it is sealed with a sealing agent, and it is fixedly secured to a base plate 2020 by a retaining spring 2023. Each chip includes a chip tank 2024 having a mesh filter attached thereto, and moreover, it includes a printed circuit board 2026 for allowing signal lines to be connected to a flexible cable, and a plurality of signal line terminals 2027 are formed on the printed circuit board 2026. As shown in FIG. 2, the mesh filter 2025 for each chip tank 2024 is projected from the frame, and the respective mesh filters are represented by 2025-1, 2025-2 and 2025-3.

As shown in FIG. 2, the tank connected to the head unit 2000 is divided into a plurality of chambers, one of them being a chamber 2022 having spongy received therein (including a buffer chamber having no sponge received therein but filled with air while making communication with atmosphere), other one being a chamber 2012 having liquid ink received therein as it is (hereinafter referred to as raw ink), and another one being a tank 2010 having two kinds of inks (black ink 2014 and printability improvement liquid 2015) received therein. The black ink 2014 is symmetrically received with the center of the tank as a center axis, and the printability improvement liquid 2015 is received at the central part of the ink tank 2015. The tank 2010 includes ink feeding ports 2016-1, 2016-2 and 2016-3 each communicating with the chamber 2011, and mesh filters 2025-1, 2025-2 and 2025-5 are inserted into the ink feeding ports 2016-1, 2016-2 and 2016-3. Thus, ink feeding can be achieved by successive or total suction recovering with the aid of main body recovering means (not shown) by inserting the filter 2025-1, 2025-2 and 2025-3 of the head 2000 from the feeding ports 2016-1, 2016-2 and 2015-3 and allowing the fore end part of the filters to come in close contact with the spongy portion of the tank 2010.

<Printing Mode>

A printing mode for controlling the driving of the monochromatic head unit in the case that the monochromatic head units (Bk1+S+Bk2) are mounted on an ink jet printing apparatus will be described below.

Basically, the print mode includes three kinds of printing modes each of which can be selected by a user depending on his own necessary image quality and a printing speed.

1. Fast Mode: one pass bidirectional 360×360 dpi (printability improvement liquid present/absent)
2. Normal Mode: two pass bidirectional 360 dpi×360 dpi (printability improvement liquid present/absent)
3. High quality Mode (four pass uni-directional 720×360 dpi (printability improvement liquid present/absent)

The printing mode can be selected by actuating a printer driver incorporated in a host computer (not shown) but it can be changed by actuating a selection switch of a printer (not shown). Each of the printing modes will be described below.

<Fast Mode: printability improvement liquid absent>

In the case that no printability improvement liquid is used, two Bk chips 2001 and 2003 for ejecting black (Bk) ink are used to perform a printing operation with one pass bidirection. The printing method is such that a carriage is driven at a high speed of 360 dpi/about 1128 mm/sec using all of 160 nozzles of the Bk1 and the Bk2 with driving frequency of 16 (kHz), i.e., double of head driving frequency 8 (kHz) so that an image of 360 dpi can be printed at a very high speed by ejecting ink with one dot timing delayed in such a manner that an image is interpolated on a printing medium with each head. In this embodiment, very high speed printing is performed using two heads but a mode may be provided which performs a printing operation using an ordinary one head corresponding to a power source on the main body, a motor load or the like.

<Fast Mode: printability improvement liquid present>

One example of the printing method in the case that printability improvement liquid is used will be described below.

In the case that one pass bidirectional printing is performed with the head constructed according to this embodiment, the printability improvement liquid is printed ahead or behind without fail by selectively using one of two Bk chips 2001 and 2003 depending on the scanning direction of the print head unit. The printing method is such that both of the Bk1 and the Bk2 are driven using all of 160 nozzles with a carriage driving frequency of 8 (kHz)/360 dpi/about 564 mm/sec, i.e., a same driving frequency of the head driving frequency of 8 (kHz) so that images of the printability improvement liquid and Bk ink are formed on the printing medium. At this time, according to the embodiment, the Bk heads are used with them exchanged with each other during forward and rearward at the time of one pass bidirectional printing so that Bk ink is printed on the printing medium after the printability improvement liquid is always printed ahead. At this time, an image of 360 dpi can be printed at a high speed with the printability improvement liquid used by ejecting and shooting the printability improvement liquid dots and Bk ink dots with a positional deviation of half pixel in the main scanning direction.

With two head structure composed of one conventional Bk head and one printability improvement liquid head, an effect of the printability improvement liquid can be maximized while preventing occurrence of density fluctuation (band fluctuation) attributable to density difference induced by the difference of shooting of the printability improvement liquid and the ink arisen (S→Bk/Bk→S) during one pass bidirectional printing.

<Normal Mode: printability improvement liquid absent>

In the case that the printability improvement liquid is not used, printing is performed using both of the Bk chips 2001 and 2003 with two pass bidirectional fine (master pattern is zigzag/inverted zigzag). The printing method is such that at the time of first forward scanning, the carriage is driven using all of 160 nozzles of the Bk1 and the Bk2 with a driving frequency of 16 (kHz)/360 dpi/about 1129 mm/sec, i.e., a double of a head driving frequency 8 (kHz) at a high speed while a head is masked with zigzag pattern/inverted zigzag pattern in such a manner that an image is interpolated on the printing medium.

This makes it possible to perform high speed two dot fine printing for an image of 360 dpi when the printability improvement liquid is absent. In this embodiment, high speed fine printing is performed with two heads but a fine mode may be provided using ordinary one head corresponding to a power source on the main body, motor load or the like. Also in this embodiment, one dot zigzag/inverted zigzag pattern is used for a master pattern during the fine printing but an optimum conventional method can be used for a printing medium, an image quality and ink such as plural dots, modified pattern having longitudinal and transverse lengths changed.

<Normal Mode: printability improvement liquid present>

An example of a printing method in the case that a printability improvement liquid is used according to the embodiment will be described below.

In the case that two pass bidirectional printing is performed with head structure of this embodiment, the printability improvement liquid can be printed ahead or behind without fail by selectively using only one of two Bk chips 2001 and 2003. The printing method is such that at the time of forward printing during a first pass, the carriage is driven using 80 nozzles of 160 nozzles located at the lower half with a driving frequency 8 (kHz)/360 dpi/about 564 mm/sec, i.e, same head driving frequency 8 (kHz) so as to allow images of the printability improvement liquid and the Bk ink to be formed on a printing medium. At the time of rearward printing during second pass, after the printing medium is fed by a quantity of 80 nozzles, the carriage is driven using all of 160 nozzles with a driving frequency of 8 (kHz)/about 564 mm/sec, i.e., same driving frequency of the head driving frequency 8 (kHz) so that images of the printability improvement liquid and the Bk ink are formed on the printing medium. After three pass, paper feeding is effected by a quantity of 80 nozzles to perform printing in the same manner as mentioned above. At this time, according to this embodiment, since the printability improvement liquid is always printed ahead on the printing medium, the Bk heads are used while they are exchanged with each other during forward and rearward at the time of two pass bidirectional printing so as to allow the Bk ink to be printed. At this time, an image of 360 dpi can be printed at a high speed by ejecting and shooting printability improvement liquid dots and Bk dots in such a manner that they overlap each other with a positional deviation of half pixel in the main scanning direction.

Thus, with two head structure composed of one conventional Bk head and one printability improvement liquid head, an occurrence of density fluctuation (band fluctuation) attributable to the difference of order of shooting of the printability improvement liquid and the ink (S→Bk/Bk→S) caused during two pass bidirectional fine printing. In this embodiment, one dot zigzag/inverted zigzag pattern are used for a master pattern at the time of fine printing but an optimum conventional method can be used for a printing medium, an image quality and ink such as plural dots, modified pattern having longitudinal and transverse length changed with each other.

<High Quality Mode: printability improvement liquid absent>

In the case that no printability improvement liquid is used, printing is performed using two Bk chips with four pass uni-direction. The printing method is such that at one pass, the carriage is driven at a driving frequency of 16 (kHz)/720 dpi/about 564 mm/sec, i.e., a double of head driving frequency using 80 nozzles at the lower half of 160 nozzles of the Bk1 and Bk2 and, at the time of four pass printing, an image of 720 dpi can be printed at a high speed while developing an image into printing data in a data developing section (not shown) in such a manner that the image is interpolated on the printing medium. At the time of printing at a second pass, after the printing medium is fed by a quantity of 80 nozzles, printing is performed using all of 160 nozzles of the Bk1 and the Bk2 while likewise interpolating the image. After a third pass and subsequent one, printing is performed by effecting paper feeding by a quantity of 80 nozzles. At this time, to determine a quantity of ejection corresponding to the image of 720 dpi, a driving pulse width of each of the Bk1 and Bk2 is narrowed and a quantity of ejection is reduced from 80 pl to 40 pl. At the time of back scanning, the carriage is returnably driven at a driving frequency 16 (kHz)/360 dpi/about 1128 mm/sec at a very high speed, and during this returnable driving, paper feeding by a quantity of 40 nozzles is completed. In this embodiment, printing is performed at a high speed using two heads but a mode of printing using ordinary one head may be provided corresponding to a power source on a housing, motor load or the like.

<High Quality Mode: printability improvement liquid present>

One example of a printing method in the case that the printability improvement liquid is used according to this embodiment will be described below. In the case that four pass bidirectional printing is performed with the head structure according to this embodiment, the printability improvement liquid can be printed ahead or behind without fail by selectively using one of two Bk chips depending on the direction of scanning of the printing head unit. The printing method is such that at the time of forward printing during a first path, the carriage is driven at a driving frequency 8 (kHz)/720 dpi/about 282 mm/sec, i.e., same driving frequency of head driving frequency 8 (kHz) using 40 nozzles of lower ¼ of 160 nozzles of the Bk1 and Bk2 so that images of the printability improvement liquid and Bk ink (Bk2) are formed on the printing medium. At the time of rearward printing during a second pass, after the printing medium is fed by a quantity corresponding to 40 nozzles, the carriage is driven at the driving frequency of 8(kHz)/about 282 mm/sec, i.e., same driving frequency 8 (kHz) of the head so that images of the printability improvement liquid and the Bk ink (Bk1) are formed on the printing medium. After a third pass and subsequent one, printing is performed by likewise feeding paper by a quantity corresponding to 40 nozzles. At this time, according to this embodiment, since the printability improving liquid is always printed ahead on the printing medium, the Bk heads are used at the time of two pass bidirectional printing while they are changed with each other during forward and rearward so that the Bk ink is printed on the printing medium. At this time, an image of 720 dpi can be printed at a high speed by ejecting and shooting while printability improvement liquid dots and Bk ink dots overlap each other with a positional offset of half pixel (720 dpi) in the main scanning direction.

This two head structure composed of one conventional Bk head and one printability improvement liquid head can prevent an occurrence of density fluctuation (band fluctuation) attributable to the temperature difference caused by the difference of order of shooting of the printability improvement liquid and the ink (S→Bk/Bk→S) arisen during four pass bidirectional fine printing. In this embodiment, one dot zigzag/inverted zigzag pattern is used for a master pattern at the time of fine printing but an optimum conventional method can be used depending on the printing medium, image quality and ink such as plural dots, modified pattern having longitudinal and transverse lengths changed with each other or the like.

The case that printing is performed while the printability improvement liquid dots and the Bk ink dots simply overlap each other and the case that printing is performed while they are positionally deviated by a quantity of half pixel are shown in FIG. 4A and FIG. 4B in comparison with each other. As is apparent from these drawings, since a wide contact area where the printability improvement liquid dots come in contact with the surrounding Bk ink dots can be maintained by positionally deviating the former from the latter (FIG. 4B), the printability improvement liquid and the Bk ink comes reliably in contact with each other even though the head slightly warps. Thus, the aforementioned effect can be obtained. On the contrary, in the case that the printability improvement liquid dots and the Bk ink dots are shot on the same central positions (FIG. 4A), there arises a location where the printability improvement liquid and the Bk ink does not come in contact with each other. Thus, the aforementioned effect can not be obtained.

The fact that the head warps as mentioned in the present invention is a problem specific to the ink jet that arises with each of the printability improvement liquid and the colored ink. The fact that the head warps means that since the ejecting direction is curved under some influence when the ink is ejected from a nozzle of the head, the position where the ejected ink is shot on the recording medium is deviated from (an ideal lattice point).

In the present invention, an effect of positively deviating the position where an image quality improvement liquid is shot on the printing medium will be described below.

To assure that an effect of the image quality improvement liquid is maximized while reducing a using rate of the latter to reduce a running cost in a normal use, recording is performed while conducting extracting treatment (extracting so as to exhibit an effect such as a minimum waterproofness, bleed stop or the like) for the image quality improvement liquid at a same position relative to image data (shot position of the colored ink). Therefore, in the case that warpage occurs with the image quality improvement liquid, unexpected image quality arises without an occurrence of contact of the image improvement liquid with the colored ink at the position which is expected at the stage of designing (usually, one dot corresponds to one dot). On the contrary, the deviating effect of the image quality improvement liquid consists in that one dot of the image quality improvement liquid always comes in contact with two to four dots, causing the deviating effect to be increased at two to four times. Incidentally, FIG. 4C and FIG. 4D show by way of example printing in accordance with a second embodiment and a third embodiment to be described later.

Figure 5A:
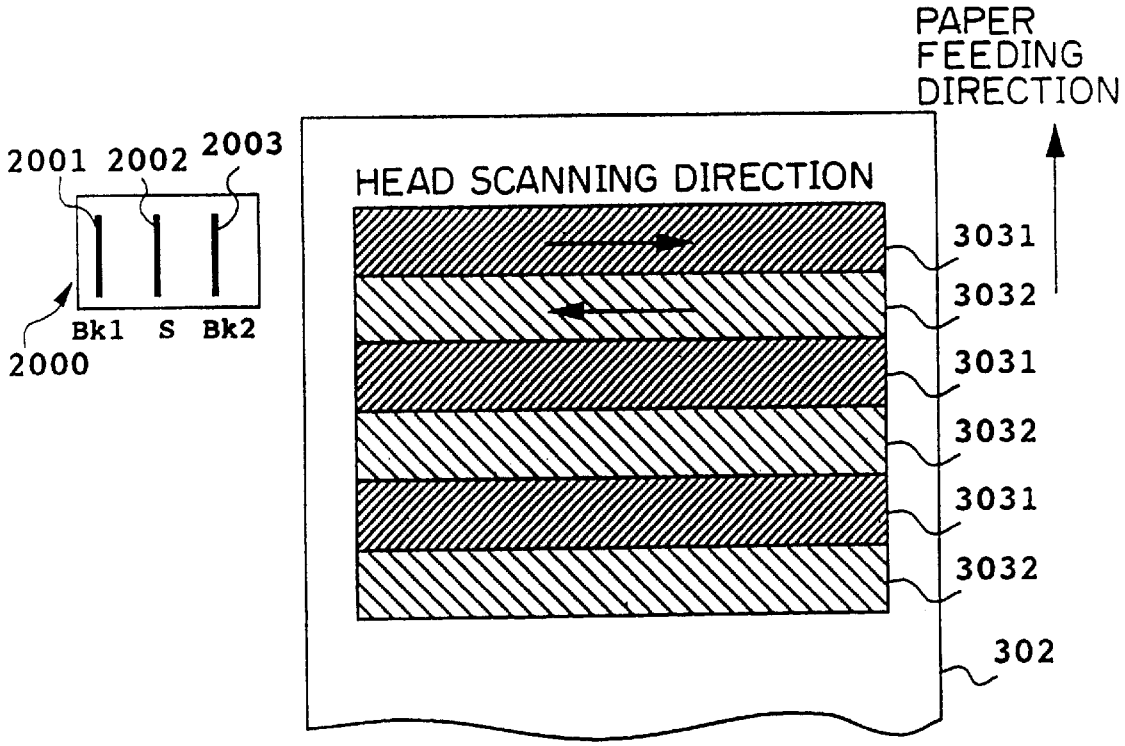
FIGS. 5A to 5C are views which explain the printing method of the present invention in comparison with the conventional printing method.
Figure 5B:
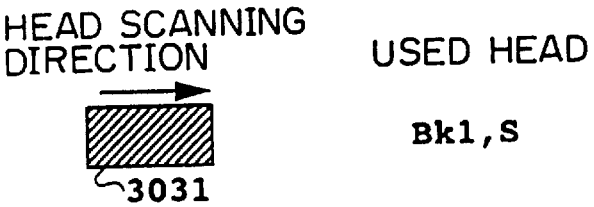
Figure 5C:
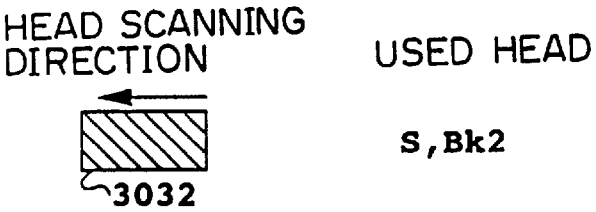

FIG. 5 shows the case that a printability improvement liquid is shot ahead or behind when plural lines are formed using the printability improvement liquid. Reference numeral 302 denoted a printing medium, reference numeral 3031 denotes a forward range where printing is performed when the scanning direction of the carriage is oriented from left to right on the printing medium (forward direction), and reference numeral 3032 denotes a rearward range where printing is performed when the scanning direction of the carriage is reversely oriented from right to left on the printing medium (rearward direction).

This embodiment is concerned with the case of one pass bidirectional printing, and the forward range 3031 and the rearward range 3032 have a width of 360 dpi and 160 pixels. In the printing range 3031, printing is performed using a printability improvement liquid chip 2002 and a Bk chip 2001. Similarly, by performing printing in the printing range 3032 using the printability improvement liquid chip 2002 and a Bk chip 2003, the printability improvement liquid can be shot ahead without fail in the forward direction as well as in the rearward direction rather than the Bk ink, and there arises no density fluctuation. In the drawing, a one pass high speed printing mode is shown as the case of both direction printing, but in the case of multi pass printing, chips can separately be used for pixels to be printed in the forward direction and pixels to be printed in the rearward direction, whereby the order of shooting the printability improvement liquid and the ink can always be kept same. This makes it possible to perform printing while reducing a frequency of use of the printing head and preventing a temperature of the printing head from elevating, whereby a uniform image can be formed in accordance with the aforementioned principle.

At this time, it is desirable to change a nozzle (master pattern) to be used for each chip of the Bk1/Bk2 every page and every scanning in order to allow the nozzle to be used for the printing head not to be kept fixed. This makes it possible that the head is used for an elongated time, and moreover, density fluctuation (variation of a quantity of ejection) attributable to the frequency of use of the nozzle is reduced.

<Description of Apparatus>

An ink jet printing apparatus having the aforementioned monochromatic head unit mounted thereon will be described below.

Figure 6:
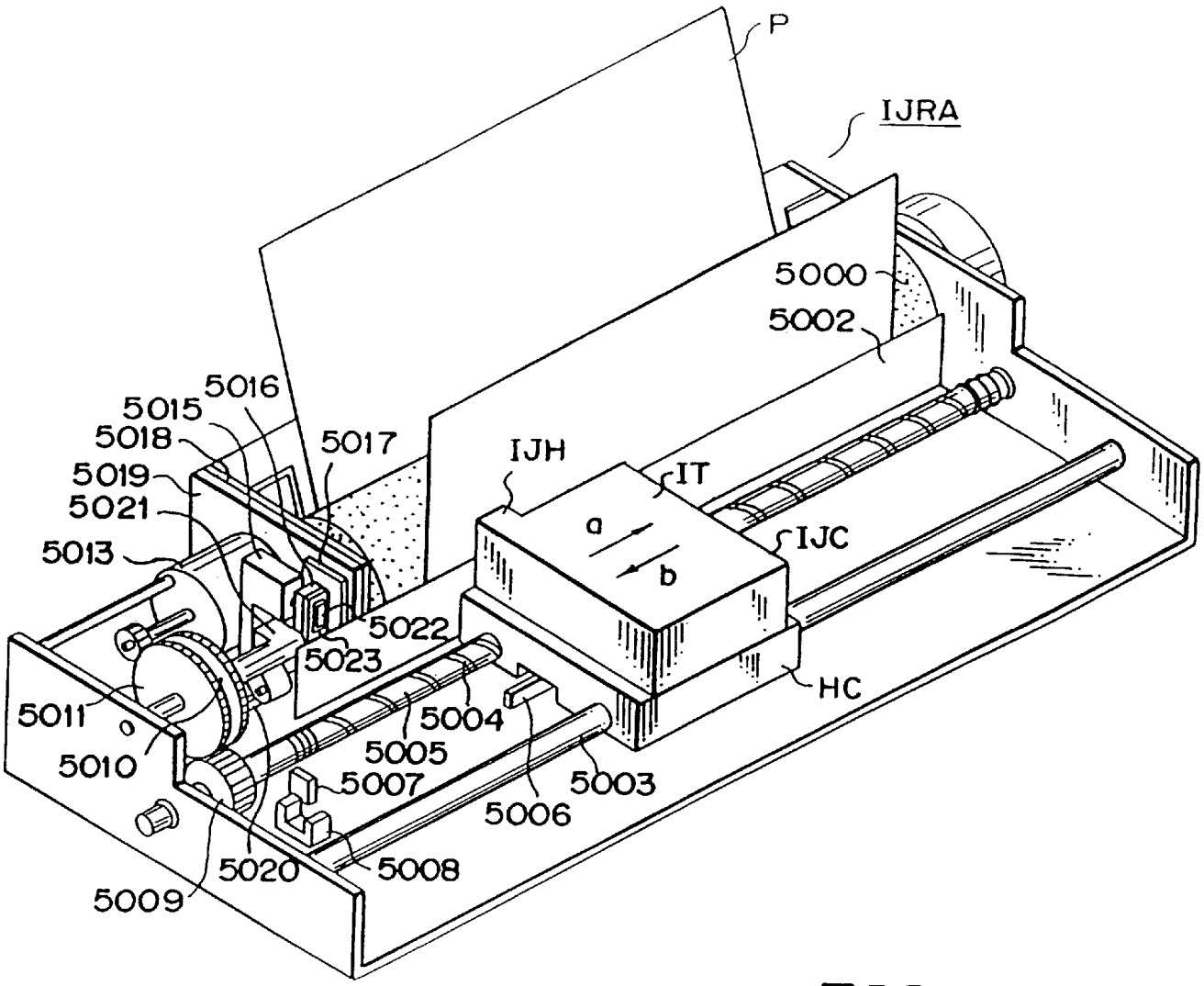
FIG. 6 is a perspective view of an ink jet printing apparatus used according to the first embodiment.

FIG. 6 is a schematic perspective view of an ink jet printing apparatus IJRA constructed according to an embodiment of the present invention. In the drawing, a carriage HC engaged with a spiral structure 5004 of a lead screw 5005 adapted to be rotated via driving force transmitting gears 5011 and 5009 in operative association with rotation of a driving motor 5013 in the normal direction as well as in a reverse direction includes a pin (not shown) so as to allow the carriage HC to be reciprocally displaced in the arrow-marked a direction as well as in the arrow-marked b direction. An ink jet head unit 2001 is mounted on the carriage HC. Reference numeral 5002 denoted a paper retaining plate which serves to thrust paper against a platen 5000 across the direction of displacement of the carriage HC. Reference numerals 5007 and 5008 denote photo couplers which serves as home position detecting means for confirming the presence of the photo couplers in the range of a lever 5006 to change the direction of rotation of a motor 5013 Reference numeral 5016 denotes a member for supporting a cap member 5022 for capping the front surface of the printing head, and reference numeral 5015 denotes sucking means for sucking the interior of the cap which conducts suction recovery of the printing head via an opening 5023 in the cap. The cap member 5022 and the support member 5016 are arranged corresponding to the aforementioned three head chips, and the opening 2023 and the sucking means 5015 are arranged corresponding to the head chips. The printability improvement liquid and the Bk ink sucked at this time are separately conveyed without any mixing with each other and then individually stored in waste ink reservoirs. Reference numeral 5017 denotes a cleaning blade which is disposed separately for the colored ink and for the printability improvement liquid. Reference numeral 5019 denotes a member for displacing the cleaning blade in the forward and rearward direction. This member 5019 is supported on a housing support plate 5018. It is sufficient that the cleaning blade is designed such that the printability improvement liquid and the colored ink do not come in contact with each other. Thus, a hitherto known method may be employed for the foregoing purpose. A series of capping, cleaning and suction recovering operations are performed with the aid of the lead screw 5005 and a clutch (not shown) when the carriage enters in the home position range so that desired treatment can be conducted at the corresponding positions via shifting operation of the lead screw and clutch.

This embodiment has been described with respect to the head structure of Bk1/S/Bk2 but it is obvious that the same effect is obtainable with other head structure of S/Bk1/Bk2 or Bk1/Bk2/S, provided that the printability improvement liquid head and the Bk ink head are arranged at the position where they are positionally deviated from each other. In addition, the same or more acceptable effect is obtainable with the structure that they are deviated from each other not only in the main scanning direction but also in the auxiliary direction.

Second Embodiment

In the first embodiment, the monochromatic head unit is used. In this embodiment, however, a head unit corresponding to color recording is used. Specifically, the structural conditions for the head unit are such that a color head unit (Bk+S+CMY)/(S+Bk+CMY) is employed and each color head is deviated by a half pixel in the auxiliary direction.

In addition, the ejection timing of the printability improvement liquid is controlled by displacing in the main scanning direction, and the head unit is constructed such that printability improvement liquid dot is deviated relative to the Bk color dot. Head structure, ejection properties and so forth will be described in detail below.

By the way, "C", "M", and "Y" denote Cyan, Magenta, and Yellow, respectively.

<Head Structure>

Figure 7:
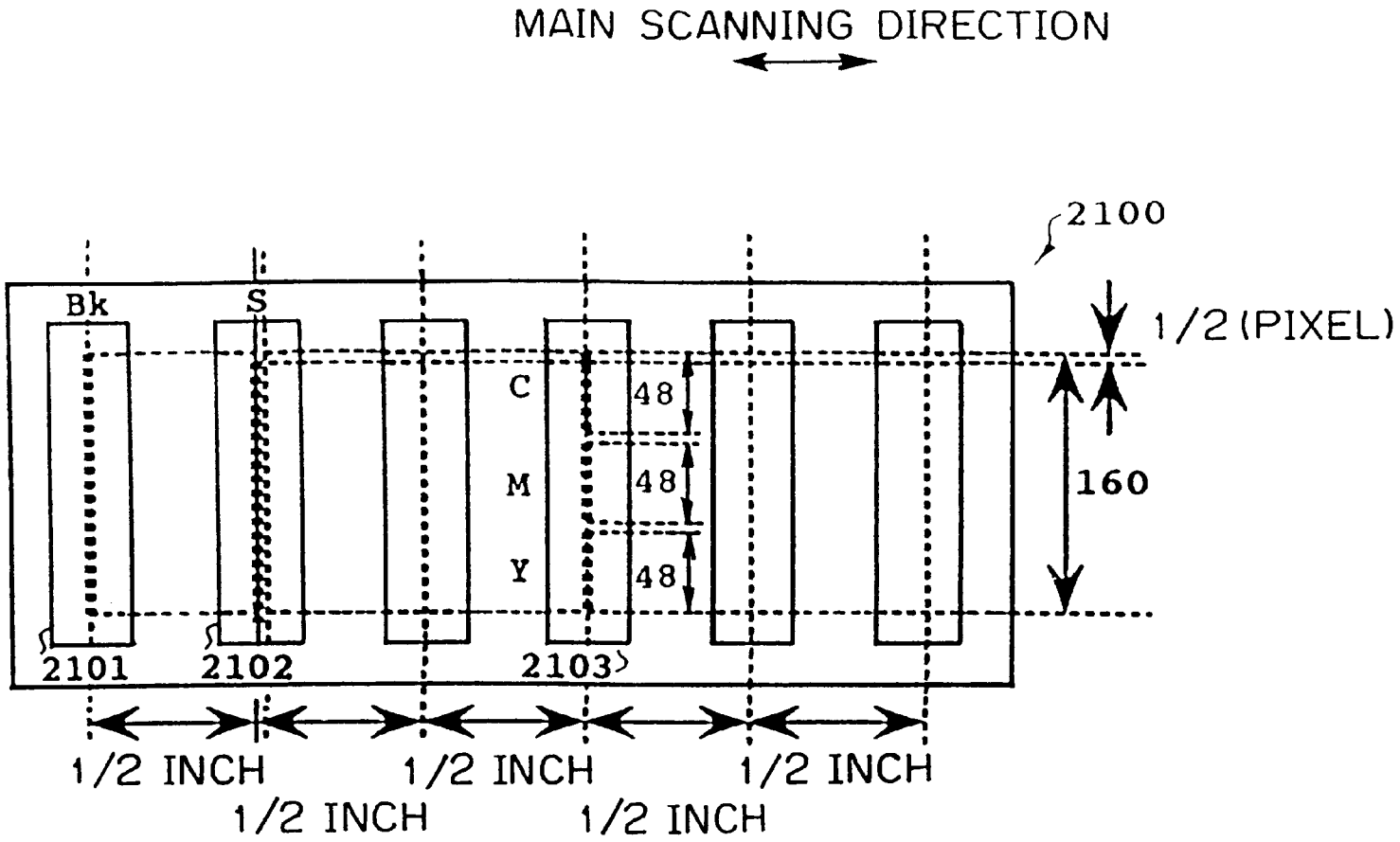
FIG. 7 is a plan view of a color printing head unit used according to a second embodiment of the present invention.

FIG. 7 shows the structure of a color head unit 2100 employed for this embodiment. The unit structure is such that the color head unit 2100 is composed of a Bk chip 2101, an S (printability improvement liquid) chip 2102, and a CMY color integrated chip 2103, and each chip is arranged in the inclined state with a pitch of ½ inch in such a manner as to correct only the driving timing. At this time, a pitch between the Bk chip S2101 and the CMY color integrated chip 2103 is set to one inch. This is because the ink tank 2010 is used on common.

The Bk chip 2101, the CMY color integrated chip 2103 and the S chip 2102 are arranged while they are positionally deviated by a quantity of ½ pixel (about μm) at 360 dpi in the auxiliary direction. Although an effect from the deviation will be described in detail later, it is intended that the contact area with the Bk ink is increased to induce high speed reaction by deviating the shot position of the printability improvement liquid by a quantity of half pixel of 360 dpi in the (0, y) direction from the viewpoint of image design to increase an area factor, and moreover, the total quantity of consumption of the printability improvement liquid is reduced by shooting a necessary minimum quantity of printability improvement liquid to induce reaction with the latter. That is, the ink-ejecting portions and the liquid-ejecting portion are not on the same line in the main-scanning direction.

In this embodiment, the same Bk chip (ejection quantity Vd=80 pl) as that in the first embodiment is used.

Ejection properties of the S chip and the CMY integrated chip are noted below.

<Ejection properties of S chip> number of nozzles: 160 nozzles
(number of divided blocks: 16 blocks)
resolution: 360 dpi
driving frequency: 8.0 (kHz)
quantity of ejection: Vd=40±4 (pl/dot)
ejection speed: 12±0.5 (m/s) (driving condition)
driving voltage: Vop=24.0 (V)
driving pulse width: Pw=4.5 (μs)
opening time per one block: Tb=7.5 (μs)

<Ejection properties of C, M and Y nozzles> number of nozzles: 160 nozzle equivalent, 48 nozzles per each color (48×3)/sealed nozzles between colors, 8 nozzles (8×2) (number of divided blocks: 16 blocks)
resolution: 360 dpi
driving frequency: 8.0 (kHz)
quantity of ejection: Vd=40±4 (pl/dot)
ejection speed: 12±0.5 (m/s) (driving condition)
driving voltage Vop=24.0 (V)
driving pulse width: Pw=4.5 (μs)
opening time per one block: Tb=7.5 (μs)

Figure 8:
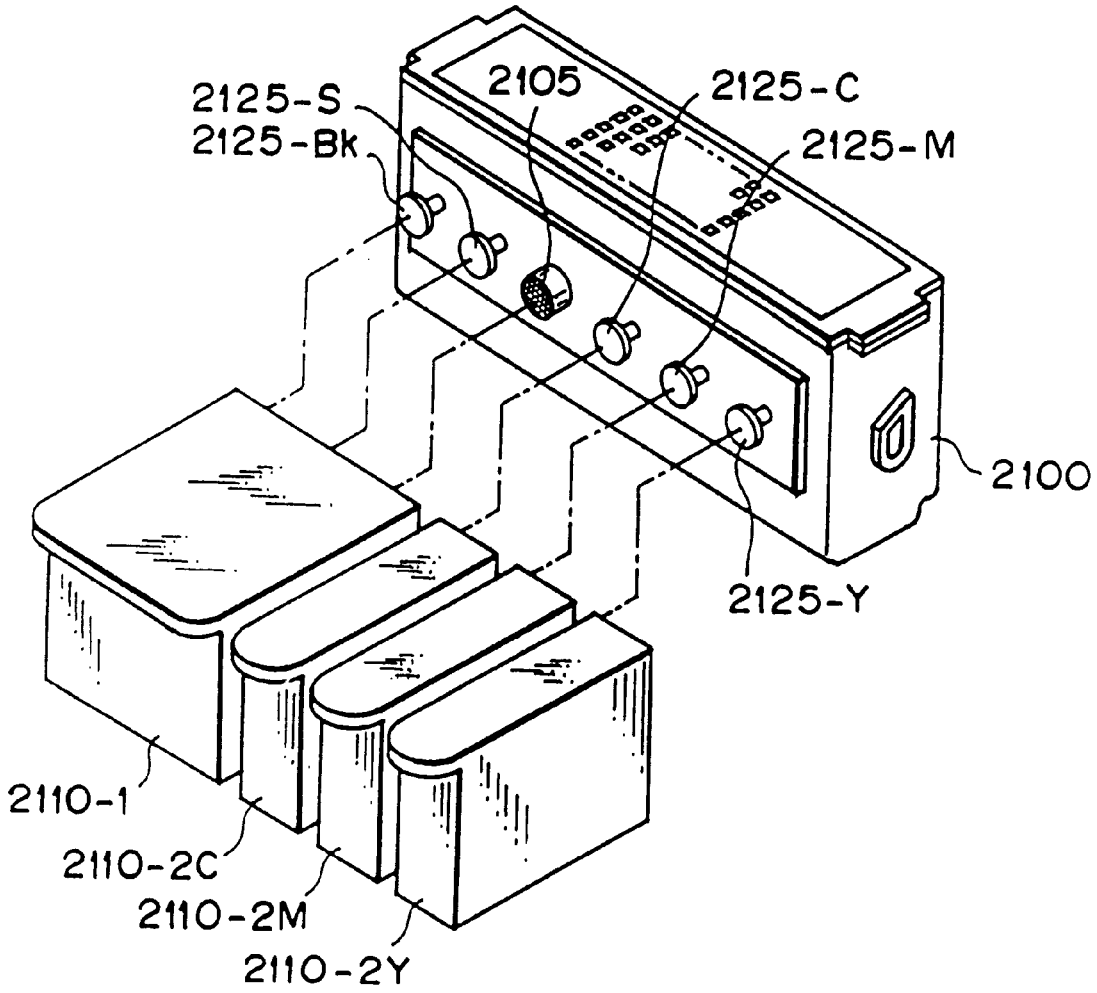
FIG. 8 is a perspective view of the color printing head unit used according to the second embodiment.
Figure 9:
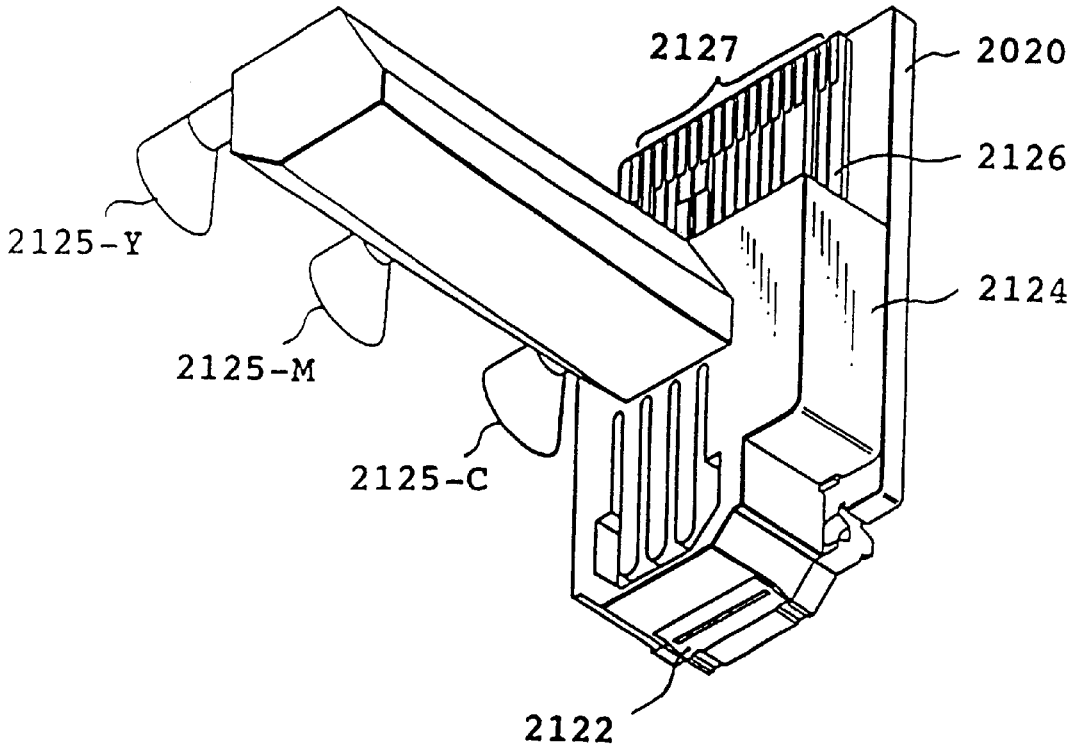
FIG. 9 is a perspective view which shows by way of example a printing head chip.

FIG. 8 is a perspective view which shows the structure of a color ink jet cartridge (head unit and tank). A head unit 2100, a tank 2110-1(same that in the first embodiment) and color ink tanks 2100-2-C, M, Y are constructed to be detachable, when it is found by an ink remaining quantity detecting mechanism that each tank becomes empty, a user is urged to exchange the empty tank with new one via the housing. The head chips 2101 and 2102 are same as explained in the first embodiment as shown in FIG. 1. The head chip 2103 is such that it is possible to print three colors (C, M, Y) with a single chip. Specifically, as shown in FIG. 9, a heater board (not shown) is adhesively attached to a base plate 2020 of aluminum, a grooved ceiling plate 2122 divided into three liquid chambers with one polysulfone (partition wall equivalent to eight nozzles disposed between two colors) is placed on the base plate 2020, sealed with a sealing agent, and firmly secured by a retaining spring (not shown), and a chip tank 2124 which is possible to independently feed three colored inks (of which ink feeding ports are disposed such that each colored ink can be fed at ½ ink pitch and which includes mesh filters 2125-C, M and Y) is secured to the base plate 2020. In addition, PCB 2126 is disposed with a plurality of signal line terminals 2127 for connecting signals lines to a flexible cable on the housing.

Since a tank 2110-1 (for Bk+S) is same as that in the first embodiment, description on it is neglected herein, but since three ink feeding ports are present for two chips, one ink feeding port for the right-hand Bk2 becomes surplus, causing ink leakage and vapor to be developed therefrom. To prevent an occurrence of the foregoing malfunction, a cover 2105 for closing the surplus hole is disposed on the head unit 2100. In this embodiment, ink vaporization is prevented by attaching the cover 2105 to the head unit 2100. However, by contriving the tank side and the filter portion, ink may be fed through the permeable part coming in contact with the filter portion when the tank is mounted.

The tank 2110-2C, 2M, 2Y are coincident with each other in dimension and each of them is divided into plural chambers, one of them being a chamber 2111 (including a buffer chamber) having a sponge received therein and other one being a chamber 2112 having raw ink received therein. One ink tank 2110-2 is used for one color. Feeding of each ink can be effected successively or via total sucking recovering by housing recovering means (not shown) by allowing the sponge portion in the tank 2110-1 and the tank 2110-2C, 2M, 2Y to come in close contact with the filter 2124-Bk, S and 2124-C, M, Y in the head 2100.

<Printing Mode>

A printing mode employable when controlling the driving of the color head unit in the color head unit constructed in the above-described manner is mounted on an ink jet printing apparatus will be described below. Since a method of printing Bk ink is not changed from the conventional method, it will briefly be described herein.

Basically, there are three kinds of printing modes each of which can be selected by an image quality and a printing speed required by a user.

1. Fast Mode one pass bidirectional 360×360 dpi (printability improvement liquid present/absent)
2. Normal Mode: two pass bidirectional 360×360 dpi (printability improvement liquid present/absent)
3. High Quality Mode: four pass one/bidirectional 720×360 dpi (printability improvement liquid present/absent)

The printing mode can be selected by actuating a print driver incorporated in a host computer (not shown), and moreover, it can be shifted by actuating a selection witch of a printer (not shown).

Here, for the purpose of simplification of description, a color printing method to be practiced using the aforementioned head structure and a printing method using the printability improvement liquid along the boundary for preventing an occurrence of bleed and most along the boundary between color and Bk will mainly be described below.

<Bk printing mode>

In the case that an article to be printed with the head constructed according to this embodiment is an image formed only with Bk, there are three printing modes.

Specifically, a high speed printing mode of printing the printability improvement liquid alternately in the head feeding state and in the behind feeding state by performing printing with bidirectional print using 160 nozzles of the Bk chip 2101 and the printability improvement liquid chip 2102 (print mode Bk1: It should be noted that there arises band fluctuation depending on the permeating state of the ahead fed printability improvement liquid/the behind fed printability improvement liquid), a printing mode of performing printing which makes it possible to print a high speed without density fluctuation with bidirectional printing in such a manner that density fluctuation does not arise by allowing the density difference between the ahead fed state and the behind fed state to be recognized as average density while distributing it without visual recognition of man's eyes wherein the bidirectional printing is executed by performing fine printing while masking every scanning as paper is conveyed by a quantity of each 80 nozzles among 160 nozzles of the Bk chip 2101 and the printability improvement liquid chip 2102, and masking treatment is conducted such that about each half area of image is formed with the Bk and the printability improvement liquid in the ahead fed state as well as in the behind fed state Printing mode Bk2), A printing mode of performing printing at a low speed but reliably by always firmly holding the printability improvement liquid in either of the ahead fed state and the behind fed state (conventional printing method) by performing printing via one directional printing using 160 nozzles of the Bk chip 2101 and the printability improvement liquid chip 2102 (print mode Bk3).

At this time, it is obvious that the printability improvement liquid and the Bk ink are always shot on the printing medium with positional deviation by a quantity corresponding to a half pixel in the auxiliary direction. This deviation effect reduce a quantity of consumption of printability improvement liquid, and moreover, similarly reduce band fluctuation depending on the contact area and positional difference.

<Color Printing Mode>

On the other hand, in the case an article to be printed is a colored image, the Bk chip 2101 and the printability improvement liquid chip 2102 perform printing using only 48 nozzles (on the cyan side) adapted to most firstly perform printing among 160 nozzles corresponding to the number of nozzles of one color (C) of the color chip 2103. One example of a color image forming method will be shown.

Figure 10:
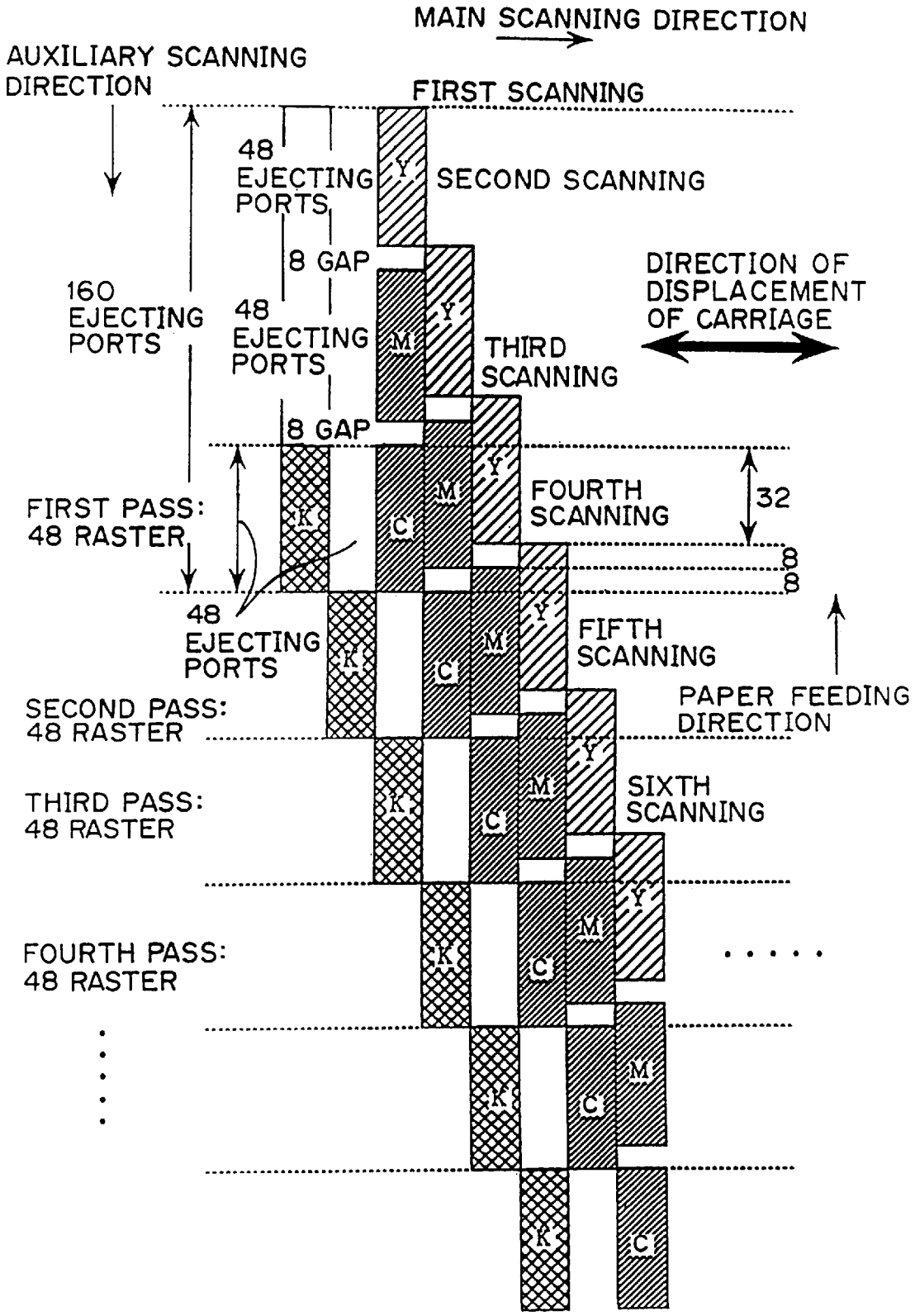
FIG. 10 is a view which explains a color printing method according to the second embodiment.

First, for the purpose of simplification of description, a method of performing one pass bidirectional color printing with the aforementioned head structure will be described with reference to FIG. 10. Incidentally, a method of printing a printability improvement liquid will be described later.

At the time of forward printing of first scanning, a first line is printed with the use of 48 nozzles of C of a color integrated type head using only 48 nozzles among 160 nozzles of the Bk. Next, a printing medium is conveyed by a quantity corresponding to 48 nozzles, and at the time of rearward printing of second scanning, a first line is printed with the use of M of 40 nozzles. At this time, a second line is printed with the use of Bk and C of 48 nozzles. Next, the printing medium is conveyed by a quantity corresponding to 48 nozzles, and at the time of forward printing of third scanning, a first line is printed with the use of y of 32 lines. At this time, a second line is printed with the use of M of 8 nozzles, and a third line is printed with the use of Bk and C of 48 nozzles. In addition, the printing medium is conveyed at a distance corresponding to 48 nozzles, and at the time of forward printing of fourth scanning, a first line is printed with the use of Y of 16 nozzles. At this time, second lines are printed with the use of M of eight nozzles and Y of 32 nozzles, a third line is printed with the use of M of 40 nozzles, and fourth lines are printed with the use of Bk and C of 48 nozzles. Subsequently, an image is formed in the same manner as mentioned above, and formation of the image is completed by performing reverse printing.

Printing is performed while completing a color print for one line by four scannings in the above-described manner.

Figure 11C:
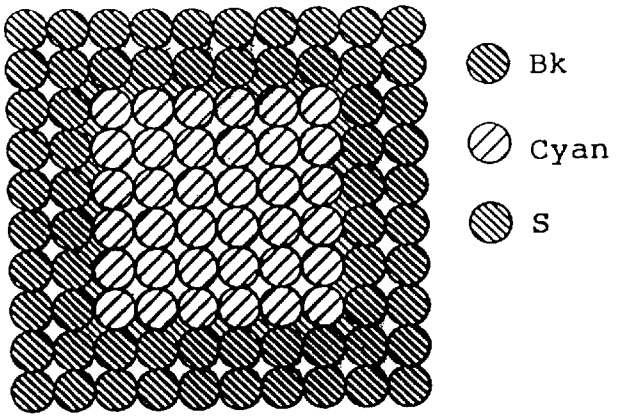
FIGS. 11A to 11D are views which show examples of a printing method along the boundary in the case that the printing head according to the second embodiment is used.
Figure 11D:
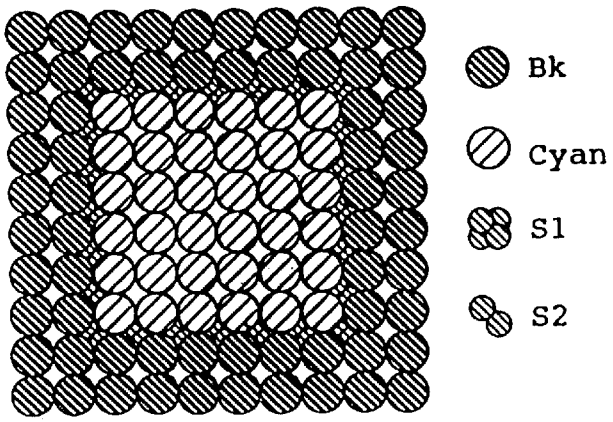
Figure 11A:
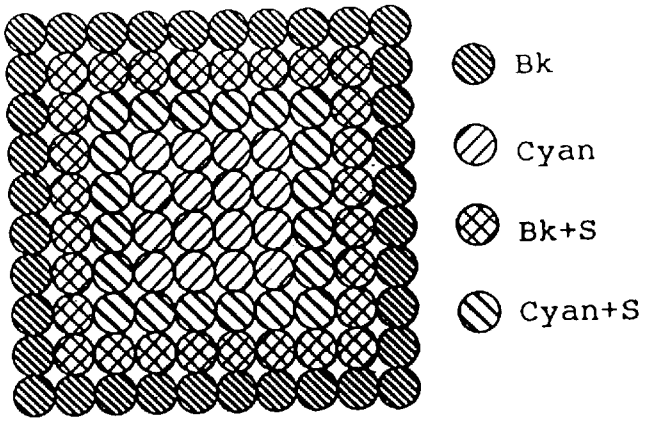

Next, one example of a method of printing printability improvement liquid along the boundary when performing one pass bidirectional color printing using the color head unit according to this embodiment will be described below with reference to FIG. 11A. Incidentally, FIG. 11B to FIG. 11D will be described below.

In this embodiment, an ink having poor permeability, high printing density and excellent sharpness but slight poor fixability is used for the Bk ink (HS ink: High Sold), while an ink having excellent permeability, exhibiting no oozing (bleed) between colors, having good fixability but having a slight poor feathering is used for the color ink (CMY in common/QS ink: Quick Set). Accordingly, oozing and white mist (a phenomenon that the dyestuff in the ink becomes thin, causing it to be recognized as white) arise along the boundary between the Bk and the color.

With the head structure constructed according to this embodiment, the printability improving liquid chip 2102 is located between the Bk chip 2101 and the color chip 2103 with the positional deviation by a quantity of half pixel in the auxiliary direction. In this embodiment, the printability improvement liquid is deviated by a quantity corresponding to a half pixel but it is deviated not only in the main scanning direction but also in the auxiliary scanning direction by causing the ink jet head to eject it in the main scanning direction with delay of the ejecting timing by a quantity of half period of the ejecting period.

For this reason, in the case of forward printing, the order of shooting of the inks and the printability improvement liquid is such that c ink→printability improvement liquid→Bk ink→M ink→Y ink. Since the printability improvement liquid is already shot on the printing medium when the Bl ink is printed, C/K ink does not come in direct contact with the colored ink along the boundary. When C/Bk ink comes in contact with the colored ink, on the other hand, the coloring material on the C ink reacts on the printability improvement liquid on the C ink (undissolution or coagulation arises), the printability improvement liquid on the C ink reacts the coloring material on the Bk ink (undissolution or coagulation arises), and the coloring material on the Bk ink is not displaced. Thus, a malfunction of bleed or white mist does not occur. In the case of rearward printing, inks are shot in accordance with the order of Bk ink→printability improvement liquid→C ink→M ink→Y ink. Since the printability improvement liquid is already shot on the printing medium in contrast with the case of forward printing when the colored ink is printed, the coloring agent on the Bk ink reacts with the printability improvement liquid along the boundary (undissolution or coagulation arises). Thus, there does not arise any problem. Since the coloring material on the Bk ink reacts with the printability improvement liquid (undissolution or coagulation arises) when the Bk ink comes in contact with the printability improvement liquid, the coloring material on C/Bk ink is not displaced. Thus, a malfunction of bleed or while mist does not occurs. Accordingly, when the structure of the print head constructed according to this embodiment is used, the Bk ink does not come in direct contact with the coloring material on the colored ink. Thus, it can be prevented that the conventional problem arises. In this embodiment, the printability improvement liquid is printed along the boundary on the dot-on-dot (100%) relationship on the Bk side, while it is printed with a width corresponding to two pixels on the color side.

At this time, it is necessary that the printability improvement liquid is printed on both the colored inks along the boundary in the dot-on-dot relationship with a width corresponding to at least one pixel. It is unavoidable that a malfunction of bleed or white mist occurs with one pixel of either of both the colored inks. It is recommendable that a quantity of shooting of the printability improvement liquid is increased for the side of the ink having high dyestuff density or the ink having poor permeability. It is sufficient that a quantity of shooting of the printability improvement liquid is determined by a desired image quality, printing speed (treatment time) or the like in consideration of a printing width of the printability improvement liquid, restriction of a quantity of shooting (reduction of a quantity of printability improvement liquid by extraction from dots on dots), the kind of ink to be used, a printing method (the number of passes/bidirection/one direction), environment or the like. When a quantity of use of the printability improvement liquid is increased, a phenomenon of reduction of printing quality appears due to increasing of a running cost and an occurrence of cock ring on the printing medium. Accordingly, it is not required that a quantity of ejection of the printability improvement liquid is increased in excess of necessity, but to reduce further an occurrence of the malfunction of bleed or white mist along the boundary between two different colors, it is preferable to increase the number of dots for application of the printability improvement liquid much more than other part having a same color. For example, the printability improvement liquid is applied to at least all pixels along the boundary between different colors, while the printability improvement liquid is applied in the extracted state to the range having a same color other than the boundary.

Figure 11B:
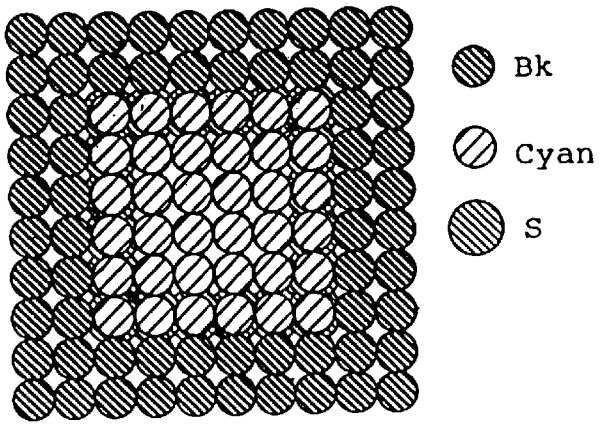

It has been found that an effect derived from the printability improvement liquid is increased by variably changing a quantity of ejection of the printability improvement liquid or an effect unattainable till now from the printability improvement liquid appears. One example of the printed state in the case that a quantity of ejection is changed along the boundary or the shot position is deviated is shown in FIG. 11B to FIG. 1D. FIG. 11B shows the case that a quantity of ejection of the printability improvement liquid is increased along the boundary, FIG. 11C shows the case that the shot position of the printability improvement liquid is deviated along the boundary, and FIG. 11D shows the case that the resolution of the printability improvement liquid is improved and the shot position of the same is deviated along the boundary.

With respect to an ordinary printing medium (a sheet of paper) to be used for the copies known as plain paper copies, a quantity of shooting of ink onto the printing medium has a limit of 16 nl/mm$^2$, at largest 20 nl/mm$^2$. When the quantity of shooting of ink onto the printing medium exceeds the foregoing value, this leads to head wearing/image contamination/head trouble due to an occurrence of cock ring on the printing medium. In addition, various kind of troubles such as appearance of a printed image on the rear surface of the printing medium, an occurrence of smear or the like arise due to delayed penetration of the ink and poor fixability.

Figure 12A:
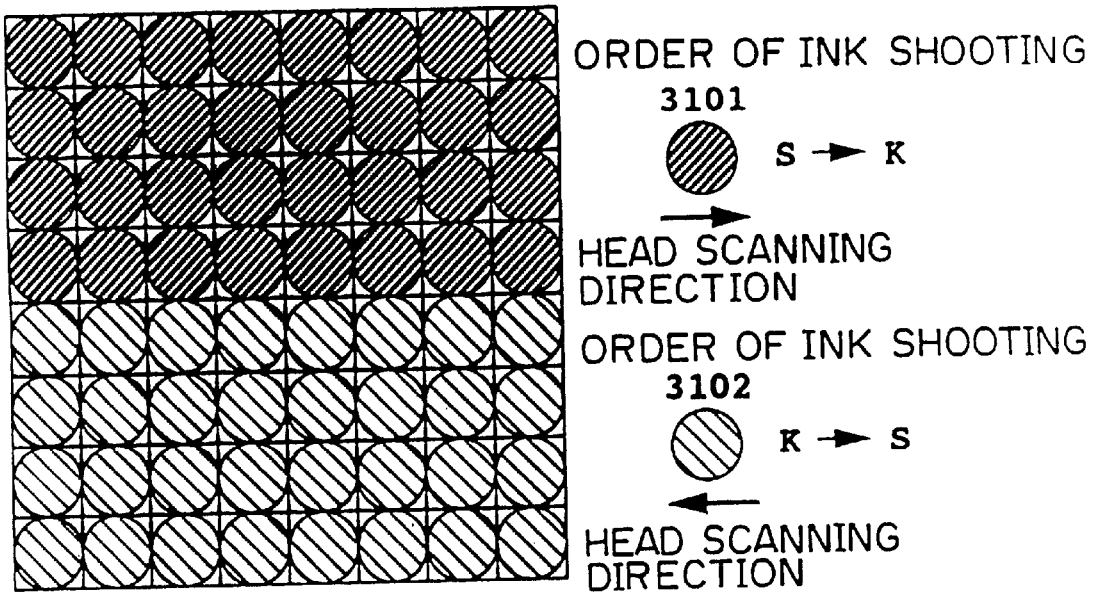
FIG. 12A and FIG. 12B are views which show reciprocable printing conducted with the use of a printing head according to the second embodiment in comparison with the conventional printing method.
Figure 12B:
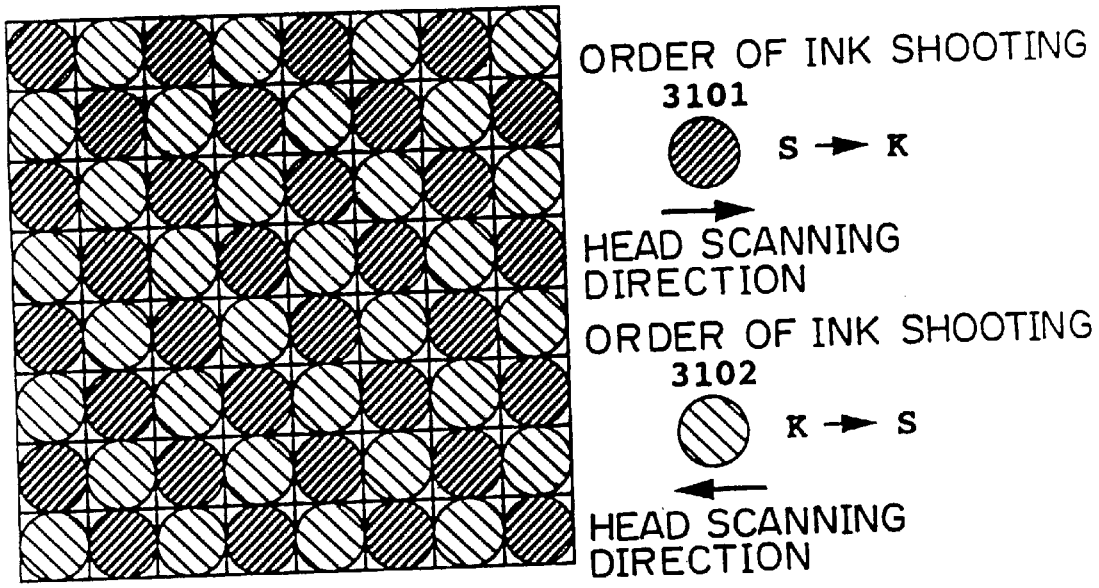

In the case that reciprocable printing is performed with the head structure constructed according to this embodiment, printing is achieved as shown in FIG. 12. To facilitate understanding of shooting of the Bk ink and the printability improvement liquid, one example of four nozzle head structure is shown in the drawing. In the drawing, reference numeral 3101 denotes a pixel which is displaced at the time when an ink jet head is displaced from left to right in the forward direction and shot on a printing medium in accordance with the order of printability improvement liquid_ink, and reference numeral 3102 denotes a pixel which is printed at the time when the ink jet head is displaced from right to left in the rearward direction and shot on the printing medium in accordance with the order of ink→printability improvement liquid. With the conventional method, the pixels 3101 and 3102 are printed during forward and rearward printing in the form of a band having a width equal to a nozzle width, resulting in density fluctuation being remarkably recognized (FIG. 12A). On the contrary with the conventional method, according to this embodiment, respective pixels are arranged in zigzag and inverted zigzag and a same range should be printed with two passes and more. Thus, both pixels are microscopically mixed with each other and a uniform image is macroscopically formed with them (FIG. 12B).

<Explanation of Apparatus>

Figure 13A:
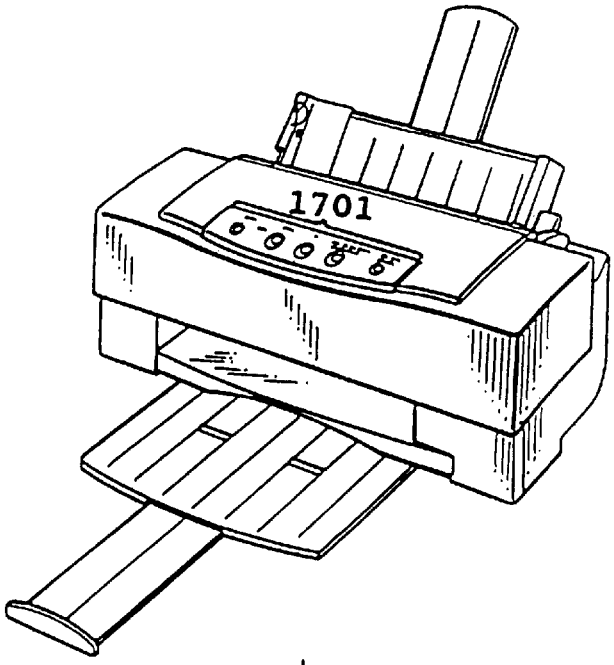
FIG. 13A and FIG. 13B are perspective views which show by way of example a color ink jet printing apparatus used according to the second embodiment.
Figure 13B:
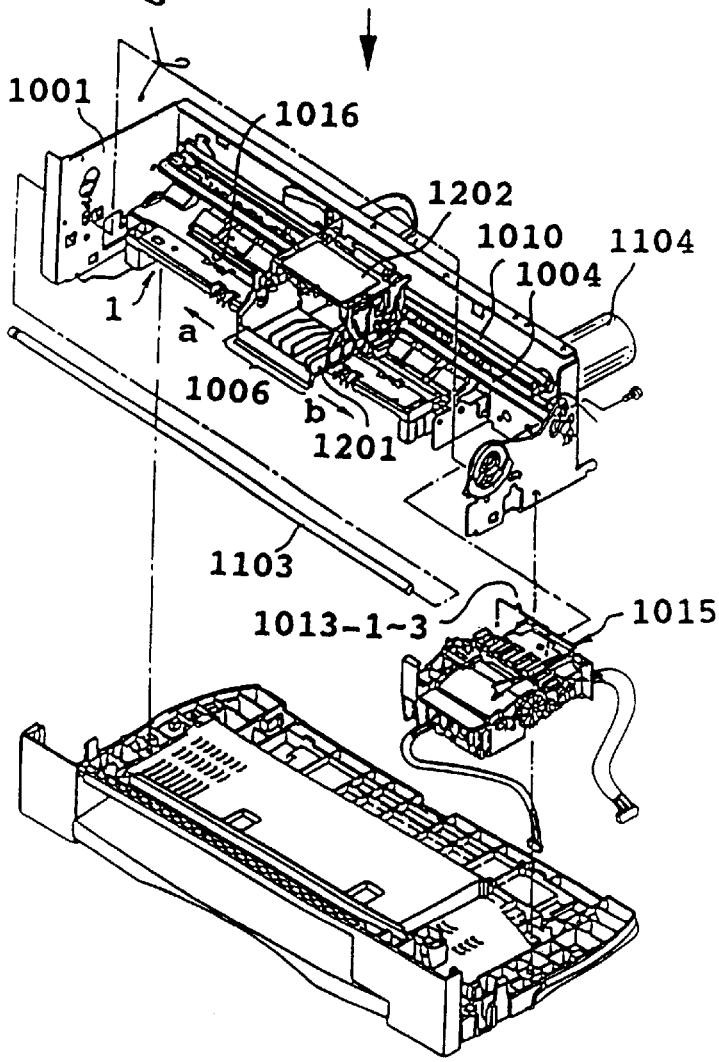
Figure 14A:
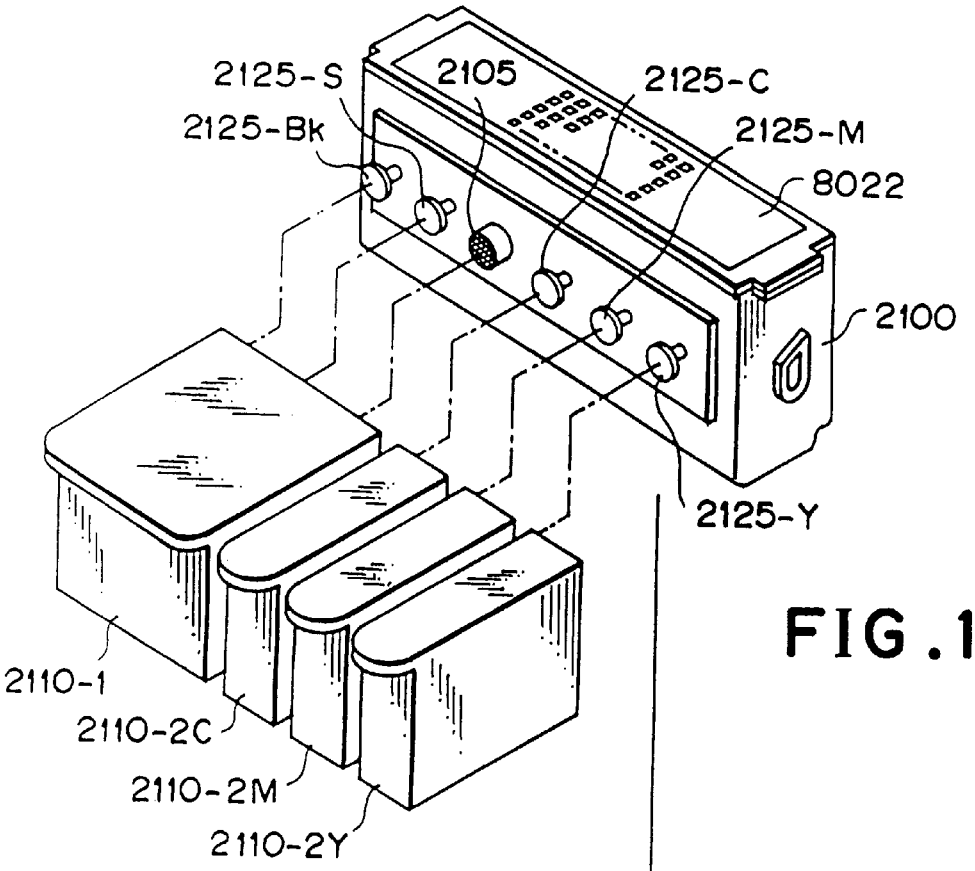
FIGS. 14A and 14B are enlarged views of a carriage portion of the color ink jet printing apparatus used according to the second embodiment.
Figure 14B:
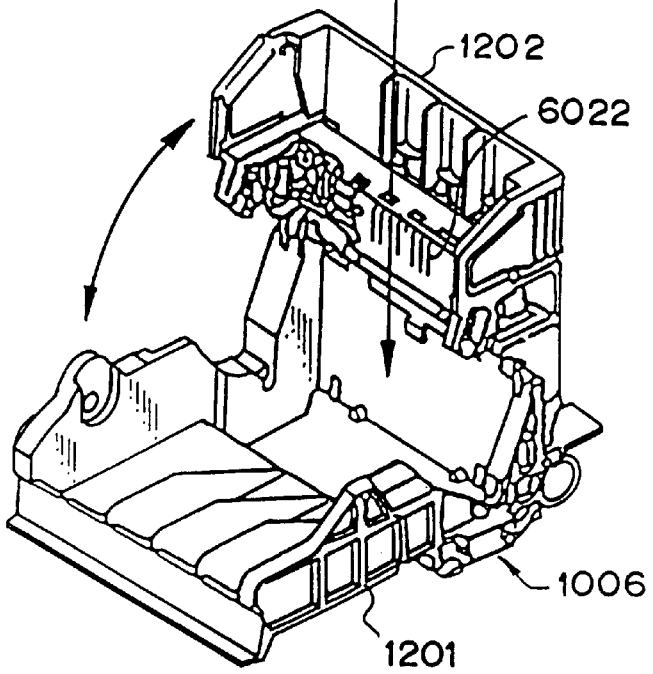

A color ink jet printing apparatus having a color ink jet print head unit as described above mounted thereon will briefly be described below. FIG. 13A is a perspective view which shows appearance of the color ink jet printing apparatus and FIG. 13B is a perspective view which shows essential components constituting the color ink jet printing apparatus in the disassembled state. FIG. 14 is a perspective view which shows essential components located in the vicinity of a carriage.

A print head unit 2100 and a group of ink tanks 2100-1 and 2110-2 for feeding ink to the printing head unit 2100 can be mounted on the carriage 1006. The carriage 1006 includes a head lever for firmly holding the print head unit 2100 and the ink tanks 2110 mounted on a carriage base 1201. A connector 8022 for receiving signals for drivably controlling the print head and power source is disposed on the upper surface of the print head unit 2100, and when the print head unit 2100 is practically mounted on the carriage 1006, the connector 8022 is electrically connected to a connector 6022 disposed on the carriage side 1006. A guide shaft 1004 and a support shaft 1103 are arranged between both the side walls of a chassis 1001 for slidably supporting the carriage 1006.

The driving force for the carriage 1006 adapted to be reciprocably displaced on both the shafts in the main scanning direction is imparted from a carriage motor 1104 via a driving belt 1010. Conveying of a printing medium such as a paper or the like is achieved by a platen roller and a pinch roller (not shown) so that the printing medium is conveyed to a platen 1016. At this time, a group of nozzles on respective printing chips 2101 to 2103 of the print head unit 2100 are arranged so as to eject ink in the downward direction and face to the printing medium on the platen 1016 in parallel with it.

In this embodiment, a recovering unit 1015 is disposed on the home position side (right-hand side as seen in FIG. 13). When the carriage 1006 is located at the home position, respective chips of the print head unit 2100 come in close contact with suction/open caps (rubber) 1013-1 to 1013-3 to perform capping. Thus, the normal ink cap 1013-1, printability improvement liquid suction cap 1-13-2 and the open cap 1013-3 prevent ink in the nozzles of the printing chips from being vaporized to prevent the ink from having an increased viscosity, and moreover, prevent reduction of reliability due to incorrect ejection of the ink. Incidentally, the printing chip 2103 facing to the open cap performs sucking operation after it is displaced to the suction cap 1013-1.

When the ink tanks are exchanged with another ones or ink is incorrectly ejected, the suction caps 1013-1 to 1013-3 are brought in close contact with the printing chips 2101 to 2103 to generate negative pressure by driving a pump unit (not shown). Thus, replacement of the ink with new one and ejecting recovery can be achieved with the aid of a suction recovering treatment mechanism. The ink and the printability improvement liquid discharged from the pump are separately recovered in waste ink tanks.

Image signals are transmitted from a host computer via I/F or the like, temporarily stored in a printing buffer, developed to data corresponding to the nozzle and a printing mode so that they are delivered to a head driver as driving signals. Thus, an image is formed by ejecting ink from the printing head.

The control panel 8022 is disposed on the upper surface of the apparatus to control printing conditions.

In this embodiment, the head structure of Bk1/S/CMY has been described above. However, it is obvious that the same effect can be obtained with other structure of S/Bk/CMY, Bk/CMY/S or the like, provided that printability improvement liquid and colored ink heads are disposed with positional deviation from each other. In addition, same effect can be obtained with positional deviation not only in the auxiliary scanning direction but also in the main scanning direction, and moreover, with simultaneous positional deviation in both the directions of the main scanning direction and auxiliary scanning direction.

Third Embodiment

In this embodiment, a head unit corresponding to color recording in the same manner as the second embodiment is used. However, structural conditions of the head unit are such that head structure is a color head unit (Bk1+s (diametrical ½ deviation)+Bk2+C+M+Y) which is positionally deviated by a quantity corresponding to a half pixel in the main scanning direction as well as in the auxiliary scanning direction.

<Head Structure>

Figure 15:
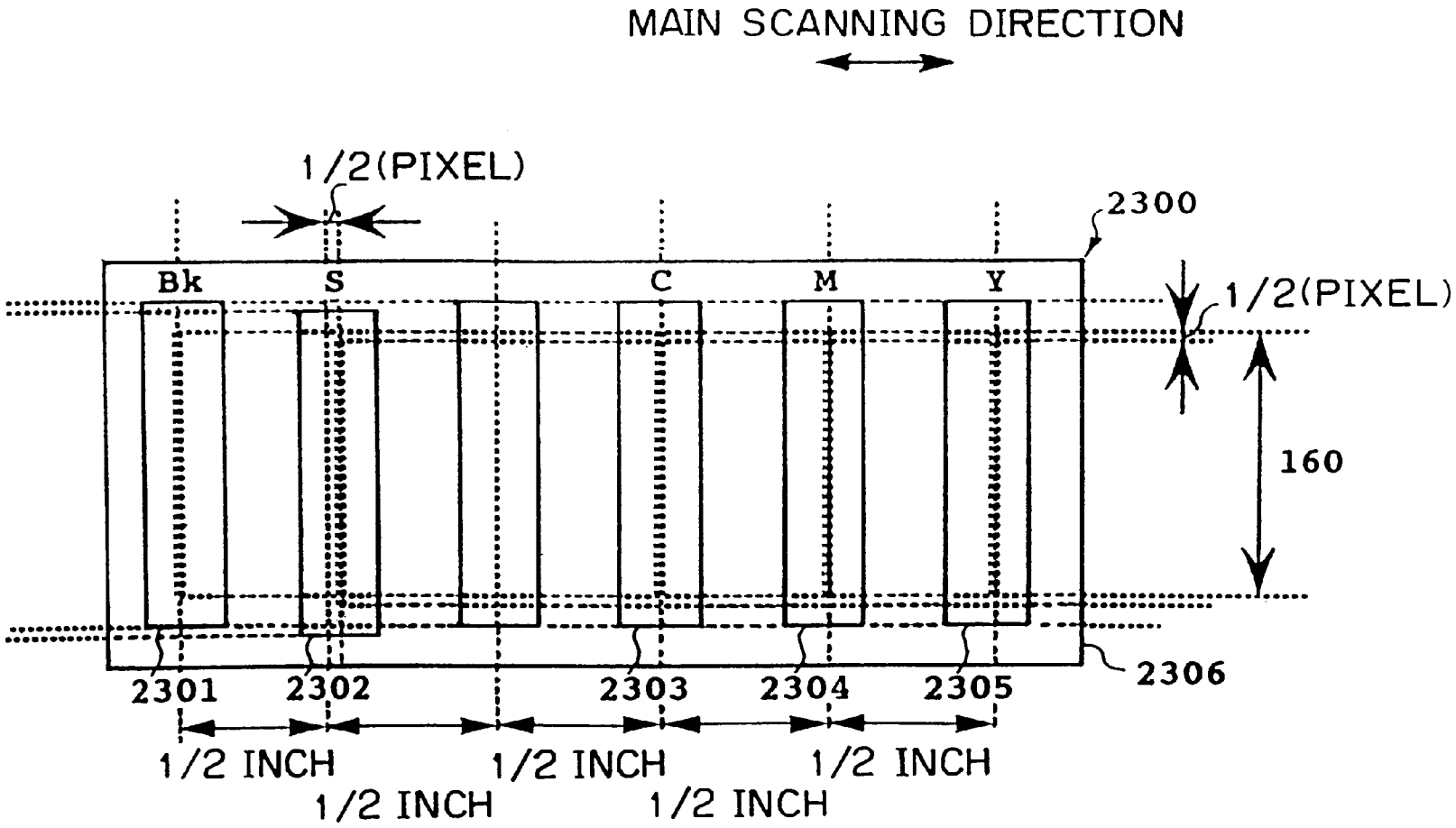
FIG. 15 is a plan view of a color printing head unit used according to a fourth embodiment of the present invention.

FIG. 15 shows the structure of a color head unit 2300 employed for this embodiment. The structure of such head unit is composed of a Bk chip 2301, S(printability improvement liquid) chip 2302, a C chip 2303, a M chip 2304 and a Y chip 2305. Each chip is arranged with a pitch of ½ inch in the inclined state on a frame 2306 so that it is corrected by a quantity corresponding to the driving timing. At this time, only a pitch between the S chip 2302 and the C chip 2303 is set to one inch, and the ink tank 2010 employed for the first embodiment is used in common.

The Bk chip 2301 and the S(printability improvement liquid) chip 2302 are disposed with positional deviation of ½ pixel (about 35 μm) at 360 dpi in the x direction as well as in the y direction. Although an effect derived from the positional deviation will be described in detail later, the shot position the printability improvement liquid is deviated by a quantity of half pixel at 360 dpi in the x direction as well as in the y direction from the viewpoint of image designing, causing an apparent area factor to be increased. Thus, a contact area with the Bk ink and the CMY inks is increased. This is intended to reduce a total quantity of use of the printability improvement liquid by shooting a necessary minimum quantity of the printability improvement liquid to induce a reaction with the latter.

The same chip as that in the first embodiment (80 pl) is used for the Bk chip, and the same chip as the S chip 2202 employed for the second embodiment (40 pl) is used for other S/C/M/Y chips. Ejection properties of each chip are noted below.

<Ejection Properties of Bk chip>
number of nozzles: 160 nozzles
(the number of divided blocks: 16 blocks)
resolution: 360 dpi
driving frequency: 10.0 (kHz)
discharged quantity: Vd=80±8 (pl/dot)
discharging speed: 15±0.5 (m/s)
<Driving Condition>
driving voltage: Vop=24.0 (V)
driving pulse width: Pw=5.5 (μs)
opening time per one block: Td=6.0 (μs)
<Ejection Properties of C, M and Y Tips>
the number of nozzle: 160 nozzle equivalent, 160 nozzles per each color)
(the number of blocks: 16 blocks
resolution: 360 dpi
driving frequency: 10.0 (kHz)
ejected quantity: Vd=40±4 (pl/dot)
ejecting speed: 12±0.5 (m/s)
<driving condition>
driving voltage: Vop=24.0
driving pulse width: Pw=4.5 (μs)
opening time per one block: Td=6.0 (μs)

Figure 16:
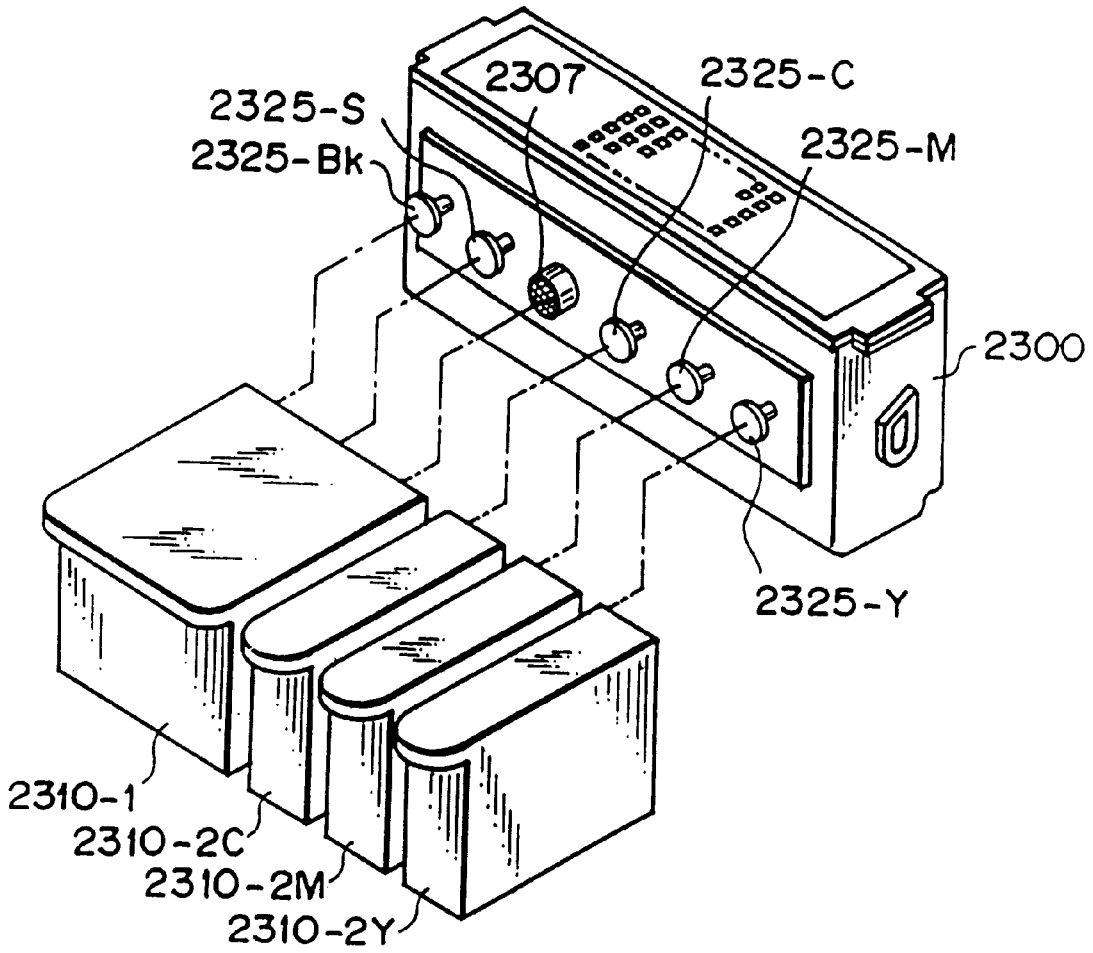
FIG. 16 is a perspective view of a color printing head unit used according to the fourth embodiment.

FIG. 16 is a perspective view which shows a color ink jet cartridge (head unit and tanks). The head unit 2300 and a tanks 2310-1 (same one as in the first embodiment) and 2310-2C, 2M and 2Y (same ones in the second embodiment) are designed to be detachable, and when it is found by an ink remaining quantity detecting mechanism that each tank becomes empty, a user urges to exchange the tank with new one. Head chips 2301 and 2302 are same as those described in the first embodiment with reference to FIG. 3. Head chips 2303, 2304 and 2305 are chips for colors which makes it possible to print three kinds of inks (C, M, Y). When only the head chip 2302 is secured to a frame 2306 of the head unit 2300, it is mounted while it is deviated by a quantity of half pixel of 360 dpi in the x direction as well as in the y direction. Since there are three ink feeding ports for two chips, the ink feeding port for the Bk2 ink located on the right-hand side becomes surplus from which ink leaks and vapor is generated. To prevent an occurrence of this malfunction, a cover 2307 for closing this port is provided on the head unit 2300. Each of tanks 2310-2C, 2310-2M, 2310-2Y is divided into plural chambers, one of them being a chamber (including a buffer chamber) having a sponge received therein and other one being a chamber having raw ink received therein. One tank 2310-2 per each color is used. Ink feeding can be achieved by bringing the sponge portions of a tank 2310 in close contact with filters 1225-Bk, 2325-S, 2325-C, 2325-M, 2325-Y of the head 2300 and then successively or totally conducting suction recovering by recovering means on the housing side.

<Printing Mode>

1. Bk/color printing mode

A printing method to be practiced with the use of a head according to this embodiment will be described below. The kind of ink usable in this embodiment is an ink of the same kind as that used in the second embodiment. With the head structure in this embodiment, since printability improvement liquid is shot between the Bk ink and the color ink with positional deviation by a quantity of half pixel in the x direction as well as in the y direction without fail, a contact area of the printability improvement liquid with the colored ink along the boundary is increased so that an occurrence of malfunction of oozing or white mist can be prevented with a small quantity of printability improvement liquid. In addition, a printing method for eliminating density fluctuation (color fluctuation) bidirectionally caused by variation of color phase (Blue) C→M/M→C, (green) C→Y/Y→C, (Red) M→Y/Y→M) attributable to the order of shooting of the color inks as well as density fluctuation (S→C/C→S, S→C→M/M→C→S) attributable to difference of the order of shooting of the printability improvement liquid at the time of color printing will be described below.

As one example, color fluctuation attributable to difference of the order of shooting of the colored inks in addition to density fluctuation attributable to the order and time difference of shooting of the colored inks and the printability improvement liquid at the time of the aforementioned bidirectional printing will be described below.

Figure 17A:
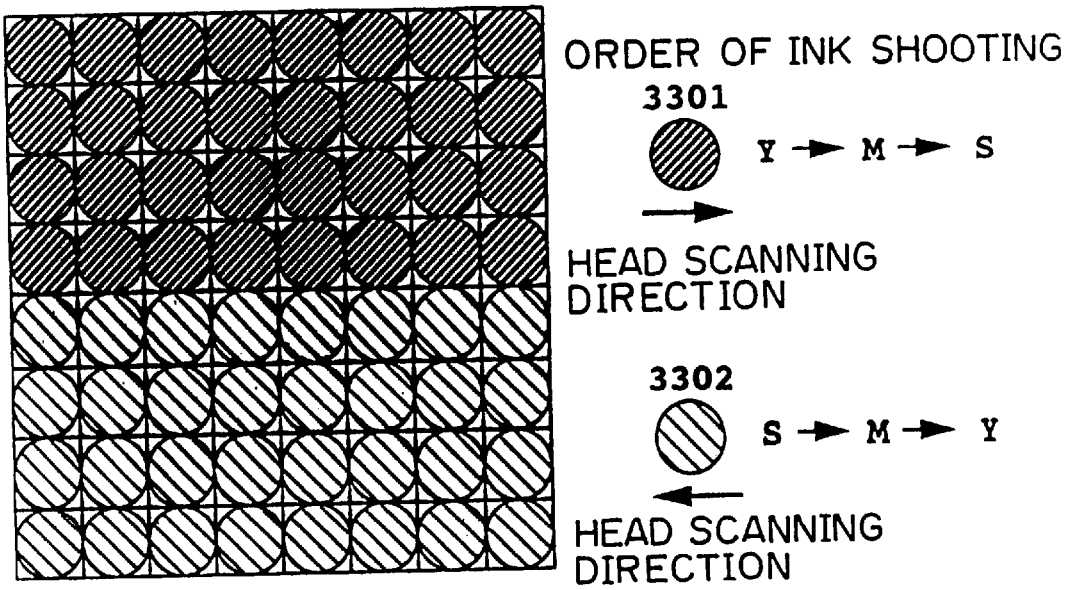
FIG. 17A and FIG. 17B are views which show reciprocable printing conducted with the use of the printing head according to the fourth embodiment in comparison with the conventional printing method.
Figure 17B:
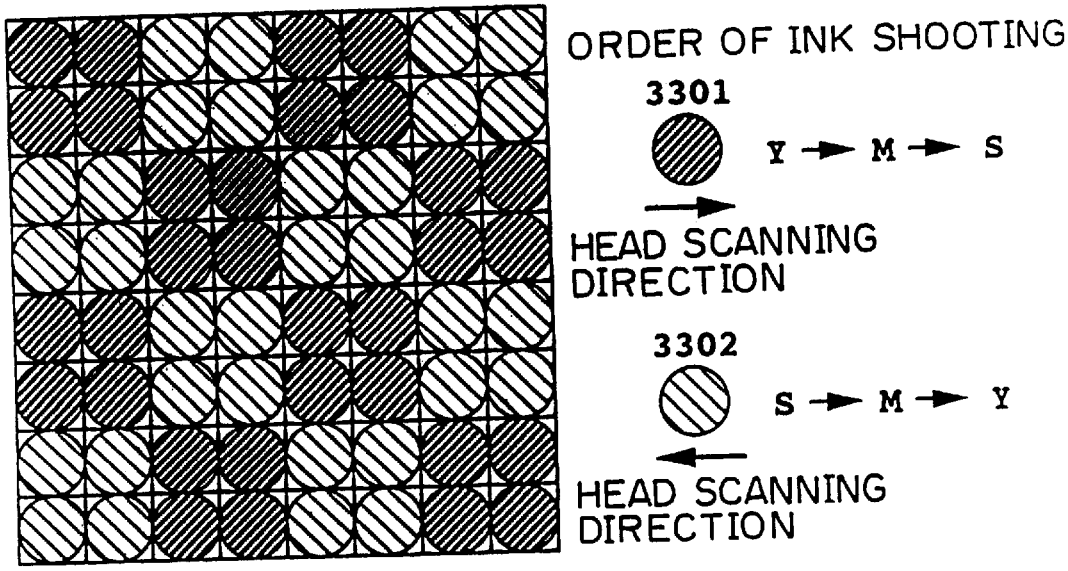

FIG. 17 shows by way of example reciprocable printing according to this embodiment in comparison with the conventional method. To facilitate understanding of an example of printing magenta ink, yellow ink and the printability improvement liquid in the case of forming red color, four nozzle head structure is shown in FIG. 17. Reference numeral 3301 denotes a pixel printed at the time of forward direction when the head unit is displaced from left to right and shot onto a printing medium in accordance with the order of Y ink→M ink→printability improvement liquid, and reference numeral 3302 denotes a pixel printed at the time of rearward direction when the head unit is displaced from right to left and shot onto the printing medium in accordance with the order of the printability improvement liquid→M ink→Y ink. When the conventional method is employed, the pixels 3301 and 3302 are printed in the form of a band having a width corresponding to the nozzle width, causing density fluctuation to be remarkably recognized (FIG. 17A). In contrast with the conventional method, according to the embodiment, pixels collected in the form of 2×2 are printed while they arranged in a zigzag or inverted zigzag pattern (FIG. 17B). Collection of the pixels in the form of 2×2 is one means for preventing an occurrence of band-shaped regular color fluctuation attributable to the order of shooting of ink caused during reciprocable printing when an image having an intermediate color is printed with full area.

Since the printability improvement liquid head is disposed with positional deviation by a quantity of half pixel in the x direction as well as in the y direction relative to colored ink heads, it is found that the same effect as mentioned in the second embodiment is obtainable even when the printability improvement liquid is printed only one pixel along the boundary in order to reduce a quantity of use of ink along the boundary. In other words, since the printability improvement liquid is shot along the boundary with positional deviation by a quantity of half pixel in all directions, it is possible to prevent an occurrence of bleed and white mist along the boundary between the Bk and the colored ink by increasing an apparent contact area even though a quantity of printability improvement liquid is reduced (by a quantity corresponding to one pixel).

In this embodiment, an effect is obtained by disposing only the printability improvement liquid on the head unit with positional deviation in the main/auxiliary scanning direction by a quantity of half pixel but it is acceptable that electrical ejecting timing is driven, e.g., in the main scanning direction with positional deviation by a quantity of half pixel, and it is obvious that the same effect as mentioned above is obtainable by feeding paper by a quantity of half pixel in the auxiliary direction.

In addition, it is acceptable that if the shot position is a position which can be divided into plural segments by processing one pixel data or employing a head disposing method, it is arbitrarily determined by the printing method and the image.

It is also possible to further increase an effect of reducing a quantity of use of the printability improvement liquid and an effect of improving the image quality by combining the positional deviation of the printability improvement liquid by a quantity of half pixel with extracting treatment/emphasizing treatment.

Further, a quantity of ejection of the printability improvement liquid may be same to that of colored ink, and at any rate, it is sufficient to determine a quantity of ejection and the shot position optimum for the printing method.

This embodiment has been described with the head structure of Bk1/S/C/M/Y but the same effect is attainable with other head structure of S/Bk/C/M/Y, Bk/C/M/Y/S or the like, only when the printability improvement liquid head and the colored ink heads are disposed with positional deviation. The same effect is also obtainable not only with the positional deviation of the head structure but also with the positional deviation by a quantity of half pixel or less in combination with the ejection timing and a quantity of paper feeding.

In this embodiment, an effect is obtained by disposing only the printability improvement liquid on the head unit while deviating it in the main scanning direction or in the auxiliary scanning direction, but it is more preferable that e.g., with respect to the main scanning direction, the printability improvement liquid is deviated further by a quantity of 1/N pixel of one pixel by utilizing the electrical timing. With respect to the auxiliary scanning direction, it is obvious that the effect is increased when an effect derived from fine printing and paper feeding by a quantity of half pixel are executed while reducing density fluctuation as a whole as multi-pass printing is performed.

Embodiments 4 to 7

FIG. 18A to FIG. 18D show an example that the shot position of the printability improvement liquid and a quantity of ejection are changed as an example of a printing method, respectively.

FIG. 18A shows by way of example other embodiment of the present invention and represents the case that the printability improvement liquid is ejected much more than the colored ink with positional deviation of ½ pixel in the x direction as well as in the y direction (Embodiment 4).

The example shown in FIG. 18B is the case that the printability improvement liquid is ejected much along the boundary between the printability improvement liquid and the colored ink with positional deviation of ½ pixel in the x direction as well as in the y direction (Embodiment 5).

FIG. 18C shows the case that the printability improvement liquid is shot less than the colored ink with positional deviation of ¼ pixel in the x direction as well as in the y direction (Embodiment 6). In this embodiment, a quantity of shooting of the printability improvement liquid is identical to that of the colored ink, and the effect is improved by dispersion of the printability improvement liquid.

The example (Embodiment 7) shown in FIG. 18D is the case that the printability improvement liquid is shot less only along the boundary between the printability improvement liquid and the colored ink with positional deviation of ¼ pixel in the x direction and in the y direction (also in this case, a quantity of shooting of the printability improvement liquid is identical to that of the colored ink and the effect is improved by dispersion of the printability improvement liquid). In other part, a quantity of shooting of the printability improvement liquid is identical to that of the colored ink.

In eighth and ninth embodiment described below, the shot position of the printability improvement liquid is deviated relative to the shot position of ink, and moreover, it is intended to reduce a quantity of consumption of the printability improvement liquid while maintaining the effect of the printability improvement liquid by ejecting it with extraction relative to the ink.

FIG. 19 shows by way of example the case that recording is effected while the shot position of the image quality improvement liquid and a quantity of extraction of the image quality improvement liquid are changed as a recording method according to the eighth embodiment. FIG. 19A is a schematic view which shows the positions where ink and printability improvement liquid are ejected.

FIG. 19B shows the case where the image quality improvement liquid is shot by the same quantity as that of the colored ink with positional deviation of half pixel in the y direction. In this case, no extraction is conducted.

FIG. 19C shows the case where the image quality improvement liquid is ejected by the same quantity as that of the colored ink. In this case, extracting treatment (extraction of 50%) is conducted.

At this time, as shown in FIG. 19A, since one dot of image improvement liquid comes in contact with upper and lower two dots of colored inks, extraction of 50% can be attained reliably. To assure that this effect is reliably maintained, it is desirable that reactive component in the image quality improvement liquid is increased by about two times.

FIG. 20 shows by way of example the case that recording is performed while the shot position of the image quality improvement liquid and the extraction rate are changed as a recording method according to the ninth embodiment. FIG. 20A is a schematic view which shows the positions where the ink and the printability improvement liquid are ejected.

FIG. 20B shows the case that the image quality liquid is shot by the same quantity as that of the colored ink with positional deviation of half pixel in the x direction as well as in the y direction. In this case, no extraction is conducted.

FIG. 20C shows the case that the image quality liquid is shot by the same quantity as that of the colored ink with positional deviation of half pixel in the x direction as well as in the y direction. In this case, extracting treatment (25% extraction) is conducted.

In this case, as shown in FIG. 20A, since one dot of image quality improvement liquid comes in contact with four dots of colored ink in all directions, extraction of 25% can be attained without fail. To assure that this effect is maintained, it is desirable that the reactive component of the image quality improvement liquid is increased by about four times.

When it is intended to reduce a running cost by reducing a quantity of use of the printability improvement liquid when extracting treatment of the printability improvement liquid is conducted in the above-described manner, there arises an occasion that the effect originally owned by the printability improvement liquid is reduced when the extracting rate exceeds in excess of a certain one (about 25%). However, it is possible to maintain the original effect even though the extracting rate is increased, by elevating the effect derived from ejecting dots of the printability improvement liquid with positional deviation relative to the ink dots and increasing a quantity of the reactive components in the printability improvement liquid. With respect to composition for improving the density of the reactive component of the printability improvement liquid, a concrete example will be shown below.

Composition of the Printing-improvement Liquid 1 (2-fold concentration)

| | |
|---|---|
| Polyallylamine hydrochloride | 10 wt % |
| Benzal conium chloride | 1.0 wt % |
| Diethylene glycol | 10.0 wt % |
| Acetylenol EH (Kawa-Ken Fine Chemical, Co., LTD.) | 0.5 wt % |
| Water | 78.5 wt % |

Composition of the Printing-improvement Liquid 2 (3-fold concentration)

| | |
|---|---|
| Polyallylamine hydrochloride | 15 wt % |
| Benzal conium chloride | 1.0 wt % |
| Diethylene glycol | 10.0 wt % |
| Acetylenol EH (Kawa-Ken Fine Chemical, Co., LTD.) | 0.5 wt % |
| Water | 73.5 wt % |

Composition of the Printing-improvement Liquid 3 (4-fold concentration)

| | |
|---|---|
| Polyallylamine hydrochloride | 20.0 wt % |
| Benzal conium chloride | 1.0 wt % |
| Diethylene glycol | 10.0 wt % |
| Acetylenol EH (Kawa-Ken Fine Chemical, Co., LTD.) | 0.5 wt % |
| Water | 68.5 wt % |

Other Examples of the Head Arrangement

Figure 21:
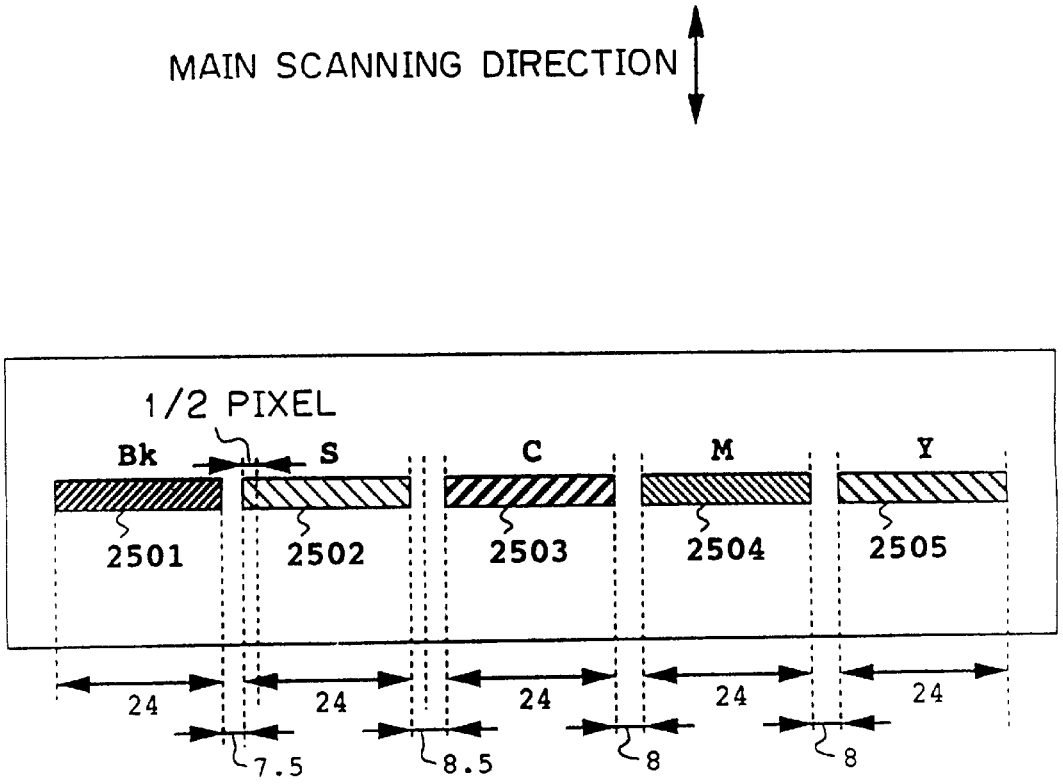
FIG. 21 is a plan view of a head unit according to other embodiment of the present invention.
Figure 22:
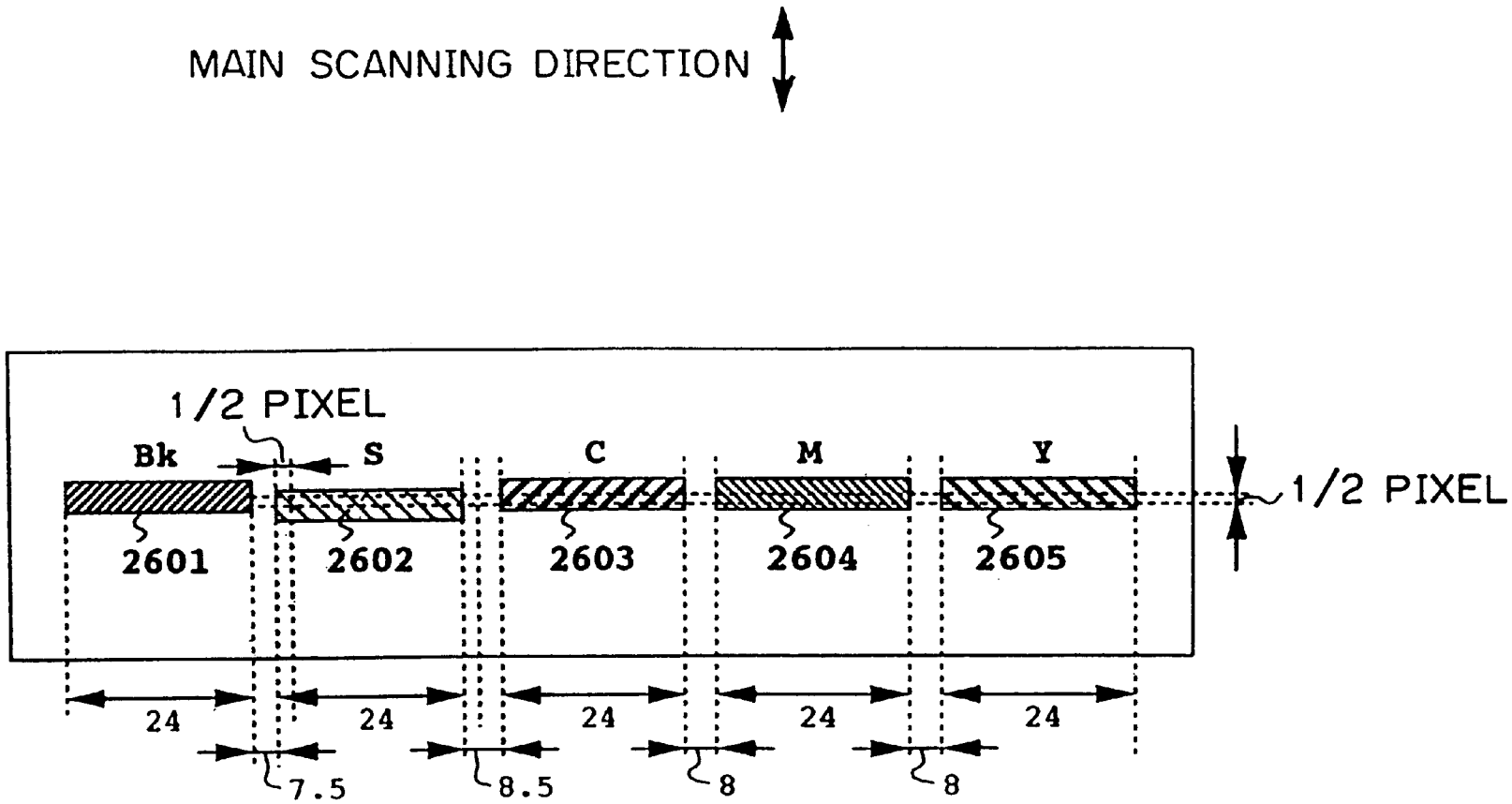
FIG. 22 is a plan view of a head unit according to other embodiment of the present invention.
Figure 23:
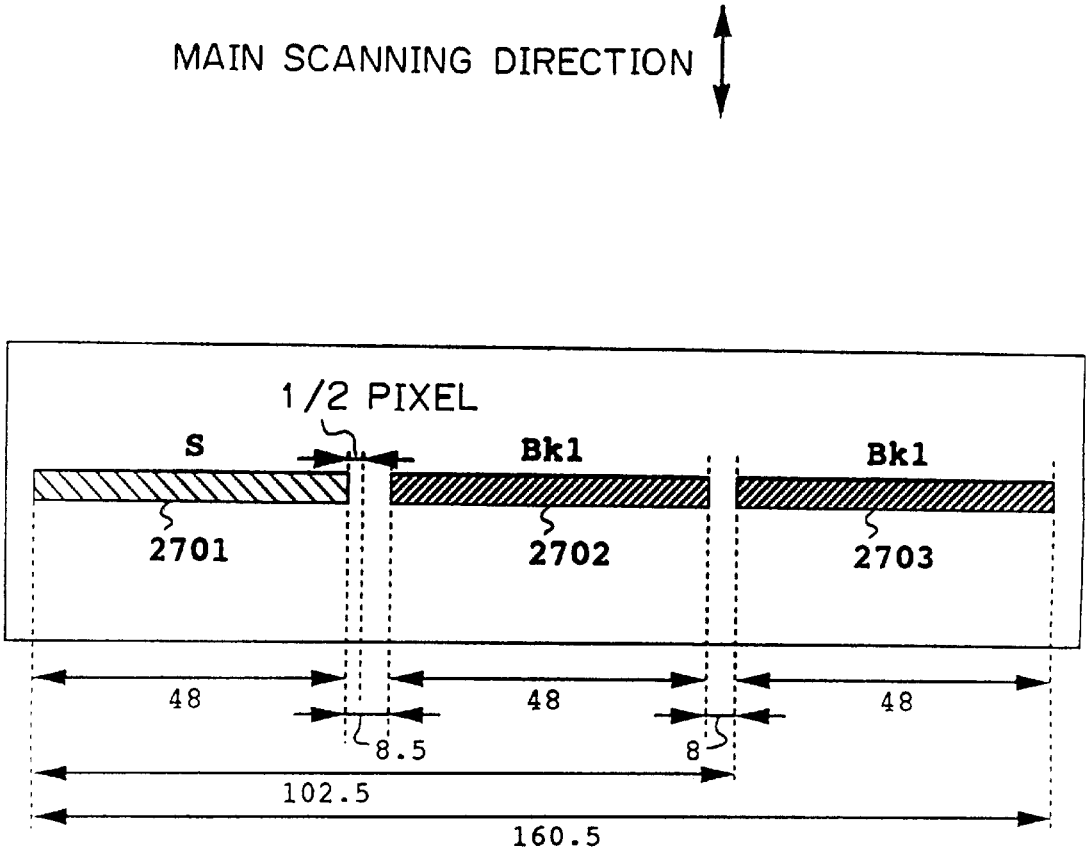
FIG. 23 is a plan view of a head unit according to other embodiment of the present invention.
Figure 24:
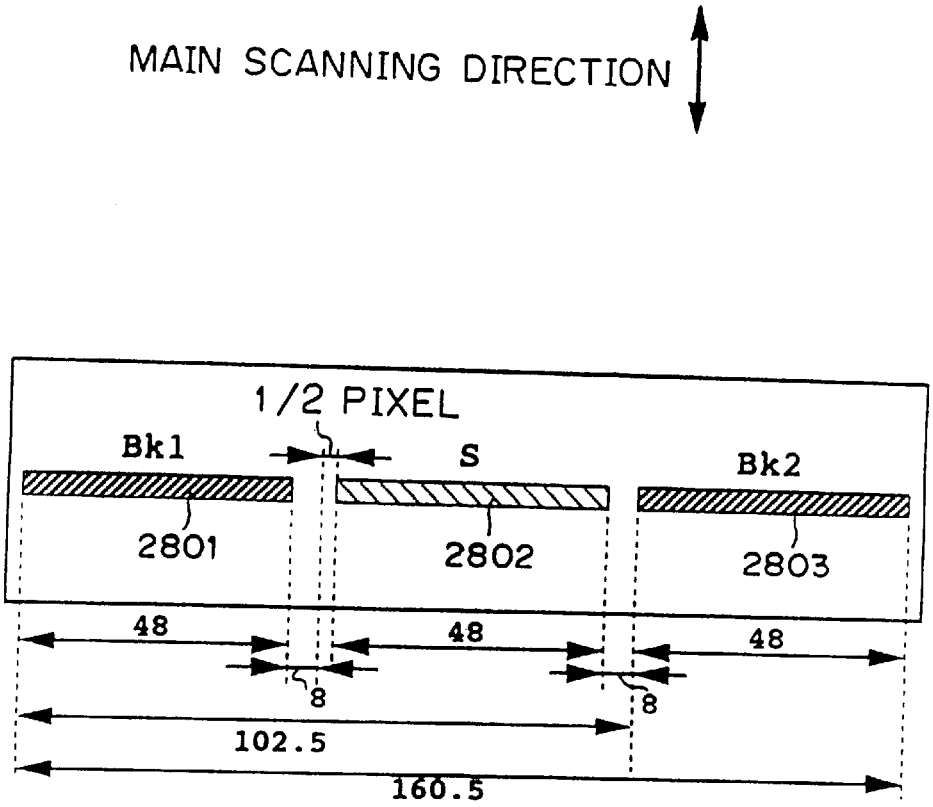
FIG. 24 is a plan view of a head unit according to other embodiment of the present invention.

As embodiments of the present invention, FIGS. 21 to 24 illustrate examples of a head arrangement of a vertical integral head type. FIG. 21 illustrates an arrangement which is similar to a second embodiment with a nozzle arrangement being such that nozzles are disposed like those of a vertical head. Bk chip 2501, S chip 2502, C chip 2503, M chip 2504, and Y chip 2505 are vertically disposed. In this arrangement, S chip 2502 is shifted by a ½ pixel in a vertical direction (in a sub-scanning direction). FIG. 22 illustrates an arrangement in which Bk chip 2601, S chip 2602, C chip 2603, M chip 2604, and Y chip 2605 are vertically disposed in a like manner as in FIG. 21. Here, S chip 2602 is shifted by a ½ pixel in either of a main scanning direction and a sub-scanning direction. FIG. 23 illustrates an arrangement in which S chip 2701, Bk1 chip 2702, and then, Bk2 chip 2703 are vertically disposed in this order, and S chip 2701 is shifted by a ½ pixel in a vertical direction (in a sub-scanning direction). FIG. 24 illustrates an arrangement in which Bk1 chip 2801, S chip 2802, and then, Bk chip 2803 are vertically disposed in this order, and S chip 2802 is shifted by a ½ pixel in a vertical direction (in a sub-scanning direction). With the head arrangements shown above, the similar advantageous results can be produced in shooting a droplet of liquid for improving printing quality and that of colored ink to different positions.

Figure 25A:
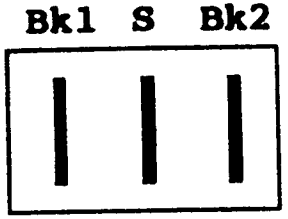
FIGS. 25A to 25C are views which show by way of example the structure of an integral type nozzle according to other embodiment of the present invention.
Figure 25B:
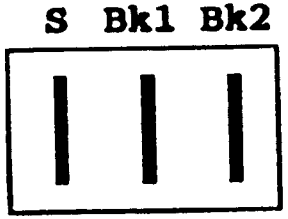
Figure 25C:
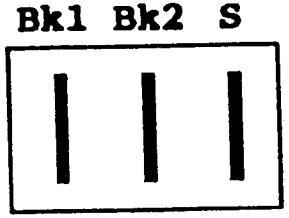
Figure 26A:
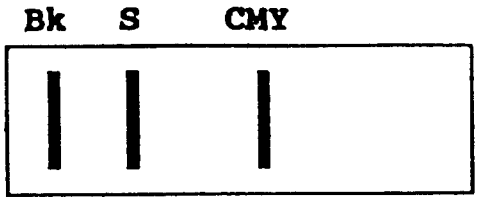
FIGS. 26A to 26C are views which show by way of example the structure of an integral type nozzle according to other embodiment of the present invention.
Figure 26B:
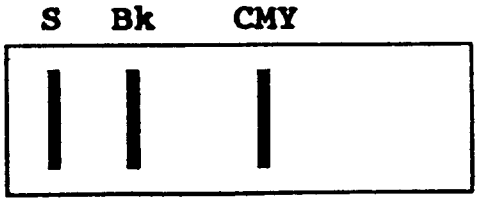
Figure 26C:
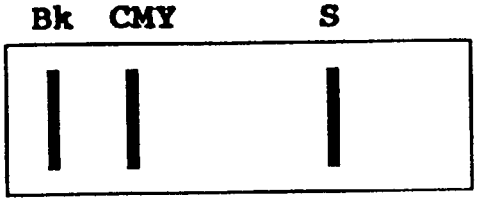
Figure 27A:
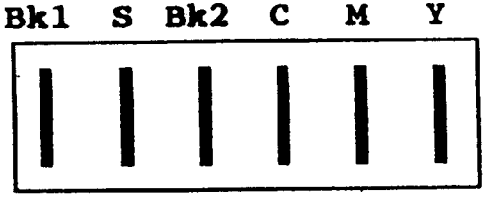
FIGS. 27A to 27D are views which show by way of example the structure of an integral type nozzle according to other embodiment of the present invention.
Figure 27B:
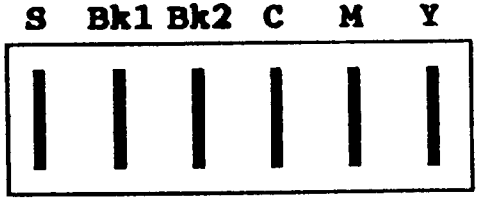
Figure 27C:
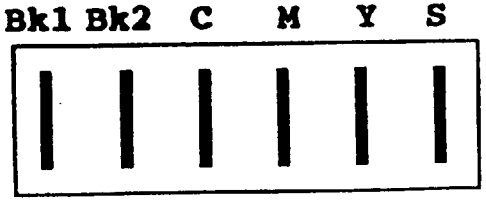
Figure 27D:
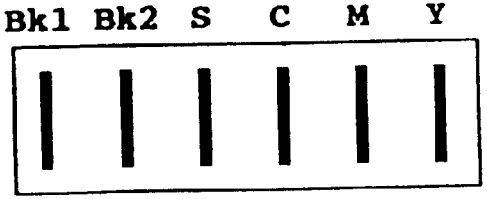

Further, as another embodiment of the present invention, FIGS. 25 to 27 illustrate another arrangements of nozzles of the head according to a first to a third embodiments. In any case, the similar advantageous results can be produced so long as a droplet of liquid for improving printing quality and that of colored ink are shot to different positions which are shifted by a ½ pixel for example. There is substantially no difference in advantageous results produced whichever way of arranging nozzles is selected.

In this case, for example, the following color ink compositions and printing improvement liquid composition are used instead of the color used, as in the case of using the ink compositions including dyestuff.

| | |
|---|---|
| 1. Yellow | |
| Glycerin | 5.0 wt % |
| Thiodiglycol | 5.0 wt % |
| Urea | 5.0 wt % |
| Isopropyl alcohol | 4.0 wt % |
| C.I. direct yellow 142 | 2.0 wt % |
| Water | 79.0 wt % |
| 2. Magenta | |
| Glycerin | 5.0 wt % |
| Thiodiglycol | 5.0 wt % |
| Urea | 5.0 wt % |
| Isopropyl alcohol | 4.0 wt % |
| C.I. acid red 289 | 2.5 wt % |
| Water | 78.5 wt % |
| 3. Cyan | |
| Glycerin | 5.0 wt % |
| Thiodiglycol | 5.0 wt % |
| Urea | 5.0 wt % |
| Isopropyl alcohol | 4.0 wt % |
| C.I. direct blue 199 | 2.5 wt % |
| Water | 78.5 wt % |
| 4. Black | |
| Glycerin | 5.0 wt % |
| Thiodiglycol | 5.0 wt % |
| Urea | 5.0 wt % |
| Isopropyl alcohol | 4.0 wt % |
| Food Black 2 | 3.0 wt % |
| Water | 78.0 wt % |
| 5. the printing-improvement liquid | |
| Polyallylamine hydrochloride | 5.0 wt % |
| Benzal conium chloride | 1.0 wt % |
| Diethylene glycol | 10.0 wt % |
| Acetylenol EH (Kawa-Ken Fine Chemicals, Co., LTD.) | 0.5 wt % |
| Water | 83.5 wt % |

The printing-improvement liquid and the ink, both having one of the above compositions (aqueous compositions), are mixed with each other at a certain inner or surface position of the recording medium as a result of their permeation therethrough. In the mixture, as a first stage of the reaction, the low molecular ingredient or the cationic oligomer of the cationic substance is associated with the anionic compound used in a pigment ink or with a water-soluble dye having an anionic group used in an ink. The moment they associated, a phase separation is occurred and results in an aggregation of the pigments or dyestuff by means a dispersion-breakdown caused in the ink or the pigment ink.

As a second stage of the reaction, an aggregate of the dyestuff or the pigments generated as a result of the above association becomes larger by adsorbing the aggregate on the surface of the high molecular ingredient being included in the recording-improvement liquid. Consequently, it becomes to difficult to introduce the aggregate into the space formed among fibers of the recording medium, while an aqueous part of the mixture without a solid part is able to permeate through the according medium. Accordingly, the high recording quality and the stable fixation can be consistent with each other.

Furthermore, the above aggregate becomes highly viscous, so that the aggregate cannot pass through the recording medium in company with the aqueous medium. Regardless of arranging the different color-ink dots so as to being adjacent to each other, as in the case of a multiple-color image formation, there is no mixing and bleeding between these different ink dots. In this case, furthermore, a light-fastness of the image can be also improved by forming the image with a screening effect of the polymer.

By the way, the term "insoluble" or "aggregation" means the observable events in only the above first step or in both the first and second steps.

For carrying out the present invention, furthermore, there is no need to use a high-molecular cationic substance and a polyvalent metal salt. Alternatively, the amount of using these substances can be kept at the minimum when there is need to use them. Because they are only used as secondary substances for further improving an effects of the present invention. As a result, we are able to give another effect of the present invention in that the present invention enables to prevent a lowering of coloring properties of the dyestuff. The lower coloring properties of the dyestuff is a problem to be caused by using the high-molecular cationic substance and the polyvalent metal salt for obtaining an effect of water-resistant in the conventional method.

The printing medium to be used for carrying out the present invention is not limited to a certain medium. It can be preferably selected from any kinds of normal paper, such as copy paper, bond paper, and so on, which have been used in the conventional printing process. It is noted that coated paper prepared especially for the ink-jet printing and transparent paper for a overhead projector can be also applied as the printing medium of the present invention. Furthermore, general wood-free paper and glossy paper are preferably used in the present invention.

Further, in practicing the present invention, ink is not limited to a dye ink. A dye ink in which a pigment is diffused may be also used. A processing liquid which solidifies the pigment may be used. As one example in which a pigment ink is solidified when mixed with colorless liquid A1, it is possible to obtain inks Y2, M2, C2 and K2 in yellow, magenta, cyan, and black which contain pigments and anion-based compounds, respectively.

<Black ink K2>

An anionic high-molecule P-1 (stylene-methacrylic acide-ethylacrylate, an acidic value 400, an average molecular weight 6,000, an aqueous liquid containing 20% solid material, and a potassium hydroxide as a liquid neutralizing agent) is used as a dispersion agent. The following materials are filled in a vertical batch-type sand mill (manufactured by Imex Co., LTD) and then glass beads of 1 mm in diameter are provided as media to fill the hole tightly. After that, the mixture is subjected to a water-cooled dispersion treatment for three hours, resulting that a fluid dispersion having the viscosity of 9 cps and the pH of 10.0. The obtained fluid dispersion is centrifuged by a centrifuge to separate contained materials of different specific gravities to remove coarse particles. Consequently, a dispersion body of carbon-black with an average particle diameter of 100 nm.

<Composition of the carbon-black dispersion body>

| | |
|---|---|
| P-1 aqueous liquid (including 20% of solidified portion) | 40 parts by weight |
| Carbon black Mogul L (Cablack made) | 24 parts by weight |
| Glycerin | 15 parts by weight |
| Ethyleneglycol monobutyl ether | 0.5 parts by weight |
| Isopropyl alcohol | 3 parts by weight |
| Water | 135 parts by weight |

A black ink K2 for the ink-jet printing, comprising pigments as sufficiently-dispersed bodies obtained by the above procedure, is thus prepared. A solidified portion of the final preparation is about 10%.

<Yellow ink Y2>

An anionic high-molecular substance P-2 (stylene-acryl acid-methylmetaacrylate, an aqueous liquid having an acid value of 280, a molecular weight of 11,000, and a solid content of 20%, and neutralizer diethanolamine ) is used as a dispersion agent. The dispersion is managed similarly to the process of preparing the black ink K2 by means of the following materials. Consequently, a yellow color dispersion body of 103 nm in average particle diameter is obtained.

<Composition of the yellow dispersion body>

| | |
|---|---|
| P-2 aqueous liquid (20% of solid content) | 35 parts by weight |
| C.I. Pigment yellow 180 (Trade name: Nova parm yellow - PH-G, manufactured by Hexist Co., LTD.) | 24 parts by weight |
| Triethylene glycol | 10 parts by weight |
| Diethylene glycol | 10 parts by weight |
| Ethyleneglycol monobutyl ether | 1.0 parts by weight |
| Isopropyl alcohol | 0.5 parts by weight |
| Water | 135 parts by weight |

A yellow ink Y2 for the ink-jet printing, comprising pigments as sufficiently-dispersed bodies obtained by the above procedure, is thus prepared. A solidified portion of the final preparation is about 10%.

3. Cyan ink C2

The anionic high-molecular substance P1, which is used in the preparation of the black ink K2, is also used as a dispersion agent for preparing the cyan ink Y2. The dispersion treatment is managed similar to the process of preparing the carbon-black dispersion by means of the following materials. Consequently, a cyan color dispersion body of 120 nm in average particle diameter is obtained.

<Composition of the cyan dispersion body>

| | |
|---|---|
| P-1 aqueous liquid (20% of solid content) | 30 parts by weight |
| C.I. Pigment blue 15:3 (Trade name: Fastgenbul-FGF, manufactured by Dai Nippon Ink Chemicals, Co., LTD.) | 24 parts by weight |
| Triethylene glycol | 10 parts by weight |
| Glycerin | 15 parts by weight |
| Diethyleneglycol monobutylether | 15 parts by weight |

-continued

| | |
|---|---|
| Isopropyl alcohol | 3 parts by weight |
| Water | 135 parts by weight |

A cyan ink C2 for the ink-jet printing, comprising pigments as sufficiently-dispersed bodies obtained by the above procedure, is thus prepared. A solidified portion of the final preparation is about 9.6%.

4. Magenta ink MC2

The anionic high-molecular substance P1, which is used in the preparation of the black ink K2, is also used as a dispersion agent for preparing the magenta ink M2. The dispersion treatment is managed similar to the process of preparing the carbon-black dispersion by means of the following materials. Consequently, a magenta color dispersion body of 115 nm in average particle diameter is obtained.

<A composition of the magenta dispersion body>

| | |
|---|---|
| P-1 aqueous liquid (20% of solid content) | 24 parts by weight |
| C.I. Pigment red 122 (manufactured by Dai Nippon Ink Chemicals, Co., LTD.) | 24 parts by weight |
| Glycerin | 15 parts by weight |
| Isopropyl alcohol | 3 parts by weight |
| Water | 135 parts by weight |

A magenta ink M2 for the ink-jet printing, comprising pigments as sufficiently-dispersed bodies obtained by the above procedure, is thus prepared. A solidified portion of the final preparation is about 9.2%.

In the above description, by the way, the embodiments that use the dyestuff including Y, M, C, and Bk ink compositions as color materials. However, it is noted that the present invention is not limited to the above compositions, but also possible to use the dyestuff including pigments as color materials, a mixture of the dyestuff and the pigments, or the like. In addition, the same effects can be obtained by using an appropriate printing-improvement liquid for aggregating each ink composition containing the color material.

Others

The present invention achieves distinct effect when applied to a printing head or a printing apparatus which has means for generating thermal energy such as electrothermal transducers or laser light, and which causes changes in the ink by the thermal energy so as to eject ink. This is because such a apparatus can achieve a high density and high reliquid printing.

A typical structure and operational principle thereof is disclosed in U.S. Pat. Nos. 4,723,129 and 4,740,796, and it is preferable to use this basic principle to implement such an apparatus. Although this apparatus can be applied either to on-demand type or continuous type ink-jet printing apparatus, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy correspondent to printing information; second, the thermal energy induces sudden temperature rise that exceeds the nucleate boiling so as to cause the film boiling on heating portions of the printing head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a printing head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the thermoelectric transducers is used as ejection orifices of the electrothermal transducers, and the latter discloses a structure in which openings for absorbing pressure waves caused by thermal energy are formed corresponding to the ejection orifices. Thus, irrespective of the type of the printing head, the present invention can achieve printing positively and effectively.

The present invention can be also applied to a so-called full-line type printing head whose length equals the maximum length across a printing medium. Such a printing head may consists of a plurality of printing heads combined together, or one integrally arranged printing head.

In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery apparatus, or a preliminary auxiliary apparatus for a printing head as a constituent of the printing apparatus because they serve to make the effect of the present invention more reliable. Examples of the recovery apparatus, are a capping means and a cleaning means for the printing head, and a pressure or suction means for the printing head. Examples of the preliminary auxiliary apparatus, are a preliminary heating means utilizing electrothermal transducers or a combination of other heater elements and the electrothermal transducers, and a means for carrying out preliminary ejection of ink independently of the ejection for printing. These apparatus are effective for reliable printing.

The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multiple-color and full-color modes. Here, the monochromatic mode performs printing by using only one major color such as black. The multiple-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink-jet apparatus, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink-jet printing apparatus of the present invention can be employed not only as an image output terminal of an information processing device such as a computer, but also as an output device of a copying machine including a reader and as an output device of a facsimile apparatus having a transmission and receiving function.

Figure 28:
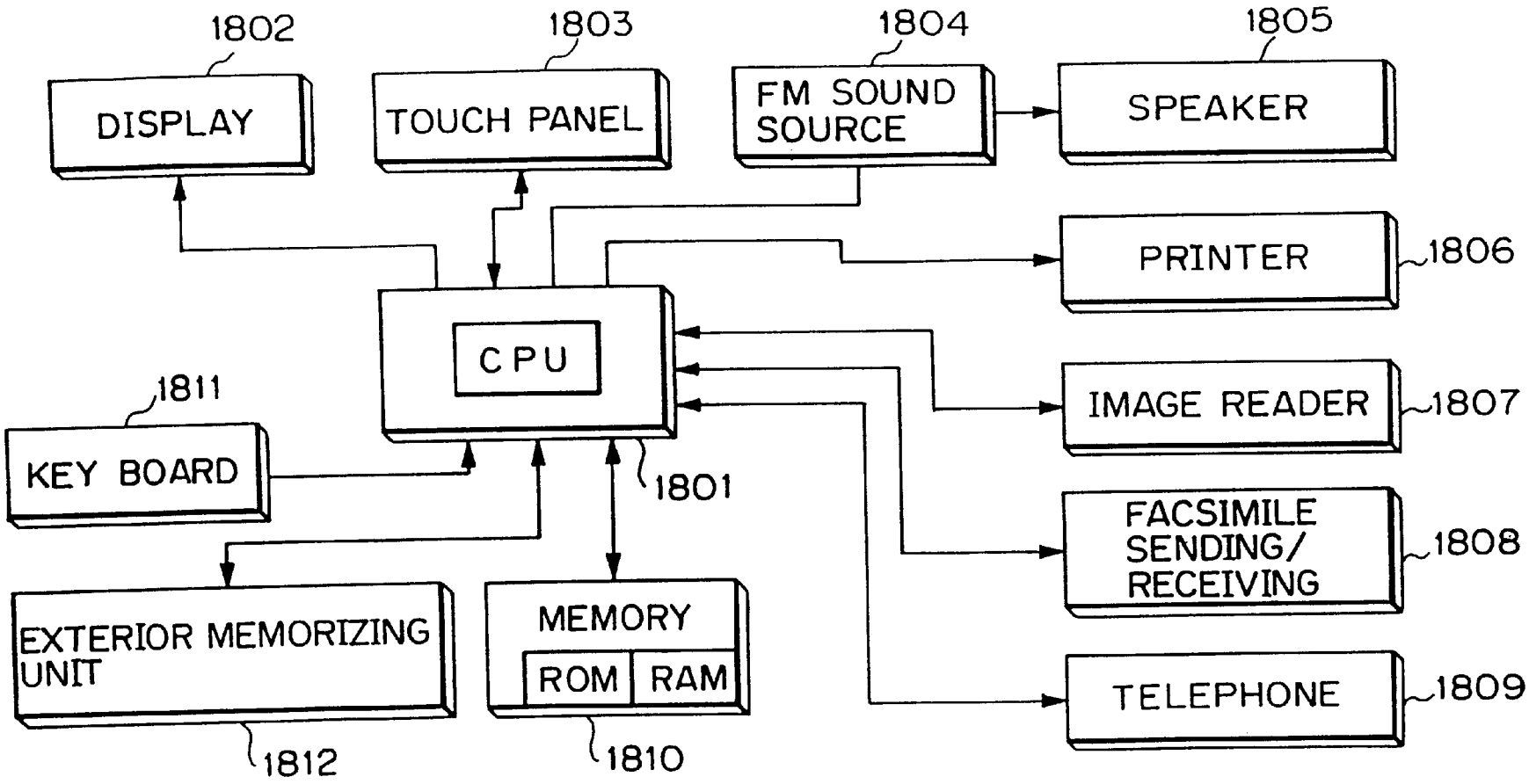
FIG. 28 is a block diagram which shows by way of example an information system for which the ink jet printing apparatus according to each of the aforementioned embodiments is used.

FIG. 28 is a block diagram showing general construction of an information processing apparatus having a function of wordprocessor, personal computer, facsimile machine, a copy machine and so forth, to which the printing apparatus according to the present invention is applied.

In the drawings, a reference numeral 1801 denotes a control portion performing control of the overall apparatus, which includes CPU, such as microprocessor and so forth, and various I/O port, to perform control for outputting control signal or data signal and so forth to respective portions and inputting control signal or data signal from the respective portions. A reference numeral 1802 denotes a display portion having a display screen, on which various menu, document information and image or so forth read by an image reader 1807 are displayed. A reference numeral 1803 denotes a transparent pressure sensitive touch panel provided on the display portion 1802 for performing item entry or coordinate portion entry on the display portion 1802 by depressing the surface thereof by a finger or so forth.

A reference numeral 1804 denotes an FM (frequency modulation) sound source portion which stores music information produced by a music editor and so forth in a memory portion 1810 or an external memory 1812 and performs FM modulation by reading out the stored music information from the memory portion or so forth. An electric signal from the FM sound source portion 1804 is transformed into an audible sound by a speaker portion 1805. A printer portion 1806 is employed as an output terminal of the wordprocessor, the personal computer, the facsimile machine, the copy machine and so forth, in which the printing apparatus according to the present invention is applied.

A reference numeral 1807 denotes an image reader portion for optoelectrically read out an original data for inputting, which is located at the intermediate position in an original feeding path and performs reading out various original document, such as original document for facsimile machine or copy machine. A reference numeral 1808 denotes a facsimile (FAX) transmission and reception portion for transmitting original data read by the image reader portion or for receiving transmitted facsimile signal, which facsimile transmission and reception portion has an external interface function. A reference numeral 1809 denotes a telephone machine portion having a normal telephone function and various associated functions, such as a printing telephone and so forth.

A reference numeral 1810 denotes a memory portion including a ROM storing a system program, a manager program, other application program and so forth, as well as character fonts, dictionary and so forth, a RAM for storing application program loaded from an external storage device 1812, document information, video information and so forth.

A reference numeral 1811 denotes a keyboard portion inputting document information or various commands. A reference numeral 1812 denotes the external storage device employing a floppy disc or hard disc drive as storage medium. In the external storage device 1812, document information, music or speech information, application program of the user and so forth are stored.

Figure 29:
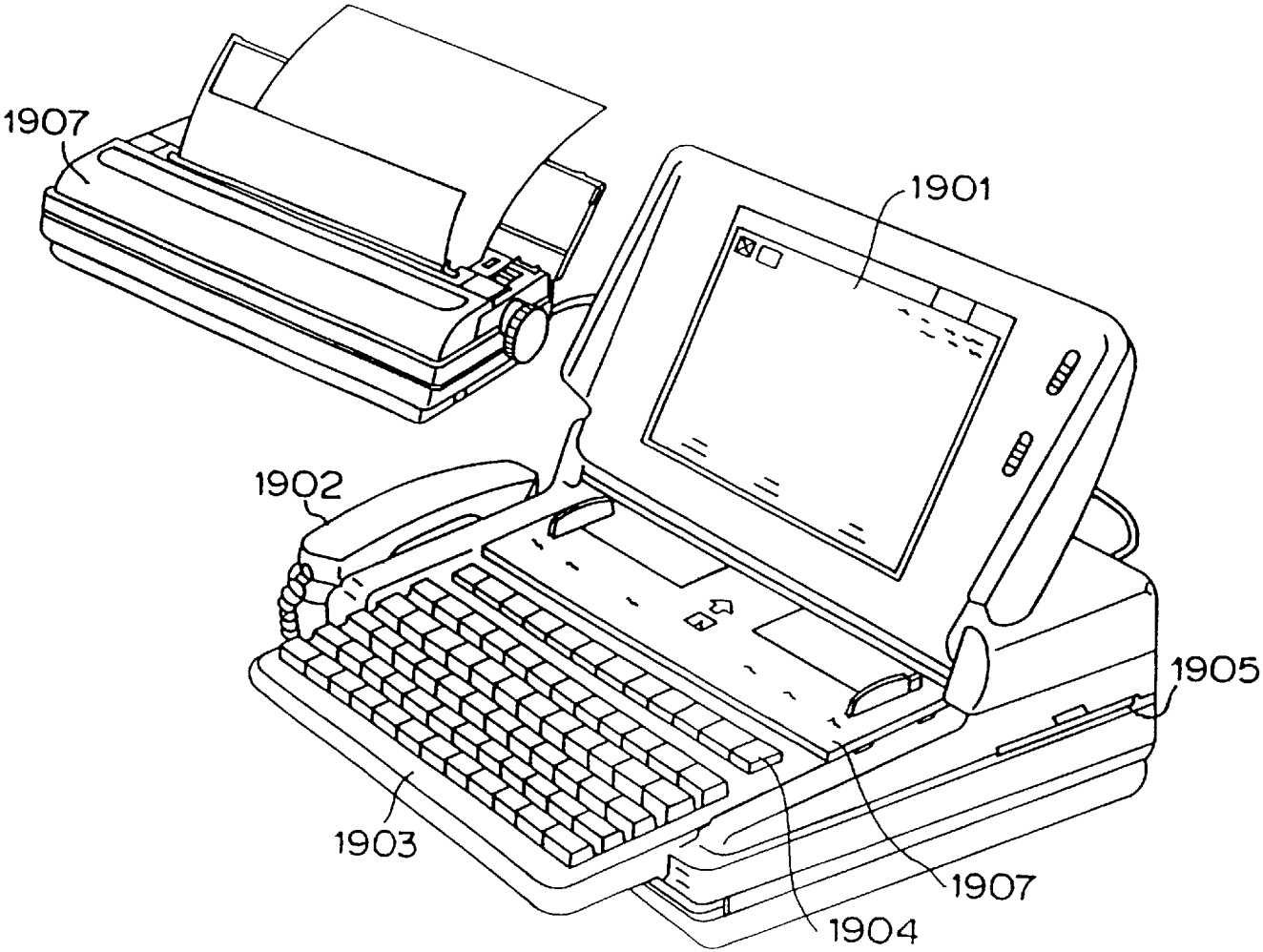
FIG. 29 is a schematic perspective view of the information system shown in FIG. 28.

FIG. 29 is a diagrammatic external view of the information processing system shown in FIG. 28.

In FIG. 29, a reference numeral 1901 denotes a flat panel display utilizing a liquid crystal and so forth. On this display, the touch panel 1803 is overlaid so that coordinate position input or item designation input can be performed by depressing the surface of the touch panel 1803 by a finger or so forth. A reference numeral 1902 denotes a handset to be used when a function as the telephone machine of the apparatus is used. A keyboard is detachably connected to a main body of the apparatus through a cable and adapted to permit entry of various document information or various data input. On the other hand, on the keyboard 1903, various function keys and so forth are arranged. A reference numeral 1905 denotes an insertion mouth of the external storage device 1812 for accommodating a floppy disk inserted thereinto.

A reference numeral 1906 denotes a paper stacking portion for stacking the original to be read by the image reader portion 1807. The original read by the image reader portion is discharged from the back portion of the apparatus. On the other hand, in facsimile reception, the received information is printed by the ink-jet printer 1907.

It should be noted that while the display portion 1802 may be a CRT, it is desirable to employ a flat display panel, such as a liquid crystal display employing a ferrodielectric liquid crystal for capability of down-sizing and reduction of thickness as well as reduction of weight.

When the information processing apparatus as set forth is operated as the personal computer or the wordprocessor, various information input through the keyboard portion 1811 is processed according to a predetermined program by the control portion 1801 and output as printed image by the printer portion 1806.

When the information processing apparatus is operated as a receiver of the facsimile machine, facsimile information input from the FAX transmission and reception portion 1808 via a communication network is subject reception process according to the predetermined program and output as received image by the printer portion 1808.

In addition, when the information processing apparatus is operated as a copy machine, the original is read by the image reader portion 1807 and the read original data is output to the printer portion as copy image via the control portion 1801.

It should be noted that, when the information processing apparatus is used as the transmitter of the facsimile machine, the original data read by the image reader 1807 is processed for transmission according to the predetermined program by the control portion, and thereafter transmitted to the communication network via the FAX transmission and reception portion 1808.

Figure 30:
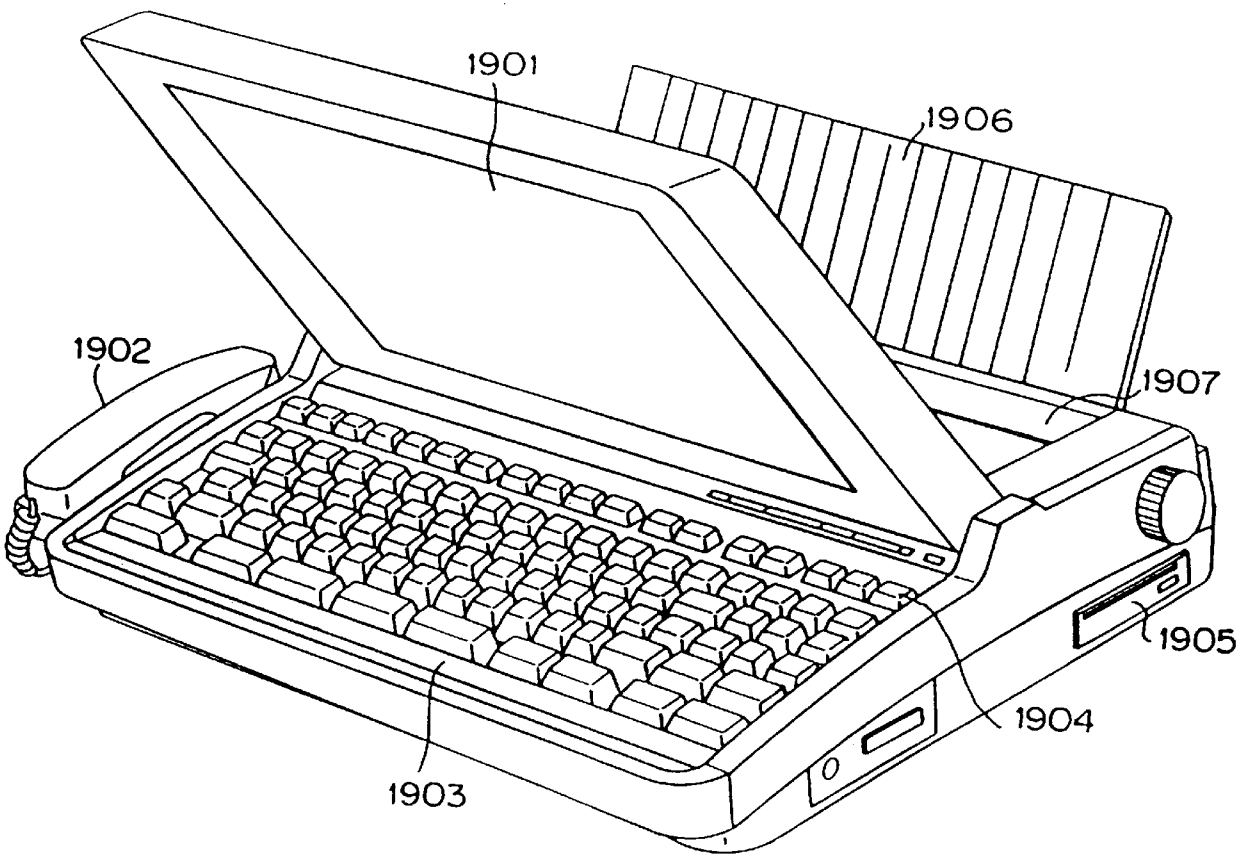
FIG. 30 is an appearance view which shows other example of the information system.

It should be noted that the information processing apparatus may be an integrated type incorporating the ink-jet printer within a main body as illustrated in FIG. 30. In this case, portability can be further improved. In FIG. 30, the portions having the same function to FIG. 29 are shown with the corresponding reference numerals.

As set forth above, a multi-function type information processing apparatus may obtain high quality printed image at high speed and low noise by employing the printing apparatus of the present invention. Therefore, the functions of the information processing apparatus can be further enhanced.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing method of printing an image of ink dots on a printing medium, said method comprising the steps of:

providing ink and printability improvement liquid containing a substance for improving printability of said ink;

ejecting said ink to a first position on the printing medium; and ejecting said printability improvement liquid to a second position on the printing medium different from the first position, with the ejected printability improvement liquid and the ejected ink coming into contact with one another, wherein the ejected printability improvement liquid partially overlaps the ejected ink on said printing medium, when the ejected printability improvement liquid and the ejected ink come into contact with each other, each ink dot consists of a portion where the printability improvement liquid and the ink are overlapped and a portion where only the ink is provided when the ejected printability improvement liquid and the ejected ink come into contact with each other on the printing medium, and a part of the plural ink dots that are provided so as to be adjacent to each other are overlapped by a single dot of the printability improvement liquid at the time that the ink and the printability improvement liquid come in contact with each other.

2. An ink jet printing method as claimed in claim 1, wherein printing of said image onto said printing medium is performed along a main scanning direction, and the position where the ejected printability improvement liquid is applied and the position where the ejected ink is applied are different along the main scanning direction.

3. An ink jet printing method as claimed in claim 1, wherein said printing medium is intermittently conveyed in an auxiliary scanning direction perpendicular to a main scanning direction along which printing of said image is performed, and the position where the ejected printability improvement liquid is applied and the position where the ejected ink is applied are different along the main scanning direction.

4. An ink jet printing method as claimed in claim 1, wherein printing of said image onto said printing medium is performed in a main scanning direction, and said printing medium is intermittently conveyed in an auxiliary scanning direction perpendicular to the main scanning direction along which said image is printed, and the position where the ejected printability improvement liquid is applied and the position where the ejected ink is applied are different in the main scanning direction as well as in the auxiliary scanning direction.

5. An ink jet printing method as claimed in claim 1, wherein an ejecting timing of said printability improvement liquid is different from an ejecting timing of said ink.

6. An ink jet printing method as claimed in claim 1, wherein a quantity of ejection of said printability improvement liquid per unit area of the printing medium is equal to or less than a quantity of ejection of said ink per unit area of the printing medium.

7. An ink jet printing method as claimed in claim 1, wherein said printability improvement liquid contains a cationic substance consisting of a first component of a first molecular weight and a cationic substance consisting of a second component having a second molecular weight higher than the first molecular weight, and said ink contains an anion based dyestuff.

8. An ink jet printing method as claimed in claim 1, wherein said printability improvement liquid contains a cationic substance consisting of a first component of a first molecular weight and a cationic substance consisting of a second component having a second molecular weight higher than the first molecular weight, and said ink contains an ion based dyestuff or at least an anion based compound and a pigment.

9. An ink jet printing method as claimed in claim 1, wherein thermal energy is used as energy of ejecting said ink and said printability improvement liquid.

10. An ink jet head used with an ink jet printing apparatus, said head comprising:

an ink ejecting portion for ejecting ink; and a liquid ejecting portion for ejecting printability improvement liquid containing a substance for improving printability of said ink, wherein said ink jet head prints an image of ink dots onto a printing medium along a main scanning direction while being mounted on the ink jet printing apparatus, and said ink ejecting portion and said liquid ejecting portion are staggered in at least one of the main scanning direction and a direction perpendicular to the main scanning direction such that an ejected ink dot and an ejected printability improvement liquid dot are mixed together on said printing medium and said ink and said printability improvement liquid are ejected to positions where centers of the ejected ink dot and the ejected printability improvement liquid dot do not coincide with each other and the ejected ink dot and the ejected printability improvement liquid dot partially overlap at a time of coming into contact with each other, and each ink dot consists of a portion where the printability improvement liquid and the ink are overlapped and a portion where only the ink is provided at the time that the ejected printability improvement liquid and the ejected ink come into contact with each other on the printing medium, a part of plural ink dots that are provided so as to be adjacent to each other is overlapped by a single dot of the printability improvement liquid at the time that the ink dots and the printability improvement liquid come into contact with each other.

11. An ink jet head as claimed in claim 10, further comprising energy generating sections for generating thermal energy for ejecting said ink and said printability improvement liquid.

12. An ink jet head used with an ink jet printing apparatus, said head comprising:

a plurality of ink ejecting portions, each for ejecting ink therefrom; and a liquid ejecting portion for ejecting printability improvement liquid containing a substance for improving printability of said ink, wherein said ink jet head prints an image formed of ink dots onto a printing medium along a main scanning direction while being mounted on the ink jet printing apparatus, and a distance between two of said ink ejecting portions located adjacent to each other in the main scanning direction is different from a distance between said liquid ejecting portion and one of said ink ejecting portions located adjacent to said liquid ejecting portion in the main scanning direction such that said liquid ejecting portion is staggered in the main scanning direction from said ink ejecting portions, and each ink dot consists of a portion where the printability improvement liquid and the ink are overlapped and a portion wherein only the ink is provided when the ejected printability improvement liquid and the ejected ink come into contact with each other on the printing medium, a part of plural ink dots that are provided so as to be adjacent to each other is overlapped by a single dot of the printability improvement liquid at the time that the ink dots and the printability improvement liquid come into contact with each other.

13. An ink jet head as claimed in claim 12, further comprising energy generating sections for generating thermal energy for ejecting said ink and said printability improvement liquid.

14. An ink jet head as claimed in claim 12, wherein said plurality of ink ejecting portions are ink ejecting portions each corresponding to color printing.

15. An ink jet head used with an ink jet printing apparatus, said head comprising:

an ink ejecting portion for ejecting ink therefrom; and a liquid ejecting portion for ejecting printability improvement liquid containing a substance for improving printability of said ink, wherein said ink jet head prints an image of ink dots onto a printing medium along a main scanning direction while being mounted on the ink jet printing apparatus, and said ink ejecting portion and said liquid ejecting portion are not arranged on a same straight line extending along the main scanning direction, and each ink dot consists of a portion where the printability improvement liquid and the ink are overlapped and a portion where only the ink is provided when the ejected printability improvement liquid and the ejected ink come into contact with each other on the printing medium, a part of plural ink dots that are provided so as to be adjacent to each other is overlapped by a single dot of the printability improvement liquid at the time that the ink dots and the printability improvement liquid come into contact with each other.

16. An ink jet head as claimed in claim 15, further comprising energy generating sections for generating thermal energy for ejecting said ink and said printability improving liquid.

17. An ink jet printing apparatus for printing an image of ink dots onto a printing medium, said apparatus comprising:

an ink jet head, said ink jet head including an ink ejecting portion for ejecting ink therefrom and a liquid ejecting portion for ejecting a printability improvement liquid containing a substance for improving printability of said ink, and printing an image onto said printing medium in a main scanning direction, wherein said ink ejecting portion and said liquid ejecting portion are staggered in at least one of the main scanning direction and a direction perpendicular to the main scanning direction such that an ejected ink dot and an ejected printability improvement liquid dot are mixed together on said printing medium and said ink and said printability improvement liquid are ejected at positions where centers of the ejected ink dot and the ejected printability improvement liquid dot do not coincide with each other and the ejected ink dot and the ejected printability improvement liquid dot partially overlap at a time of coming into contact with each other, and each ink dot consists of a portion where the printability improvement liquid and the ink are overlapped and a portion where only the ink is provided at the time that the ejected printability improvement liquid and the ejected ink come into contact with each other on the printing medium, a part of plural ink dots that are provided so as to be adjacent to each other is overlapped by a single dot of the printability improvement liquid at the time that the ink dots and the printability improvement liquid come into contact with each other.

18. An ink jet printing apparatus as claimed in claim 17, wherein said ink jet head comprises energy generating sections for generating thermal energy for ejecting said ink and said printability improvement liquid.

19. An ink jet printing apparatus as claimed in claim 17, further comprising controlling means for controlling ejecting of said printability improvement liquid under a condition that a quantity of ejection of said printability improving liquid per unit area of the printing medium is equal to or less than a quantity of ejection of said ink per unit area of the printing medium.

20. An ink jet printing apparatus as claimed in claim 17, wherein said printability improvement liquid contains a cationic substance consisting of a first component of a first molecular weight and a cationic substance consisting of a second component having a second molecular weight higher than the first molecular weight, and said ink contains an ion based dyestuff.

21. An ink jet printing apparatus as claimed in claim 17, wherein said printability improvement liquid contains a cationic substance consisting of a first component of a first molecular weight and a cationic substance consisting of a second component having a second molecular weight higher than the first molecular weight, and said ink contains an ion based dyestuff or an anion based dyestuff and a pigment.

22. An ink jet printing apparatus for printing an image onto a printing medium, said apparatus comprising:

an ink jet head, wherein said ink jet head includes a plurality of ink ejecting portions each for ejecting ink therefrom and a liquid ejecting portion for ejecting printability improvement liquid containing a substance for improving printability of said ink, and said ink jet head prints an image of ink dots onto said printing medium in a main scanning direction, and a distance between two of said ink ejecting portions located adjacent to each other along the main scanning direction is different from a distance between said liquid ejecting portion and one of said ink ejecting portions located adjacent to said liquid ejecting portion along the main scanning direction such that said liquid ejecting portion is staggered in the main scanning direction from said ink ejecting portions, and each ink dot consists of a portion where the printability improvement liquid and the ink are overlapped and a portion where only the ink is provided when the ejected printability improvement liquid and the ejected ink come into contact with each other on the printing medium, a part of plural ink dots that are provided so as to be adjacent to each other is overlapped by a single dot of the printability improvement liquid at the time that the ink dots and the printability improvement liquid come into contact with each other.

23. An ink jet printing apparatus as claimed in claim 22, wherein said ink jet head comprises energy generating sections for generating thermal energy for ejecting said ink and said printability improvement liquid.

24. An ink jet printing apparatus as claimed in claim 22, wherein said plurality of ink ejecting portions are ink ejecting portions each corresponding to color printing.

25. An ink jet printing apparatus as claimed in claim 22, further comprising controlling means for controlling ejecting of said printability improvement liquid under a condition that a quantity of ejection of said printability improvement liquid per unit area of the printing medium is equal to or less than a quantity of ejection of said ink per unit area of the printing medium.

26. An ink jet printing apparatus as claimed in claim 22, wherein said printability improvement liquid contains a cationic substance consisting of a first component of a first molecular weight and a cationic substance consisting of a second component having a second molecular weight higher than the first molecular weight, and said ink contains an anion based dyestuff.

27. An ink jet printing apparatus as claimed in claim 22, wherein said printability improvement liquid contains a cationic substance consisting of a first compound of a first molecular weight and a cationic substance consisting of a second component having a second molecular weight higher than the first molecular weight, and said ink contains an ion based dyestuff or at least an anion based compound and a pigment.

28. An ink jet printing apparatus for printing an image onto a printing medium, said apparatus comprising:

an ink jet head, wherein said ink jet head includes an ink ejecting portion for ejecting ink therefrom and a liquid ejecting portion for ejecting printability improvement liquid containing a substance for improving printability of said ink, said ink jet head printing an image of ink dots on said printing medium along a main scanning direction, and said ink ejecting portion and said liquid ejecting portion are not arranged on a same straight line extending along the main scanning direction, and each ink dot consists of a portion where the printability improvement liquid and the ink are overlapped and a portion where only the ink is provided when the ejected printability improvement liquid and the ejected ink come into contact with each other on the printing medium, a part of plural ink dots that are provided so as to be adjacent to each other is overlapped by a single dot of the printability improvement liquid at the time that the ink dots and the printability improvement liquid come into contact with each other.

29. An ink jet printing apparatus as claimed in claim 28, wherein said ink jet head comprises energy generating sections for generating thermal energy for ejecting said ink and said printability improvement liquid.

30. An ink jet printing apparatus as claimed in claim 28, further comprising controlling means for controlling ejecting of said printability improvement liquid under a condition that a quantity of ejection of said printability improvement liquid per unit area of the printing medium is equal to or less than a quantity of ejection of said ink per unit area of the printing medium.

31. An ink jet printing apparatus as claimed in claim 28, wherein said printability improvement liquid contains a cationic substance consisting of a first component of a first molecular weight and a cationic substance consisting of a second component having a second molecular weight higher than the first molecular weight, and said ink contains an anion based dyestuff.

32. An ink jet printing apparatus as claimed in claim 28, wherein said printability improvement liquid contains a cationic substance consisting of a first compound of a first molecular weight and a cationic substance consisting of a second component having a second molecular weight higher than the first molecular weight, and said ink contains an ion based dyestuff or at least an anion based compound and a pigment.

33. An ink cartridge used with an ink jet printing apparatus, said cartridge comprising:

an ink jet head; and an ink tank detachably connectable to said ink jet head, wherein said ink jet head includes an ink ejecting portion for ejecting ink and a liquid ejecting portion for ejecting printability improvement liquid containing a substance for improving printability of said ink, said ink jet head printing an image of ink dots onto a printing medium along a main scanning direction while being mounted on the ink jet printing apparatus, and said ink ejecting portion and said liquid ejecting portion are staggered in at least one of the main scanning direction and a direction perpendicular to the main scanning direction such that an ejected ink dot and an ejected printability improvement liquid dot are mixed together on said printing medium and said ink and said printability improvement liquid are ejected to positions where centers of the ejected ink dot and the ejected printability improvement liquid dot do not coincide with each other and the ejected ink dot and the ejected printability improvement liquid dot partially overlap at a time of coming into contact with each other, and each ink dot consists of a portion where the printability improvement liquid and the ink are overlapped and a portion where only the ink is provided at the time that the ejected printability improvement liquid and the ejected ink come into contact with each other on the printing medium, a part of plural ink dots that are provided so as to be adjacent to each other is overlapped by a single dot of the printability improvement liquid at the time that the ink dots and the printability improvement liquid come into contact with each other.

34. An ink jet printing method of forming an image of ink dots, said method comprising the steps of:

providing colored ink applied from an ejecting portion of an ink jet head onto a printing medium and a printability improvement liquid containing at least a printability improvement substance applied to said printing medium for improving printability in ink jet printing;

arranging a droplet of said printability improvement liquid at a first shot lattice point; and arranging a droplet of said colored ink at a second shot lattice point different from the first shot lattice point, with the printability improvement liquid and the ink coming into contact with one another, wherein the printability improvement liquid droplet partially overlaps the colored ink droplet when the printability improvement liquid droplet and the colored ink droplet come in contact with each other, and each ink dot consists of a portion where the printability improvement liquid and the colored ink are overlapped and a portion where only the ink is provided when the printability improvement liquid and the ink come into contact with each other on the printing medium, a part of plural ink dots that are provided so as to be adjacent to each other is overlapped by a single droplet of the printability improvement liquid at the time that the ink droplets and the printability improvement liquid droplets come into contact with each other.

35. An ink jet printing method as claimed in claim 34, wherein printing of said image onto said printing medium is performed along a main scanning direction, and the shot lattice point of the printability improvement liquid and the shot lattice point of the colored ink are different from each other along the main scanning direction.

36. An ink jet printing method as claimed in claim 35, wherein a positional deviation between the shot lattice points in the main scanning direction is achieved by changing an ejecting timing of said ejecting portion.

37. An ink jet printing method as claimed in claim 34, wherein said printing medium is intermittently conveyed in an auxiliary scanning direction perpendicular to a main scanning direction along which printing of said image is performed, and a shot lattice point of the printability improvement liquid and a shot lattice point of the colored ink are different from each other in the main scanning direction.

38. An ink jet printing method as claimed in claim 37, wherein a positional deviation between the lattice points in the auxiliary scanning direction is achieved by performing scannings several times while a quantity of feeding of said printing medium is changed.

39. An ink jet printing method as claimed in claim 34, wherein printing of said image onto said printing medium is achieved along a main scanning direction, and said printing medium is intermittently conveyed in an auxiliary scanning direction perpendicular to the main scanning direction along which printing of said image is performed, and a shot lattice point of the printability improvement liquid and a shot lattice point of the colored ink are different from each other in the main scanning direction as well as in the auxiliary scanning direction.

40. An ink jet printing method as claimed in claim 39, wherein a positional deviation of lattice points in the main scanning direction is achieved by changing an ejecting timing of said ejecting portion, and positional deviation of the lattice points in the auxiliary scanning direction is achieved by performing scannings several times while a quantity of feeding of said printing medium is changed.

41. An ink jet printing method as claimed in claim 34, wherein an ejecting timing of said printability improvement liquid and an ejecting timing of said ejecting head portion are different from each other.

42. An ink jet printing method as claimed in claim 34, wherein a quantity of ejection of said printability improvement liquid per unit area of the printing medium is equal to or less than a quantity of ejection of said colored ink per unit area of the printing medium.

43. An ink jet printing method as claimed in claim 34, wherein said printability improvement liquid contains a cationic substance consisting of a first component of a first molecular weight and a cationic substance consisting of a second component having a second molecular weight higher than the first molecular weight, and said ink contains an anion based dyestuff.

44. An ink jet printing method as claimed in claim 34, wherein said printability improvement liquid contains a cationic substance consisting of a first component of a first molecular weight and a cationic substance consisting of a second component having a second molecular weight higher than the first molecular weight, and said ink contains an ion based dyestuff or at least an anion based compound and a pigment.

45. An ink jet printing method as claimed in claim 34, wherein thermal energy is used as energy for ejecting said ink and said printability improvement liquid.

46. An ink jet head for forming an image of ink dots, said head comprising:

ink ejecting head portions for ejecting ink therefrom; and liquid ejecting head portions for ejecting a printability improvement liquid containing at least a printability improvement substance to be applied to a printing medium for improving printability in ink jet printing, wherein at least one of said liquid ejecting head portions has a head structure that is deviated relatively to at least one of said ink ejecting head portions such that said at least one of said liquid ejecting head portions is staggered in at least one direction from said at least one of said ink ejecting head portions, and each ink dot consists of a portion where the printability improvement liquid and the ink are overlapped and a portion where only the ink is provided when the printability improvement liquid and the ink come into contact with each other on a printing medium, a part of plural ink dots that are provided so as to be adjacent to each other is overlapped by a single dot of the printability improvement liquid at the time that the ink dots and the printability improvement liquid come into contact with each other.

47. An ink jet head as claimed in claim 46, wherein said head structure is deviated in a main scanning direction of a printed image.

48. An ink jet head as claimed in claim 46, wherein said head structure is deviated in an auxiliary scanning direction of a printed image.

49. An ink jet head as claimed in claim 46, wherein said head structure is deviated in a main scanning direction as well as in an auxiliary scanning direction of a printed image.

50. An ink jet head as claimed in claim 46, further comprising electrothermal transducers as energy generating elements for generating thermal energy for causing a phenomenon of film boiling to appear in said ink or in said printability improvement liquid.

51. An ink jet printing apparatus for printing an image of ink dots on a printing medium, said apparatus comprising:

an ink jet head, wherein said ink jet head includes ink ejecting portions for ejecting ink and liquid ejecting portions for ejecting a printability improvement liquid including at least a printability improvement substance to be applied to a printing medium for improving printability in ink jet printing, and at least one of the liquid ejecting portions is deviated relatively to at least one of the ink ejecting portions such that said at least one of said liquid ejecting portions is staggered in at least one direction from said at least one of said ink ejecting portions, and each ink dot consists of a portion where the printability improvement liquid and the ink are overlapped and a portion where only the ink is provided when the printability improvement liquid and the ink come into contact with each other on the printing medium, a part of plural ink dots that are provided so as to be adjacent to each other is overlapped by a single dot of the printability improvement liquid at the time that the ink dots and the printability improvement liquid come into contact with each other.

52. An ink jet printing apparatus as claimed in claim 51, further comprising a main body, wherein said ink jet head is detachably arranged on said main body.

53. An ink jet cartridge for forming an image of ink dots, said cartridge comprising:

an ink jet head; and an ink tank detachably connected to said ink jet head, wherein said ink jet head includes ink ejecting portions for ejecting ink and liquid ejecting portions for ejecting a printability improving liquid including at least a printability improvement substance to be applied to a printing medium for improving printability in ink jet printing, and at least one of the liquid ejecting portions is deviated relatively to at least one of the ink ejecting portions such that said at least one of said liquid ejecting portions is staggered in at least one direction from said at least one of said ink ejecting portions, and each ink dot consists of a portion where the printability improvement liquid and the ink are overlapped and a portion where only the ink is provided when the ejected printability improvement liquid and the ejected ink come into contact with each other on the printing medium, a part of plural ink dots that are provided so as to be adjacent to each other is overlapped by a single dot of the printability improvement liquid at the time that the ink dots and the printability improvement liquid come into contact with each other.

54. An ink jet printing method of printing an image of ink dots on a printing medium by applying ink and printability improvement liquid containing a substance for improving printability of said ink to said printing medium, comprising the steps of:

applying a dot of said printability improvement liquid to said printing medium; and applying a dot of said ink to said printing medium, wherein the dot of said printability improvement liquid and the dot of said ink are combined together on said printing medium and the dot of said printability improvement liquid and the dot of said ink are applied to positions where centers of the dot of said ink and the dot of said printability improvement liquid do not coincide with each other, and the applied ink dot and the applied printability improvement liquid dot partially overlap at a time of coming into contact with each other, and each ink dot consists of a portion where the printability improvement liquid and the ink are overlapped and a portion where only the ink is provided when the printability improvement liquid and the ink come into contact with each other on the printing medium, a part of plural ink dots that are provided so as to be adjacent to each other is overlapped by a single dot of the printability improvement liquid at the time that the ink dots and the printability improvement liquid come into contact with each other.

55. An ink jet printing method of printing an image of ink dots on a printing medium by applying ink and a printability improvement liquid containing a component having a function of making a coloring material in the ink insoluble or aggregating said coloring material by bringing said liquid in contact with said ink, comprising the steps of:

applying a dot of said printability improvement liquid to said printing medium; and applying a dot of said ink to said printing medium, wherein the dot of said printability improvement liquid and the dot of said ink are combined together on said printing medium and the dot of said printability improvement liquid and the dot of said ink are applied to positions where centers of the dot of said ink and the dot of said printability improvement liquid do not coincide with each other, and the applied ink dot and the applied printability improvement liquid dot partially overlap at a time of coming into contact with each other, and each ink dot consists of a portion where the printability improvement liquid and the ink are overlapped and a portion where only the ink is provided when the printability improvement liquid and the ink come into contact with each other on the printing medium, a part of plural ink dots that are provided so as to be adjacent to each other is overlapped by a single dot of the printability improvement liquid at the time that the ink dots and the printability improvement liquid come into contact with each other.

56. An ink jet printing apparatus for printing an image of dots on a printing medium, said apparatus comprising:

an ink jet head, wherein said ink jet head includes an ink ejecting portion for ejecting ink therefrom and a liquid ejecting portion for ejecting a printability improvement liquid containing a substance having a function of making a coloring material in the ink insoluble or aggregating said coloring material by bringing said printability improvement liquid into contact with said ink, and forms said image on said printing medium along a main scanning direction, said ink ejecting portion and said liquid ejecting portion being staggered in at least one direction, and a dot of said ink ejected from said ink ejecting portion and a dot of said printability improvement liquid ejected from said liquid ejecting portion are combined together on said printing medium, and said ink and said liquid are ejected to positions where centers of the dot of said ink and the dot of said printability improvement liquid do not coincide with each other, and the ejected ink dot and the ejected printability improvement liquid dot partially overlap at a time of coming into contact with each other, and each ink dot consists of a portion where the printability improvement liquid and the ink are overlapped and a portion where only the ink is provided when the ejected printability improvement liquid and the ejected ink come into contact with each other on the printing medium, a part of plural ink dots that are provided so as to be adjacent to each other is overlapped by a single dot of the printability improvement liquid at the time that the ink dots and the printability improvement liquid come into contact with each other.

* * * * *

UNITED STATES PATENT AND TRADEMARK OFFICE

CERTIFICATE OF CORRECTION

PATENT NO. : 6,120,141

DATED : September 19, 2000

INVENTOR(S) : TAJIKA, ET AL.

It is certified that error appears in the above-identified patent and that said Letters Patent is hereby corrected as shown below:

[56] References Cited:
FOREIGN PATENT DOCUMENTS, "4247942 of 1992" should read --4-247942 9/1992--.

COLUMN 5:
Line 66, "are" should read --do--.

COLUMN 6:
Line 63, "it" should be deleted.

COLUMN 9:
Line 34, "an" (first occurrence) should read --a--.
Line 42, "are" should read --do--.
Line 53, "at least one of" should be deleted.
Line 54, "at least one of" should be deleted.

COLUMN 11:
Line 20, "FIG." should read --FIGS.--.
Line 30, "other" should read --another--.
Line 32, "other" should read --another--.
Line 35, "other" should read --another--.
Line 37, "other" should read --another--.
Line 55, "other" should read --another--.

COLUMN 12:
Line 11, "half" should read --a half--.

UNITED STATES PATENT AND TRADEMARK OFFICE

CERTIFICATE OF CORRECTION

PATENT NO. : 6,120,141

DATED : September 19, 2000

INVENTOR(S) : TAJIKA, ET AL.

It is certified that error appears in the above-identified patent and that said Letters Patent is hereby corrected as shown below:

COLUMN 13:
Line 17, "spongy" should read --a sponge--.

COLUMN 18:
Line 28, "5013" should read --5013.--.

COLUMN 19:
Line 23, "on" should read --in--.

COLUMN 20:
Line 55, "Mode" should read --Mode:--.

COLUMN 21:
Line 2, "most" should read --mist--.

COLUMN 22:
Line 49, "c" should read --C--.
Line 52, "Bl" should read --Bk--.

COLUMN 23:
Line 7, "while" should read --white--, and "occurs." should read --occur.--.
Line 37, "cock ring" should read --cockling--.

COLUMN 24:
Line 5, "cock ring" should read --cockling--.
Line 20, "liquid____ink" should read --liquid-ink--.

COLUMN 25:
Line 59, "a" (second occurrence) should read --an--.

UNITED STATES PATENT AND TRADEMARK OFFICE

CERTIFICATE OF CORRECTION

PATENT NO. : 6,120,141

DATED : September 19, 2000

INVENTOR(S) : TAJIKA, ET AL.

It is certified that error appears in the above-identified patent and that said Letters Patent is hereby corrected as shown below:

COLUMN 33:
Line 22, "methylmetaacrylate," should read --methylmethacrylate,--.
Line 24, "neutralizer" should read --neutralizer:--.
Line 49, "P1," should read --P-1,--.

COLUMN 34:
Line 50, "a" (first occurrence) should read --an--, and "reliquid" should read --resolution--.

COLUMN 35:
Line 45, "apparatus," should read --apparatus--.
Line 48, "apparatus," should read --apparatus--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*